US011259599B2

(12) United States Patent
Bruce et al.

(10) Patent No.: US 11,259,599 B2
(45) Date of Patent: Mar. 1, 2022

(54) LACING SYSTEM

(71) Applicant: NIKE, Inc., Beaverton, OR (US)

(72) Inventors: Katelyn Bruce, Hillsboro, OR (US); Piero Fenato, Beaverton, OR (US); Kevin W. Hoffer, Portland, OR (US); Daniel A. Johnson, Portland, OR (US); Elizabeth A. Kilgore, Portland, OR (US); Peter Lam, Portland, OR (US); Jeffrey C. Spanks, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/595,839

(22) Filed: Oct. 8, 2019

(65) Prior Publication Data

US 2020/0037708 A1 Feb. 6, 2020

Related U.S. Application Data

(63) Continuation of application No. 15/458,816, filed on Mar. 14, 2017, now Pat. No. 10,537,155.
(Continued)

(51) Int. Cl.

| | |
|---|---|
| ***A43B 11/00*** | (2006.01) |
| ***A43B 1/06*** | (2006.01) |
| ***A43B 3/00*** | (2006.01) |
| ***A43B 13/14*** | (2006.01) |
| ***A43B 23/02*** | (2006.01) |
| ***A43C 1/00*** | (2006.01) |
| ***A43C 11/12*** | (2006.01) |
| ***A43C 11/16*** | (2006.01) |

(Continued)

(52) U.S. Cl.
CPC ..... *A43C 11/008* (2013.01); *A43B 3/0005* (2013.01); *A43B 13/14* (2013.01); *A43B 23/0245* (2013.01); *A43C 1/00* (2013.01); *A43C 1/06* (2013.01); *A43C 11/12* (2013.01); *A43C 11/165* (2013.01); *Y10T 24/3734* (2015.01); *Y10T 24/3737* (2015.01); *Y10T 24/3742* (2015.01)

(58) Field of Classification Search
None
See application file for complete search history.

(56) References Cited

U.S. PATENT DOCUMENTS 319,190 A * 6/1885 Bryant ..... 1/4
2,109,751 A 3/1938 Matthias
(Continued)

FOREIGN PATENT DOCUMENTS

WO WO-2018080580 A1 5/2018

OTHER PUBLICATIONS

International Application Serial No. PCT/US2017/022338, International Search Report and Written Opinion, dated Jul. 24, 2017.

*Primary Examiner* — Jila M Mohandesi
(74) *Attorney, Agent, or Firm* — Honigman LLP; Matthew H. Szalach; Jonathan O'Brien

(57) ABSTRACT

A lace-receiving assembly includes a substrate, a first sheet, and a lace guide. The substrate includes a first surface and a second surface opposite the first surface. The first sheet includes a third surface and a fourth surface opposite the third surface. The third surface is bonded to the first surface to define a channel extending between the substrate and the first sheet. The lace guide is disposed within the channel.

17 Claims, 29 Drawing Sheets

Related U.S. Application Data

(60) Provisional application No. 62/424,294, filed on Nov. 18, 2016, provisional application No. 62/413,142, filed on Oct. 26, 2016.

(51) Int. Cl.
*A43C 11/00* (2006.01)
*A43C 1/06* (2006.01)

(56) References Cited

U.S. PATENT DOCUMENTS 4,937,952 A 7/1990 Olivieri
5,117,567 A 6/1992 Berger
5,983,530 A 11/1999 Chou
6,324,774 B1 12/2001 Zebe, Jr.
6,922,917 B2 8/2005 Kerns et al.
7,096,559 B2 8/2006 Johnson
7,281,341 B2 * 10/2007 Reagan ..... A43B 3/0031 36/50.1
7,841,106 B2 11/2010 Farys
8,474,157 B2 7/2013 Motawi et al.
8,713,820 B2 5/2014 Kerns et al.
8,881,430 B2 * 11/2014 Seamarks ..... A43B 23/0275 36/45
9,132,601 B2 * 9/2015 Beye ..... B32B 5/02
9,474,328 B2 * 10/2016 Beye ..... A43C 1/04
2003/0204938 A1 11/2003 Hammerslag
2004/0181972 A1 * 9/2004 Csorba ..... A43C 11/14 36/50.1
2006/0196083 A1 * 9/2006 Martin ..... A43B 5/0405 36/50.5
2007/0068040 A1 3/2007 Farys
2008/0307673 A1 12/2008 Johnson
2013/0019500 A1 * 1/2013 Greene ..... A43B 13/223 36/50.1
2013/0086816 A1 4/2013 Johnson et al.
2014/0196310 A1 * 7/2014 Beye ..... B32B 5/22 36/45
2014/0196311 A1 * 7/2014 Follet ..... B32B 5/06 36/45
2015/0059206 A1 * 3/2015 Lovett ..... F16G 11/02 36/50.1
2016/0198803 A1 7/2016 Soderberg et al.
2016/0213099 A1 7/2016 Ha et al.

* cited by examiner

LACING SYSTEM

CROSS REFERENCE TO RELATED APPLICATIONS

This application is a continuation of, and claims priority under 35 U.S.C. § 120 from, U.S. patent application Ser. No. 15/458,816, filed on Mar. 14, 2017, which claims the benefit of priority of U.S. Provisional Patent Application Ser. No. 62/413,142, filed on Oct. 26, 2016, and of U.S. Provisional Patent Application Ser. No. 62/424,294, filed on Nov. 18, 2016, the benefit of priority of each of which is claimed hereby, and each of which is incorporated by reference herein in its entirety.

FIELD

The present disclosure relates generally to an article, such as an article of footwear, having a lacing system for moving the article between a tightened state and a loosened state, and to methods of manufacturing a lacing system.

The following specification describes various aspects of a footwear assembly involving a lacing system including a motorized or non-motorized lacing engine, footwear components related to the lacing engines, automated lacing footwear platforms, and related manufacturing processes. More specifically, much of the following specification describes various aspects of lacing architectures (configurations) for use in footwear including motorized or non-motorized lacing engines for centralized lace tightening.

BACKGROUND

This section provides background information related to the present disclosure and is not necessarily prior art.

Articles such as footwear, apparel, and luggage conventionally include a closure system having laces, straps, or other fasteners to move the article between a tightened state and a loosened state, or to adjust the relative tightness of the article. For example, known lacing systems typically include a lace that extends through a plurality of apertures and can be manipulated to apply tension to one or more portions of the article for closing an opening of the article. For instance, in an article of footwear, laces may be tightened to close an upper of the article of footwear around a foot, and tied once a desired fit of the upper around the foot is attained. Care is required to ensure that the upper is not too loose or too tight around the foot each time the laces are tied. While fasteners such as hook-and-loop fasteners are easier and quicker to operate than traditional laces, these fasteners have a propensity to wear out over time and require more attention to attain a desired tension when securing the upper to the foot.

While conventional lacing systems allow a user to increase the magnitude of tension of one or more laces to achieve a desired tightness, use of such lacing systems often results in friction between the lace and the upper and, as such, not only resists movement of the lace relative to the upper but, also, causes wear on both the lace and the upper. Moreover, the resulting conventional lacing system often detracts from the general appearance and aesthetics of the footwear.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

Figure 1:
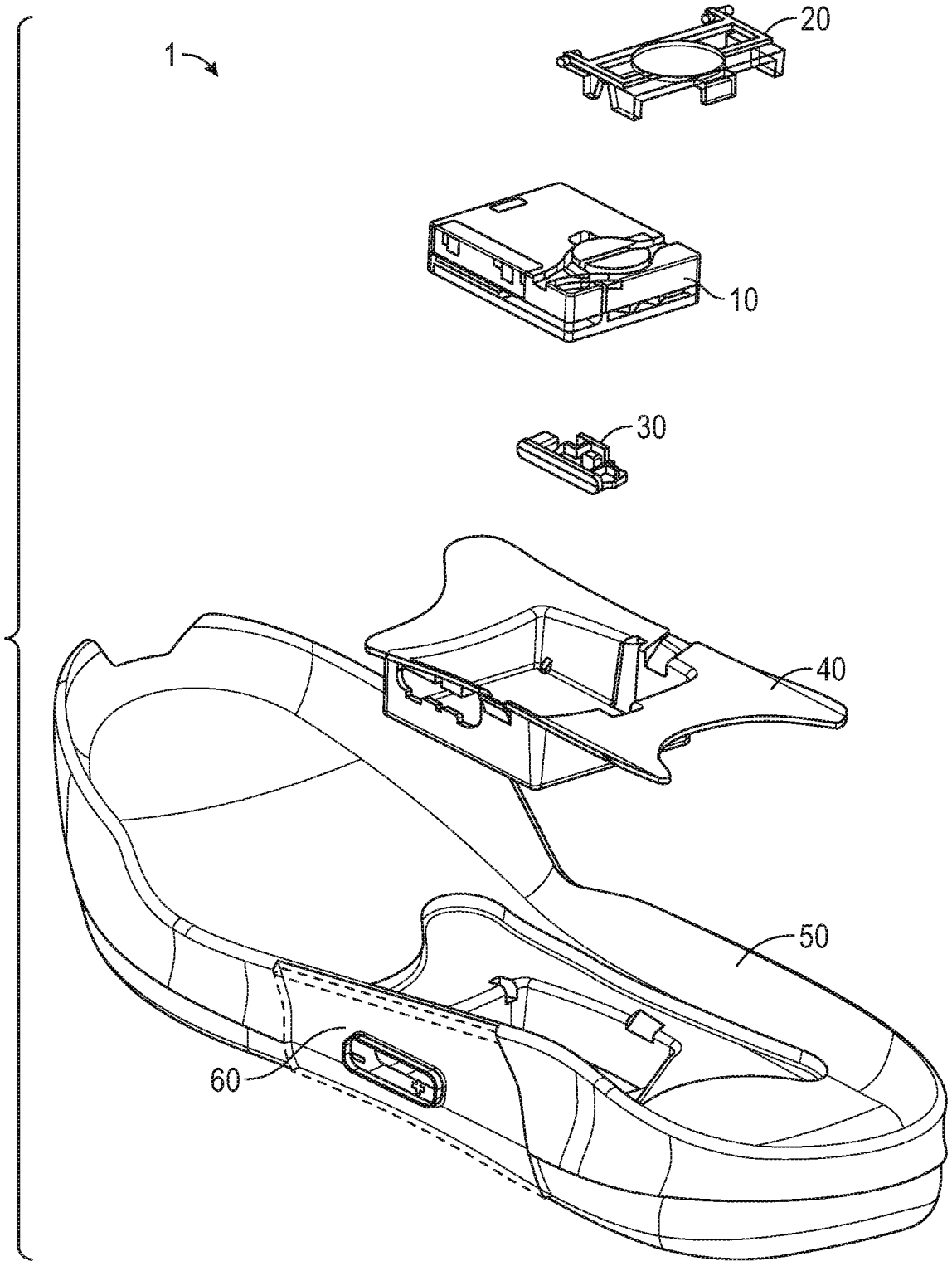
FIG. 1 is an exploded view illustration of components of a portion of a footwear assembly with a motorized lacing system, according to some example embodiments.

Any headings provided herein are merely for convenience and do not necessarily affect the scope or meaning of the terms used or discussion under the heading.

DETAILED DESCRIPTION

The concept of self-tightening shoe laces was first widely popularized by the fictitious power-laced Nike® sneakers worn by Marty McFly in the movie Back to the Future II, which was released back in 1989. While Nike® has since released at least one version of power-laced sneakers similar in appearance to the movie prop version from Back to the Future II, the internal mechanical systems and surrounding footwear platform employed do not necessarily lend themselves to mass production or daily use. Additionally, other previous designs for motorized lacing systems comparatively suffered from problems such as high cost of manufacture, complexity, assembly challenges, and poor serviceability. The present inventors have developed a modular footwear platform to accommodate motorized and non-motorized lacing engines that solves some or all of the problems discussed above, among others. In order to fully leverage the modular lacing engine discussed briefly below and in greater detail in Application Ser. No. 62/308,686, titled "LACING APPARATUS FOR AUTOMATED FOOTWEAR PLATFORM," the present inventors developed a lacing architectures discussed herein. The lacing architectures discussed herein can solve various problems experienced with centralized lace tightening mechanisms, such as uneven tightening, fit, comfort, and performance. The lacing architectures provide various benefits, including smoothing out lace tension across a greater lace travel distance and enhanced comfort while maintaining fit performance. One aspect of enhanced comfort involves a lacing architecture that reduces pressure across the top of the foot. Example lacing architectures can also enhance fit and performance by manipulating lace tension both a medial-lateral direction as well as in an anterior-posterior (front to back) direction. Various other benefits of the components described below will be evident to persons of skill in the relevant arts.

The lacing architectures discussed were developed specifically to interface with a modular lacing engine positioned within a mid-sole portion of a footwear assembly. However, the concepts could also be applied to motorized and manual lacing mechanisms disposed in various locations around the footwear, such as in the heel or even the toe portion of the footwear platform. The lacing architectures discussed include use of lace guides that can be formed from tubular plastic, metal clip, fabric loops or channels, plastic clips, and open u-shaped channels, among other shapes and materials. In some examples, various different types of lacing guides can be mixed to perform specific lace routing functions within the lacing architecture.

The motorized lacing engine discussed below was developed from the ground up to provide a robust, serviceable, and inter-changeable component of an automated lacing footwear platform. The lacing engine includes unique design elements that enable retail-level final assembly into a modular footwear platform. The lacing engine design allows for the majority of the footwear assembly process to leverage known assembly technologies, with unique adaptions to standard assembly processes still being able to leverage current assembly resources.

In an example, the modular automated lacing footwear platform includes a mid-sole plate secured to the mid-sole for receiving a lacing engine. The design of the mid-sole plate allows a lacing engine to be dropped into the footwear platform as late as at a point of purchase. The mid-sole plate, and other aspects of the modular automated footwear platform, allow for different types of lacing engines to be used interchangeably. For example, the motorized lacing engine discussed below could be changed out for a human-powered lacing engine. Alternatively, a fully automatic motorized lacing engine with foot presence sensing or other optional features could be accommodated within the standard mid-sole plate.

Utilizing motorized or non-motorized centralized lacing engines to tighten athletic footwear presents some challenges in providing sufficient performance without sacrificing some amount of comfort. Lacing architectures discussed herein have been designed specifically for use with centralized lacing engines, and are designed to enable various footwear designs from casual to high-performance.

At least a portion of an upper of an article of footwear, and in some embodiments substantially the entirety of the upper, may be formed of a knitted component. The knitted component may additionally or alternatively form another element of the article of footwear such as the midsole, for example. The knitted component may have a first side forming an inner surface of the upper (e.g., facing the void of the article of footwear) and a second side forming an outer surface of the upper (e.g. facing generally away from the first side). An upper including the knitted component may substantially surround the void so as to substantially encompass the foot of a person when the article of footwear is in use. The first side and the second side of the knitted component may exhibit different characteristics (e.g., the first side may provide abrasion resistance and comfort while the second side may be relatively rigid and provide water resistance, among other advantageous characteristics mentioned below). The knitted component may be formed as an integral one-piece element during a knitting process, such as a weft knitting process (e.g., with a flat knitting machine or circular knitting machine), a warp knitting process, or any other suitable knitting process. That is, the knitting process may substantially form the knit structure of the knitted component without the need for significant post-knitting processes or steps. Alternatively, two or more portions of the knitted component may be formed separately as integral one-piece elements and then the respective elements attached. In some embodiments, the knitted component may be shaped after the knitting process to form and retain the desired shape of the upper (for example, by using a foot-shaped last). The shaping process may include attaching the knitted component to another object (e.g., a strobel) and/or attaching one portion of the knitted component to another portion of the knitted component at a seam by sewing, by using an adhesive, by bonding or by another suitable attachment process.

Forming the upper with the knitted component may provide the upper with advantageous characteristics including, but not limited to, a particular degree of elasticity (for example, as expressed in terms of Young's modulus), breathability, bendability, strength, moisture absorption, weight, and abrasion resistance. These characteristics may be accomplished by selecting a particular single layer or multi-layer knit structure (e.g., a ribbed knit structure, a single jersey knit structure, or a double jersey knit structure), by varying the size and tension of the knit structure, by using one or more yarns formed of a particular material (e.g., a polyester material, or an elastic material such as spandex) or construction (e.g., multifilament or monofilament), by selecting yarns of a particular size (e.g., denier), or a combination thereof. The knitted component may also provide desirable aesthetic characteristics by incorporating yarns having different colors, textures or other visual properties arranged in a particular pattern. The yarns themselves and/or the knit structure formed by one or more of the yarns of the knitted component may be varied at different locations such that the knitted component has two or more portions with different properties (e.g., a portion forming the throat area of the upper may be relatively elastic while another portion may be relatively inelastic). In some embodiments, the knitted component may incorporate one or more materials with properties that change in response to a stimulus (e.g., temperature, moisture, electrical current, magnetic field, or light). For example, the knitted component may include yarns formed of a thermoplastic polymer material (e.g., polyurethanes, polyamides, polyolefins, and nylons) that transitions from a solid state to a softened or liquid state when subjected to certain temperatures at or above its melting point and then transitions back to the solid state when cooled. The thermoplastic polymer material may provide the ability to heat and then cool a portion of the knitted component to thereby form an area of bonded or continuous material that exhibits certain advantageous properties including a relatively high degree of rigidity, strength, and water resistance, for example.

In some embodiments, the knitted component may include one or more yarns or strands that are at least partially inlaid or otherwise inserted within the knit structure of the knitted component during or after the knitting process, herein referred to as "tensile strands." The tensile strands may be substantially inelastic so as to have a substantially fixed length. The tensile strands may extend through a plurality of courses of the knitted component or through a passage formed within the knitted component and may limit the stretch of the knitted component in at least one direction. For example, the tensile strands may extend from an area underfoot, and/or approximately from a biteline of the upper to a throat area of the upper to limit the stretch of the upper in the lateral direction. The tensile strands may form one or more lace apertures for receiving a lace and/or may extend around at least a portion of a lace aperture formed in the knit structure of the knitted component.

One aspect of the present disclosure provides a lace-receiving assembly. The lace-receiving assembly includes a substrate, a first sheet, and a lace guide. The substrate includes a first surface and a second surface opposite the first surface. The first sheet includes a third surface and a fourth surface opposite the third surface. The third surface is bonded to the first surface to define a channel extending between the substrate and the first sheet. The lace guide is defined within the channel.

In some implementations, the first sheet includes a material selected from a group consisting of a hot melt adhesive and a thermoplastic polyurethane. In some implementations, the substrate includes a material selected from a group consisting of a hot melt adhesive and a thermoplastic polyurethane. The substrate may include a portion of one of an article of footwear, an article of clothing, and a bag.

In some implementations, the assembly includes a third sheet having a fifth surface and a sixth surface. The fifth surface may be bonded to the fourth surface of the first sheet. The third sheet may include a material selected from a group consisting of a textile, a foam, a leather, and a synthetic leather.

In some implementations, the assembly includes a fourth sheet having a seventh surface and an eighth surface. The seventh surface may be bonded to the second surface of the substrate. The fourth sheet may include a material selected from a group consisting of a textile, a foam, a leather, and a synthetic leather.

In some implementations, the assembly includes a fifth sheet having a ninth surface and a tenth surface. The ninth surface may be bonded to the eighth surface of the fourth sheet. The fifth sheet may include a material selected from a group consisting of a hot melt adhesive and a thermoplastic polyurethane.

In some implementations, the assembly includes a sixth sheet having an eleventh surface and a twelfth surface. The eleventh surface may be bonded to the tenth surface of the fifth sheet. The sixth sheet may include a portion of one of an upper of an article of footwear and a tongue portion of an article of footwear.

In some implementations, the lace guide includes a conduit. The conduit may include a proximal end and a distal end. The proximal end may define a first opening, and the distal end may define a second opening in fluid communication with the first opening. In some implementations, the conduit defines an arcuate shape extending between the proximal end and the distal end. The arcuate shape may be selected from a group consisting of a C-shape, a U-shape, and an S-shape. In some implementations, the conduit includes a passage extending between the first opening and the second opening. The passage may be defined by an inner surface of the conduit.

Another aspect of the present disclosure provides an article having a first side, a second side opposite the first side, and an opening between the first side and the second side. The article may include a first lace-receiving assembly and a second lace-receiving assembly. The first lace-receiving assembly may be disposed on the first side and may include a first substrate, a first, sheet, and a first lace guide. The first substrate may include a first surface and a second surface opposite the first surface. The first sheet may include a third surface and a fourth surface opposite the third surface. The third surface may be bonded to the first surface to define a first channel extending between the substrate and the first sheet. The first lace guide may be disposed within the first channel. The second lace-receiving assembly may be disposed on the second side and may include a second substrate, a second sheet, and a second lace guide. The second substrate may include a fifth surface and a sixth surface opposite the fifth surface. The second sheet may include a seventh surface and an eighth surface opposite the seventh surface. The seventh surface may be bonded to the fifth surface to define a second channel extending between the substrate and the first sheet. The second lace guide may be disposed within the second channel.

In some implementations, the article includes one of an article of footwear, an article of clothing, and a bag.

In some implementations, the article includes a lace extending through the first lace guide and the second lace guide. The lace may be operable to reduce the opening when tightened by bringing the first side and the second side closer together.

In some implementations, the first lace guide includes a conduit. The conduit may include a proximal end and a distal end. The proximal end may define a first opening. The distal end may define a second opening in fluid communication with the first opening. In some implementations, the conduit defines an arcuate shape extending between the proximal end and the distal end. The arcuate shape may be selected from a group consisting of a C-shape, a U-shape, and an S-shape. In some implementations, the conduit includes a passage extending between the first opening and the second opening. The passage may be defined by an inner surface of the conduit.

Another aspect of the present disclosure provides a method of manufacturing a lace-receiving assembly. The method may include providing a substrate having a first surface and a second surface opposite the first surface. The method may also include bonding the first surface to a third surface of a first sheet to define a channel extending between the substrate and the first sheet. The method may further include positioning a lace guide within the channel.

In some implementations, the method includes providing a pin board having a plurality of pins extending therefrom. The method may also include extending at least one of the plurality of pins through the substrate and extending at least one of the plurality of pins through the first sheet.

In some implementations, positioning the lace guide within the channel includes positioning the lace guide on the first surface of the substrate. Positioning the conduit on the first surface of the substrate may include engaging the conduit with one or more of the plurality of pins. In some implementations, engaging the conduit with one or more of the plurality of pins includes bending the conduit into an arcuate shape.

This initial overview is intended to introduce the subject matter of the present patent application. It is not intended to provide an exclusive or exhaustive explanation of the various inventions disclosed in the following more detailed description.

Automated Footwear Platform

The following discusses various components of the automated footwear platform including a motorized lacing engine, a mid-sole plate, and various other components of the platform. While much of this disclosure focuses on lacing architectures for use with a motorized lacing engine, the discussed designs are applicable to a human-powered lacing engine or other motorized lacing engines with additional or fewer capabilities. Accordingly, the term "automated" as used in "automated footwear platform" is not intended to only cover a system that operates without user input. Rather, the term "automated footwear platform" includes various electrically powered and human-power, automatically activated and human activated mechanisms for tightening a lacing or retention system of the footwear.

FIG. 1 is an exploded view illustration of components of a motorized lacing system for footwear, according to some example embodiments. The motorized lacing system 1 illustrated in FIG. 1 includes a lacing engine 10, a lid 20, an actuator 30, a mid-sole plate 40, a mid-sole 50, and an outsole 60. FIG. 1 illustrates the basic assembly sequence of components of an automated lacing footwear platform. The motorized lacing system 1 starts with the mid-sole plate 40 being secured within the mid-sole. Next, the actuator 30 is inserted into an opening in the lateral side of the mid-sole plate opposite to interface buttons that can be embedded in the outsole 60. Next, the lacing engine 10 is dropped into the mid-sole plate 40. In an example, the lacing system 1 is inserted under a continuous loop of lacing cable and the lacing cable is aligned with a spool in the lacing engine 10 (discussed below). Finally, the lid 20 is inserted into grooves in the mid-sole plate 40, secured into a closed position, and latched into a recess in the mid-sole plate 40. The lid 20 can capture the lacing engine 10 and can assist in maintaining alignment of a lacing cable during operation.

In an example, the footwear article or the motorized lacing system 1 includes or is configured to interface with one or more sensors that can monitor or determine a foot presence characteristic. Based on information from one or more foot presence sensors, the footwear including the motorized lacing system 1 can be configured to perform various functions. For example, a foot presence sensor can be configured to provide binary information about whether a foot is present or not present in the footwear. If a binary signal from the foot presence sensor indicates that a foot is present, then the motorized lacing system 1 can be activated, such as to automatically tighten or relax (i.e., loosen) a footwear lacing cable. In an example, the footwear article includes a processor circuit that can receive or interpret signals from a foot presence sensor. The processor circuit can optionally be embedded in or with the lacing engine 10, such as in a sole of the footwear article.

Lacing Architectures

Figure 2:
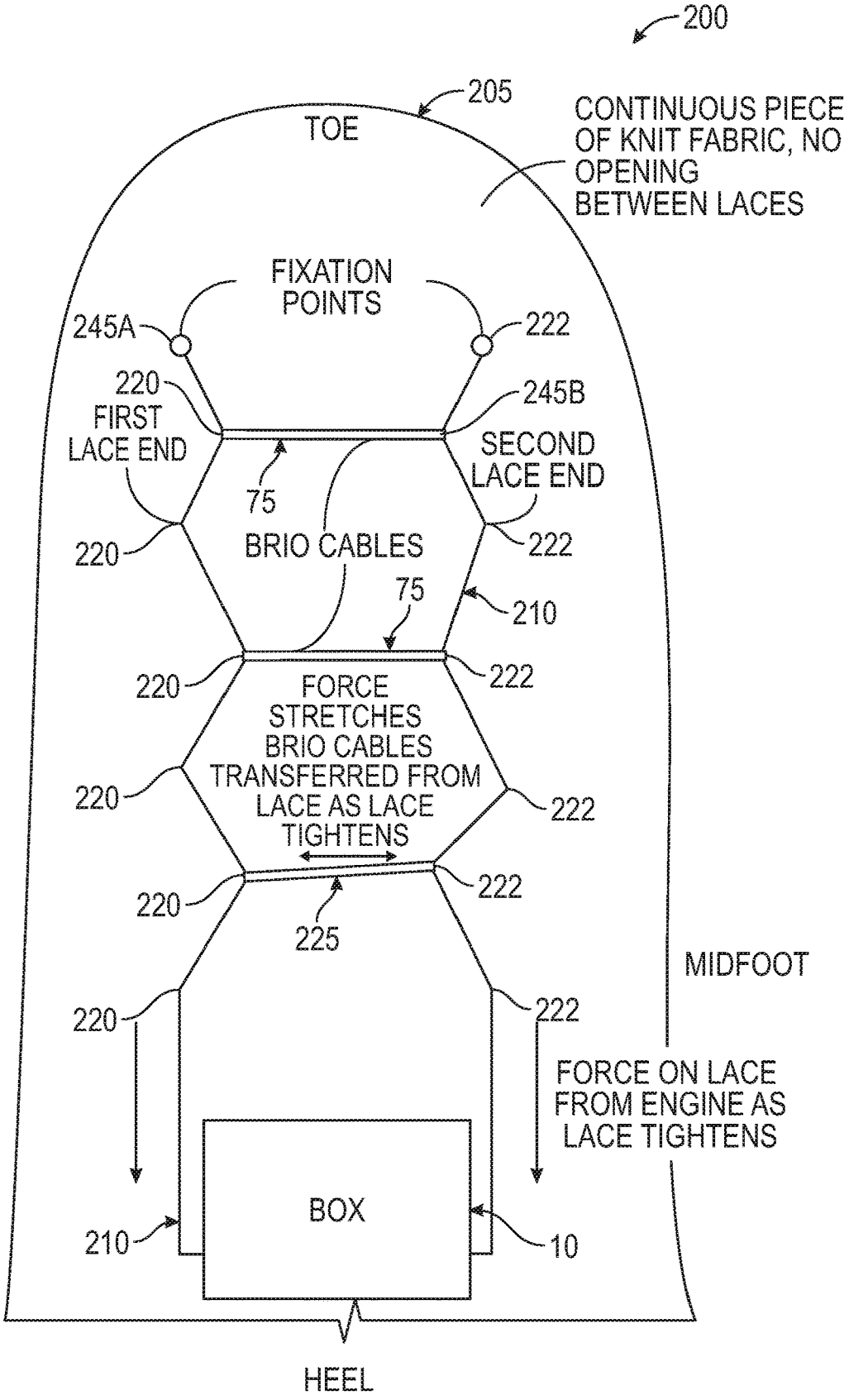
FIG. 2 is a top-view diagram illustrating a lacing architecture for use with footwear assemblies including a motorized lacing engine, according to some example embodiments.

FIG. 2 is a top view diagram of upper 200 illustrating an example lacing configuration, according to some example embodiments. In this example, the upper 205 includes lateral lace fixation 215, medial lace fixation 216, lateral lace guides 222, medial lace guides 220, and brio cables 225, in additional to lace 210 and lacing engine 10. The example illustrated in FIG. 2 includes a continuous knit fabric upper 205 with diagonal lacing pattern involving non-overlapping medial and lateral lacing paths. The lacing paths are created starting at the lateral lace fixation 215 running through the lateral lace guides 222 through the lacing engine 10 up through the medial lace guides 220 back to the medial lace fixation 216. In this example, lace 210 forms a continuous loop from lateral lace fixation 215 to medial lace fixation 216. Medial to lateral tightening is transmitted through brio cables 225 in this example. In other examples, the lacing path may crisscross or incorporate additional features to transmit tightening forces in a medial-lateral direction across the upper 205. Additionally, the continuous lace loop concept can be incorporated into a more traditional upper with a central (medial) gap and lace 210 crisscrossing back and forth across the central gap.

Figure 3A:
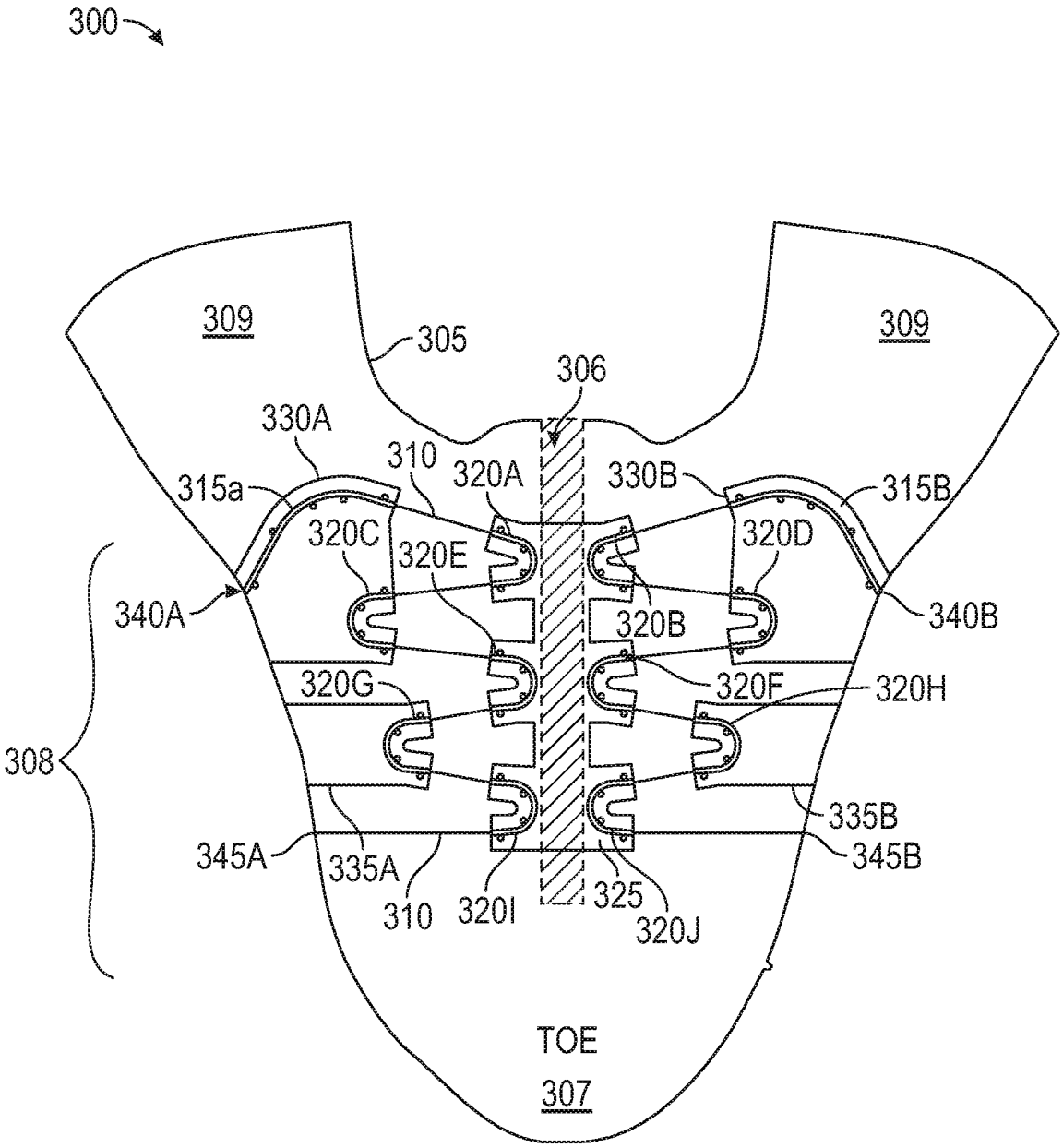
FIGS. 3A-3C are top-view diagrams illustrating a flattened footwear upper with a lacing architecture for use in footwear assemblies including a motorized lacing engine, according to some example embodiments.
Figure 3B:
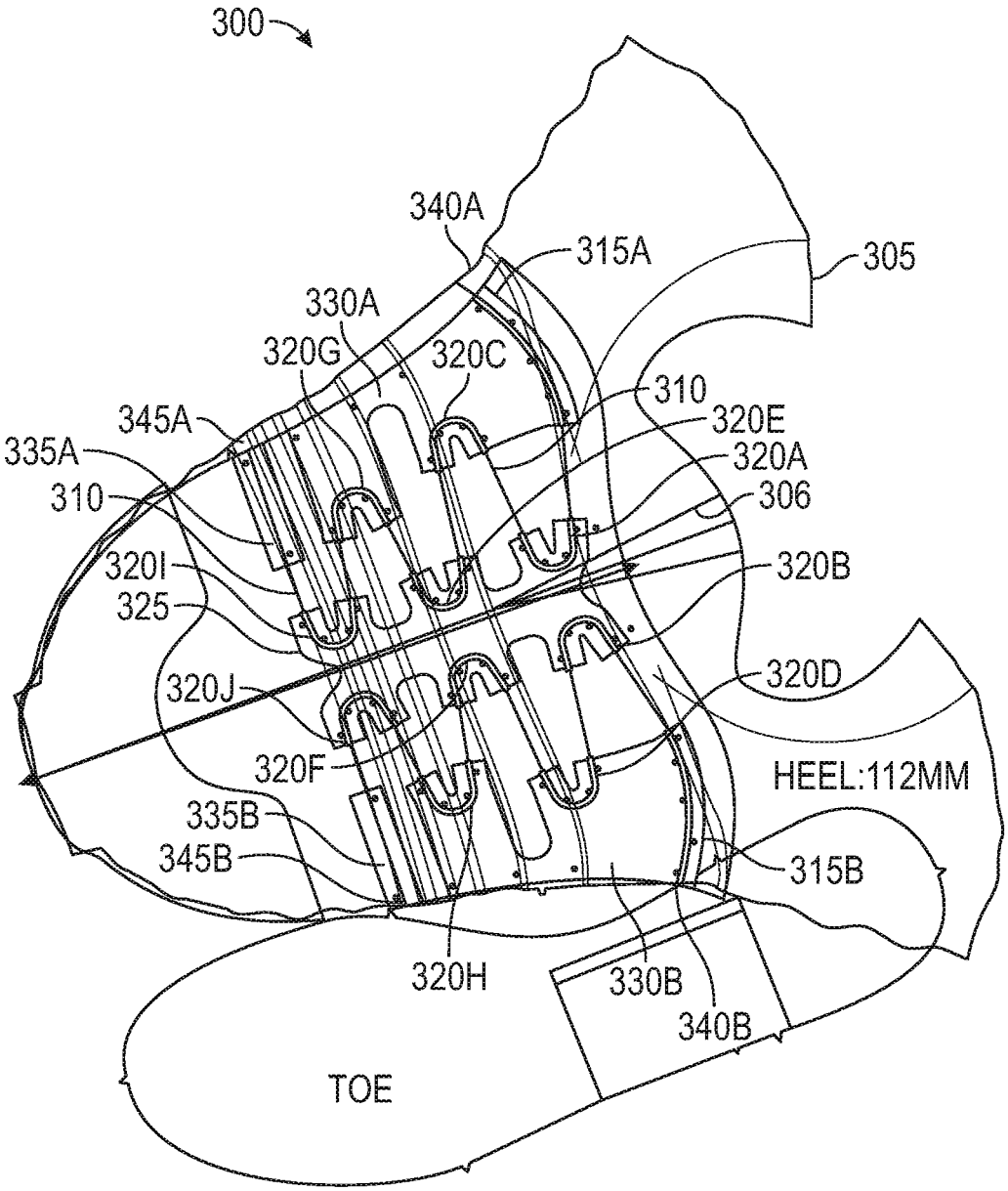
Figure 3C:
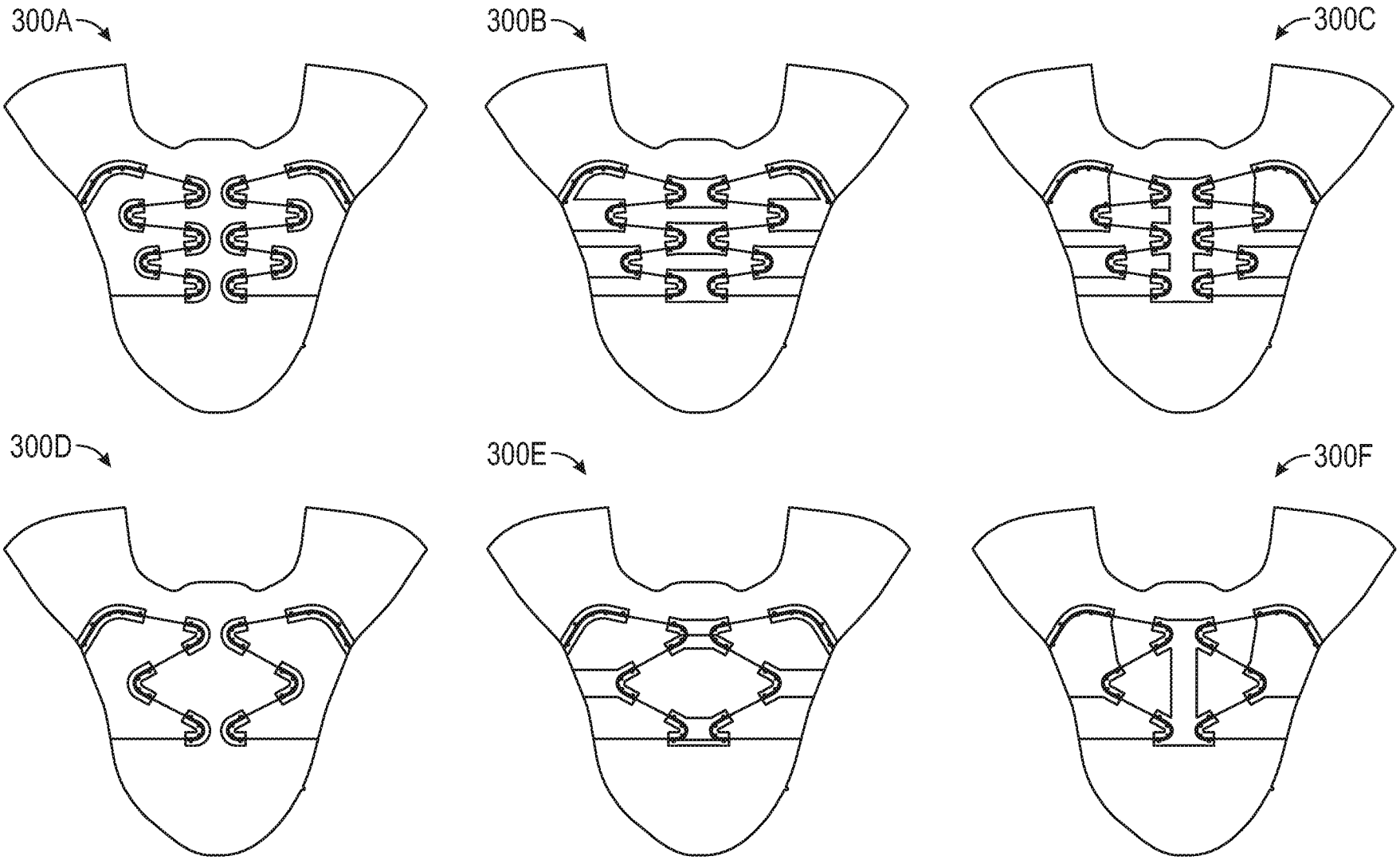

FIGS. 3A-3C are top-view diagrams illustrating a flattened footwear upper 305 with a lacing architecture 300 for use in footwear assemblies including a motorized lacing engine, according to some example embodiments. For the purposes of discussing example footwear uppers, the upper 305 is assumed to be designed for incorporation into a right foot version of a footwear assembly. FIG. 3A is a top-view diagram of a flattened footwear upper 305 with a lacing architecture 300 as illustrated. In this example, footwear upper 305 includes a series of lace guides 320A-320J (collectively referred to as lace guide(s) 320) with a lace cable 310 running through the lace guides 320. The lace cable 310, in this example, forms a loop that is terminated on each side of the upper 305 at a lateral lace fixation 345A and a medial lace fixation 345B (collectively referred to as lace fixation points 345) with the middle portion of the loop routed through a lacing engine within a mid-sole of the footwear assembly. The upper 305 also includes reinforcements associated with each of the series of lace guides 320. The reinforcements can cover individual lace guides or span multiple lace guides. In this example, the reinforcements include a central reinforcement 325, a first lateral reinforcement 335A, a first medial reinforcement 335B, a second lateral reinforcement 330A, a second medial reinforcement 330B. The middle portion of the lace cable 310 is routed to and/or from the lacing engine via a lateral rear lace guide 315A and a medial rear lace guide 315B, and exits and/or enters the upper 300 through a lateral lace exit 340A and a medial lace exit 340B.

The upper 305 can include different portions, such as a forefoot (toe) portion 307, a mid-foot portion 308, and a heel portion 309. The forefoot portion 307 corresponding with joints connecting metatarsal bones with phalanx bones of a foot. The mid-foot point 308 may correspond with an arch area of the foot. The heel portion 309 may correspond with the rear or heel portions of the foot. The medial and lateral sides of the mid-foot portion of the upper 305 can include a central portion 306. In some common footwear designs the central portion 306 can include an opening spanned by crisscrossing (or similar) pattern of laces that allows for the fit of the footwear upper around the foot to be adjusted. A central portion 306 including an opening also facilitates entry and removal of the foot from the footwear assembly.

The lace guides 320 are tubular or channel structures to retain the lace cable 310, while routing the lace cable 310 through a pattern along each of a lateral side and a medial side of the upper 305. In this example, the lace guides 320 are u-shaped plastic tubes laid out in an essentially sinusoidal wave pattern, which cycles up and down along the medial and lateral sides of the upper 305. The number of cycles completed by the lace cable 310 may vary depending on shoe size. Smaller sized footwear assemblies may only be able to accommodate one and one half cycles, with the example upper 305 accommodating two and one half cycles before entering the medial rear lace guide 315B or the lateral rear lace guide 315A. The pattern is described as essentially sinusoidal, as in this example at least, the u-shape guides have a wider profile than a true sine wave crest or trough. In other examples, a pattern more closely approximating a true sine wave pattern could be utilized (without extensive use of carefully curved lace guides, a true sine wave is not easily attained with a lace stretched between lace guides). The shape of the lace guides 320 can be varied to generate different torque versus lace displacement curves, where torque is measured at the lacing engine in the mid-sole of the shoe. Using lace guides with tighter radius curves, or including a higher frequency of wave pattern (e.g., greater number of cycles with more lace guides), can result in a change to the torque versus lace displacement curve. For example, with tighter radius lace guides the lace cable experiences higher friction, which can result in a higher initial torque, which may appear to smooth out the torque out over the torque versus lace displacement curve. However, in certain implementations it may be more desirable to maintain a low initial torque level (e.g., by keep friction within the lace guides low) while utilizing lace guide placement pattern or lace guide design to assist in smoothing the torque versus lace displacement curve. One such lace guide design is discussed in reference to FIGS. 7A and 7B, with another alternative lace guide design discussed in reference to FIGS. 8A through 8G. In addition to the lace guides discussed in reference to these figures, lace guides can be fabricated from plastics, polymers, metal, or fabric. For example, layers of fabric can be used to create a shaped channel to route a lace cable in a desired pattern. As discussed below, combinations of plastic or metal guides and fabric overlays can be used to generate guide components for use in the discussed lacing architectures.

Returning to FIG. 3A, the reinforcements 325, 335, and 330 are illustrated associated with different lace guides, such as lace guides 320. In an example, the reinforcements 335 can include fabric impregnated with a heat activated adhesive that can be adhered over the top of lace guides 320G, 320H, a process sometimes referred to as hot melt. The reinforcements can cover a number of lace guides, such as reinforcement 325, which in this example covers six upper lace guides positioned adjacent to a central portion of the footwear, such as central portion 306. In another example, the reinforcement 325 could be split down the middle of the central portion 306 to form two pieces covering lace guides along a medial side of the central portion 306 separately from lace guides along a lateral side of the central portion 306. In yet another alternative example, the reinforcement 325 could be split into six separate reinforcements covering individual lace guides. Use of reinforcements can vary to change the dynamics of interaction between the lace guides and the underlying footwear upper, such as upper 305. Reinforcements can also be adhered to the upper 305 in various other manners, including sewing, adhesives, or a combination of mechanisms. The manner of adhering the reinforcement in conjunction with the type of fabric or materials used for the reinforcements can also impact the friction experienced by the lace cable running through the lace guides. For example, a more rigid material hot melted over otherwise flexible lace guides can increase the friction experienced by the lace cable. In contrast, a flexible material adhered over the lace guides may reduce friction by maintaining more of the lace guide flexibility.

As mentioned above, FIG. 3A illustrates a central reinforcement 325 that is a single member spanning the medial and lateral upper lace guides (320A, 320B, 320E, 320F, 320I, and 320J). Assuming reinforcement 325 is more rigid material with less flexibility than the underlying footwear upper, upper 305 in this example, the resulting central portion 306 of the footwear assembly will exhibit less forgiving fit characteristics. In some applications, a more rigid, less forgiving, central portion 306 may be desirable. However, in applications where more flexibility across the central portion 306 is desired, the central reinforcement 325 can be separated into two or more reinforcements. In certain applications, separated central reinforcements can be coupled across the central portion 306 using a variety of flexible or elastic materials to enable a more form fitting central portion 306. In some examples, the upper 305 can have a small gap running the length of the central portion 306 with one or more elastic members spanning the gap and connecting multiple central reinforcements, such as is at least partially illustrated in FIG. 4 with lace guide 410 and elastic member 440.

FIG. 3B is another top-view diagram of the flattened footwear upper 305 with a lacing architecture 300 as illustrated. In this example, footwear upper 305 includes a similar lace guide pattern including lace guides 320 with modifications to the configuration of reinforcements 325, 330, and 335. As discussed above, the modifications to the configuration of the reinforcements will result in at least slightly different fit characteristics and may also change the torque versus lace displacement curve.

FIG. 3C is a series of lacing architecture examples illustrated on flattened footwear uppers according to example embodiments. Lace architecture 300A illustrates a lace guide pattern similar to the sine wave pattern discussed in reference to FIG. 3A with individual reinforcements covering each individual lace guide. Lace architecture 300B once again illustrates a wave lacing pattern, also referred to as parachute lacing, with elongated reinforcements covering upper lace guide pairs spanning across a central portion and individual lower lace guides. Lace architecture 300C is yet another wave lacing pattern with a single central reinforcement. Lace architecture 300D introduces a triangular shaped lace pattern with individual reinforcements cut to form fit over the individual lace guides. Lace architecture 300E illustrates a variation in reinforcement configuration in the triangular lace pattern. Finally, lace architecture 300F illustrates another variation in reinforcement configuration including a central reinforcement and consolidated lower reinforcements.

Figure 4:
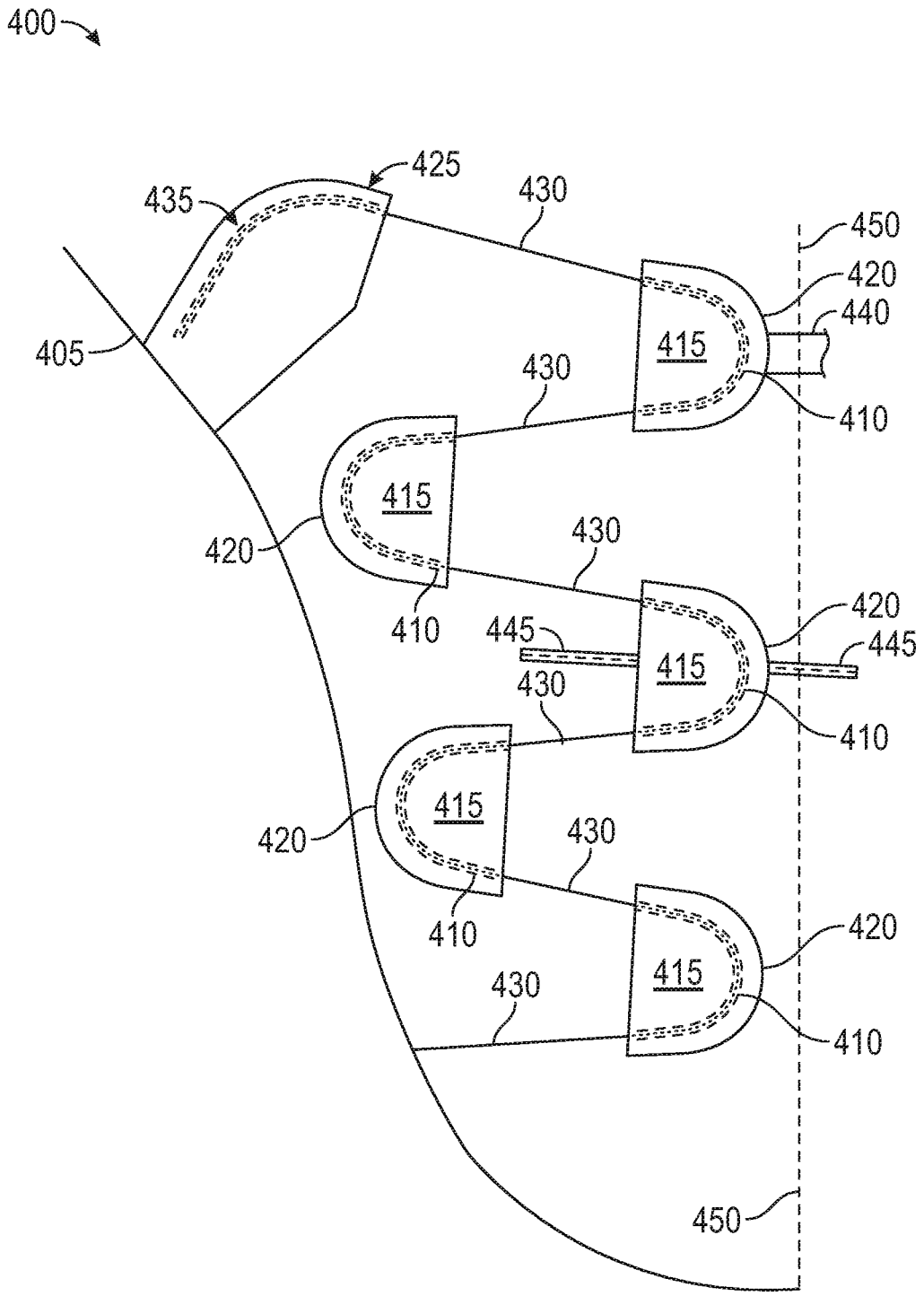
FIG. 4 is a diagram illustrating a portion of a footwear upper with a lacing architecture for use in footwear assemblies including a motorized lacing engine, according to some example embodiments.

FIG. 4 is a diagram illustrating a portion of a footwear upper 405 with a lacing architecture 400 for use in footwear assemblies including a motorized lacing engine, according to some example embodiments. In this example, a medial portion of upper 405 is illustrated with lace guides 410 routing lace cable 430 through to medial exit guide 435. Lace guides 410 are encapsulated in reinforcements 420 to form lace guide components 415, with at least a portion of the lace guide components being repositionable on upper 405. In one example, the lace guide components 415 are backed with hook-n-loop material and the upper 405 provides a surface receptive to the hook-n-loop material. In this example, the lace guide components 415 can be backed with the hook portion with the upper 405 providing a knit loop surface to receive the lace guide components 415. In another example, lace guide components 415 can have a track interface integrated to engage with a track, such as track 445. A track-based integration can provide a secure, limited travel, movement option for lace guide components 415. For example, track 445 runs essentially perpendicular to the longitudinal axis of the central portion 450 and allows for positioning a lace guide component 415 along the length of the track. In some examples, the track 445 can span across from a lateral side to a medial side to hold a lace guide component on either side of central portion 450. Similar tracks can be positioned in appropriate places to hold all of the lace guide components 415, enabling adjustment in restrictions directions for all lace guides on footwear upper 405.

The footwear upper 405 illustrates another example lacing architecture including central elastic members, such as elastic member 440. In these examples, at least the upper lace guide components along the medial and lateral sides can be connected across the central portion 450 with elastic members that allow for different footwear designs to attain different levels of fit and performance. For example, a high performance basketball shoe that needs to secure a foot through a wide range of lateral movement may utilize elastic members with a high modulus of elasticity to ensure a snug fit. In another example, a running shoe may utilize elastic members with a low modulus of elasticity, as the running shoe may be designed to focus on comfort for long distance road running versus providing high levels of lateral motion containment. In certain examples, the elastic members 440 can be interchangeable or include a mechanism to allow for adjustment of the level of elasticity. As discussed above, in some examples the footwear upper, such as upper 405, can include a gap along central portion 450 at least partially separating a medial side from a lateral side. Even with a small gap along central portion 450 elastic members, such as elastic member 440, can be used to span the gap.

While FIG. 4 only illustrates a single track 445 or a single elastic member 440, these elements can be replicated for any or all of the lace guides in a particular lacing architecture.

Figure 5:
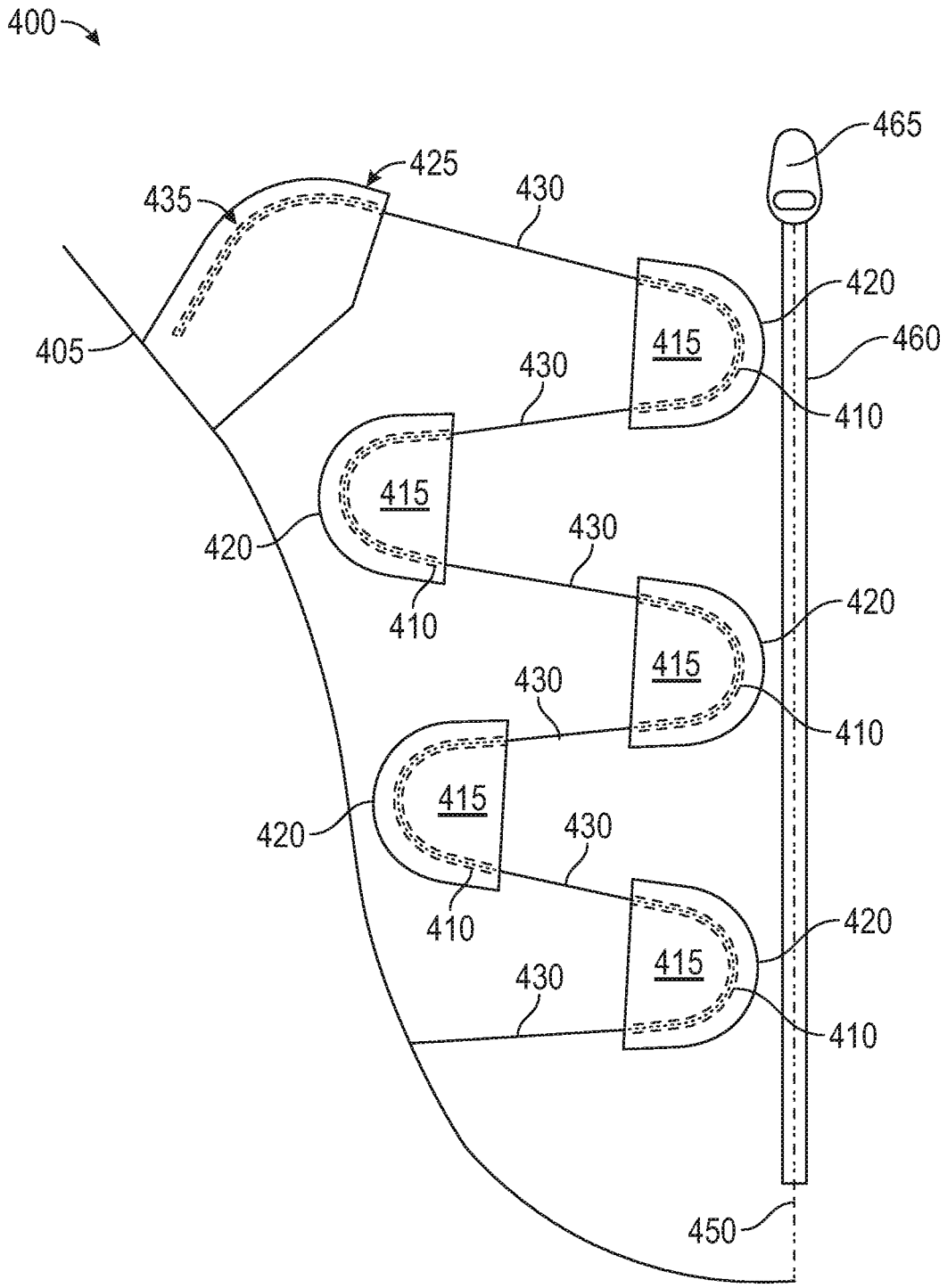
FIG. 5 is a diagram illustrating a portion of a footwear upper with a lacing architecture for use in footwear assemblies including a motorized lacing engine, according to some example embodiments.

FIG. 5 is a diagram illustrating a portion of footwear upper 405 with lacing architecture 400 for use in footwear assemblies including a motorized lacing engine, according to some example embodiments. In this example, the central portion 450 illustrated in FIG. 4 is replaced with a central closure mechanism 460, which is illustrated in this example as a central zipper 465. The central closure mechanism is designed to enable a wider opening in the footwear upper 405 for easy entry and exit. The central zipper 465 can be easily unzipped to enable foot entry or exit. In other examples, the central closure 460 can be hook and loop, snaps, clasps, toggles, secondary laces, or any similar closure mechanism.

Figure 6:
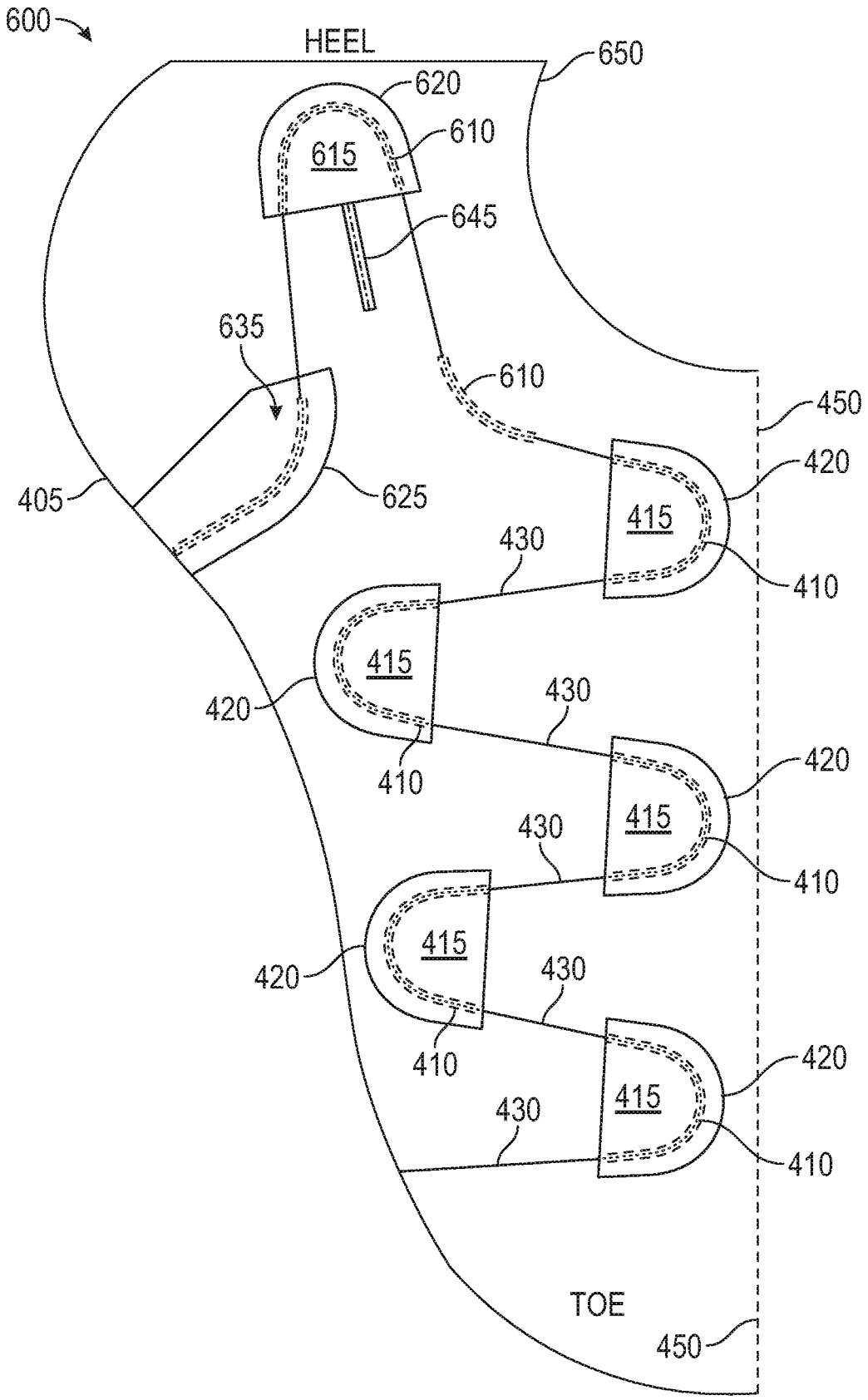
FIG. 6 is a diagram illustrating a portion of a footwear upper with a lacing architecture for use in footwear assemblies including a motorized lacing engine, according to some example embodiments.

FIG. 6 is a diagram illustrating a portion of footwear upper 405 with a lacing architecture 600 for use in footwear assemblies including a motorized lacing engine, according to some example embodiments. In this example, lacing architecture 600 adds a heel lacing component 615 including a heel lacing guide 610 and a heel reinforcement 620 as well as a heel redirect guide 610 and a heel exit guide 635. The heel redirect guide 610 shifts the lace cable 430 from exiting the last lace guide 410 towards a heel lacing component 615. The heel lacing component 615 is formed from a heel lacing guide 610 with a heel reinforcement 620. The heel lacing guide 610 is depicted with a similar shape to lacing guides used in other locations on upper 405. However, in other examples the heel lacing guide 610 can be other shapes or include multiple lace guides. In this example, the heel lace component 615 is shown mounted on a heel track 645 allowing for adjustability of the location of the heel lace component 615. Similar to the adjustable lace guides discussed above, other mechanisms can be utilized to enable adjustment in positioning of the heel lace component 615, such as hook and loop fasteners or comparable fastening mechanisms.

In some examples, the upper 405 includes a heel ridge 650, which like the central portion 450 discussed above can include a closure mechanism. In examples with a heel closure mechanism, the heel closure mechanism is designed to provide easy entry and exit from the footwear by expanding a traditional footwear assembly foot opening. Additionally, in some examples, the heel lacing component 615 can be connected across the heel ridge 650 (with or without a heel closure mechanism) to a matching heel lacing component on the opposite side. The connection can include an elastic member, similar to elastic member 440.

Figure 7A:
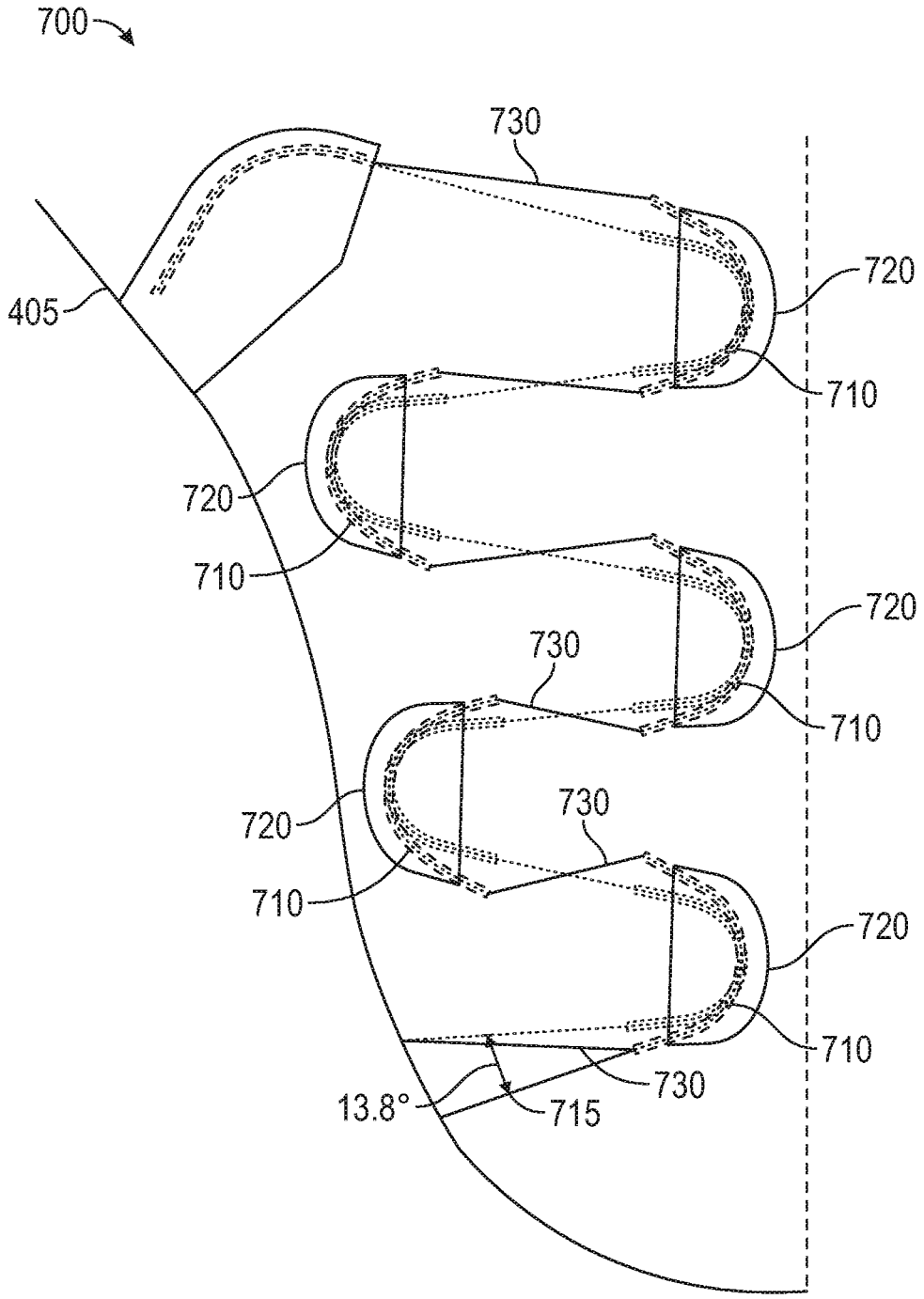
FIGS. 7A-7B are diagrams illustrating a portion of a footwear upper with a lacing architecture for use in footwear assemblies including a motorized lacing engine, according to some example embodiments.
Figure 7B:
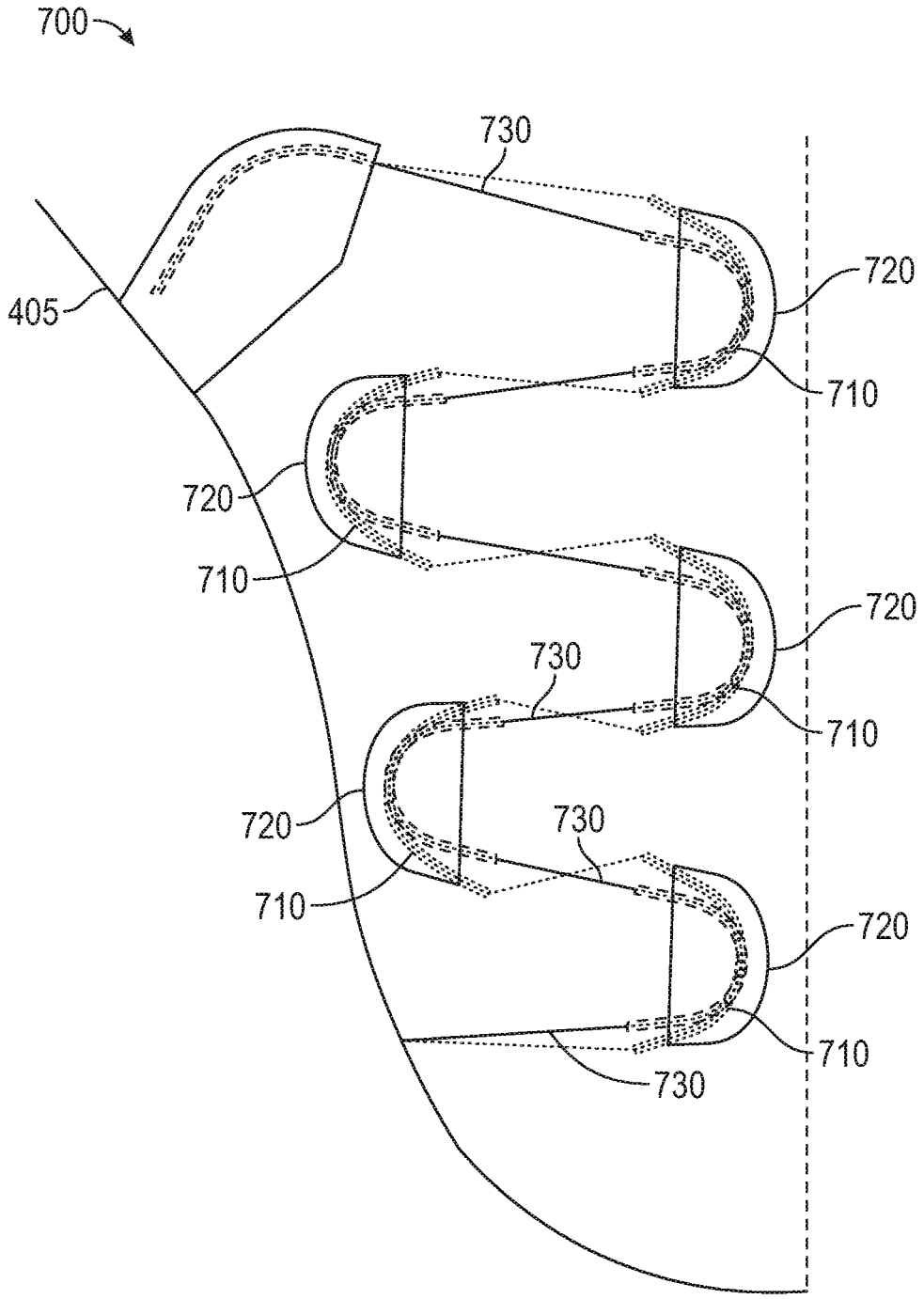

FIG. 7A-7B are diagrams illustrating a portion of footwear upper 405 with a lacing architecture 700 for use in footwear assemblies including a motorized lacing engine, according to some example embodiments. In this example, the lacing architecture 700 includes lace guides 710 for routing lace 730. The lace guides 710 can include associated reinforcements 720. In this example, the lace guides 710 are configured to allow for flexing of portions of the lace guides 710 from an open initial position illustrated in FIG. 7A to a flexed closed position illustrated in FIG. 7B (with phantom lines illustrating the opposition positions in each figure for reference). In this example, the lace guides 710 include extension portions that exhibit flex of approximately 14 degrees between the open initial position and the closed position. Other examples, can exhibit more or less flex between an initial and final position (or shape) of the lace guide 710. The flexing of the lace guides 710 occurs as the lace 730 is tightened. The flexing of the lace guides 710 works to smooth out the torque versus lace displacement curve by applying some initial tension to the lace 730 and providing an additional mechanism to dissipate lace tension during the tightening process. Accordingly, in an initial shape or flex position, lace guide 710 creates some initial tension in the lace cable, which also functions to take up slack in the lace cable. When tightening of the lace cable begins, the lace guide 710 flexes or deforms The lace guides 710, in this example, are plastic or polymer tubes and can have different modulus of elasticity depending upon the particular composition of the tubes. The modulus of elasticity of the lace guides 710 along with the configuration of the reinforcements 720 will control the amount of additional tension induced in the lace 730 by flexing of the lace guides 710. The elastic deformation of the ends (legs or extensions) of the lace guides 710 induces a continued tension on the lace 730 as the lace guides 710 attempt to return to original shape. In some examples, the entire lace guide flexes uniformly over the length of the lace guide. In other examples, the flex occurs primarily within the u-shaped portion of the lace guide with the extensions remaining substantially straight. In yet other examples, the extensions accommodate most of the flex with the u-shaped portion remaining relatively fixed.

The reinforcements 720 are adhered over the lace guides 710 in a manner that allows for movement of the ends of the lace guides 710. In some examples, reinforcements 720 are adhered through the hot melt process discussed above, with the placement of the heat activated adhesive allowing for an opening to enable flex in the lace guides 710. In other embodiments, the reinforcements 720 can be sewed into place or use a combination of adhesives and stitching. How the reinforcements 720 are adhered or structured can affect what portion of the lace guide flexes under load from the lace cable. In some examples, the hot melt is concentrated around the u-shaped portion of the lace guide leaving the extensions (legs) more free to flex.

Figure 7C:
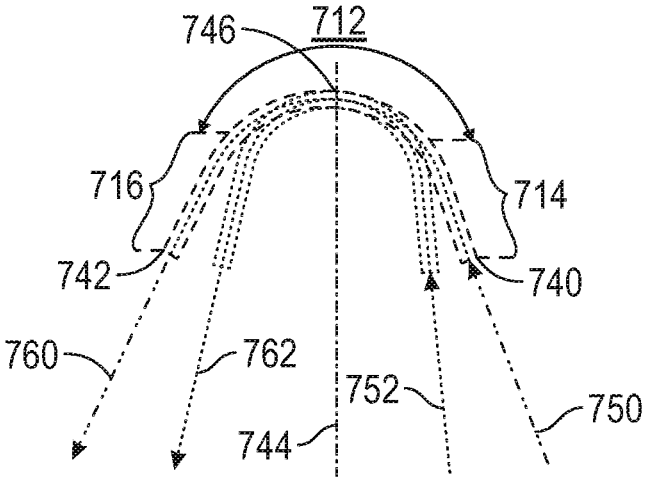
FIGS. 7C-7D are diagrams illustrating deformable lace guides for use in footwear assemblies, according to some example embodiments.
Figure 7D:
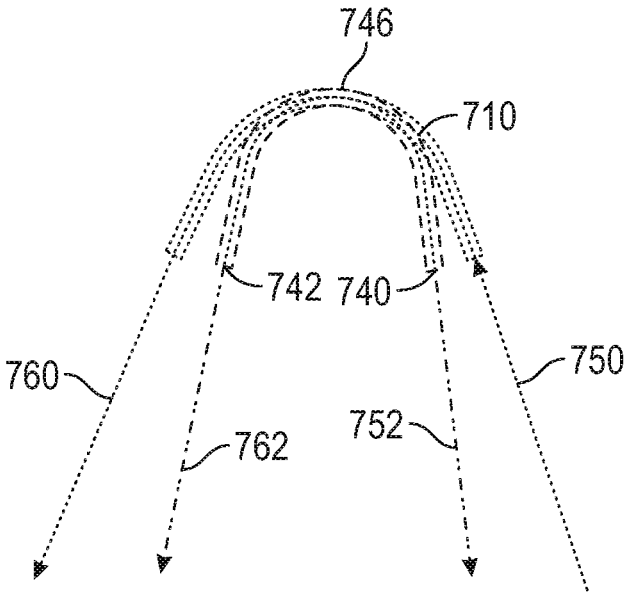

FIGS. 7C-7D are diagrams illustrating deformable lace guides 710 for use in footwear assemblies, according to some example embodiments. In this example, lace guides 710 introduced above in reference to FIGS. 7A and 7B are discussed in additional detail. FIG. 7C illustrates the lace guide 710 in a first (open) state, which can be considered a non-deformed state. FIG. 7D illustrates the lace guide 710 in a second (closed/flexed) state, which can be considered a deformed state. The lace guide 710 can include three different sections, such as a middle section 712, a first extension 714, and a second extension 716. The lace guide 710 can also include a lace reception opening 740 and a lace exit opening 742. As mentioned above, lace guide 710 can have different modulus of elasticity, which controls the level of deformation with a certain applied tension. In some examples, the lace guide 710 can be constructed with different sections having different modulus of elasticity, such as the middle section 712 having a first modulus of elasticity, the first extension having a second modulus of elasticity and the second extension having a third modulus of elasticity. In certain examples, the second and third moduli of elasticity can be substantially similar, resulting in the first extension and the second extension flexing or deforming in a similar manner. In this example, substantially similar can be interpreted as the moduli of elasticity being within a few percentage points of each other. In some examples, the lace guide 710 can have a variable modulus of elasticity shifting from a high modulus at the apex 746 to a low modulus towards the outer ends of the first extension and the second extension. In these examples, the modulus can vary based on wall thickness of the lace guide 710.

The lace guide 710 defines a number of axes useful is describing how the deformable lace guide functions. For example, the first extension 714 can define a first incoming lace axis 750, which aligns with at least an outer portion of an inner channel defined within the first extension 714. The second extension 716 defines a first outgoing lace axis 760, which aligns with at least an outer portion of an inner channel defined within the second extension 716. Upon deformation, the lace guide 710 defines a second incoming lace axis 752 and a second outgoing lace axis 762, which are each aligned with respective portions of the first extension and the second extension. The lace guide 710 also includes a medial axis 744 that intersects the lace guide 710 at the apex 746 and is equidistant from the first extension and the second extension (assuming a symmetrical lace guide in a non-deformed state as illustrated in FIG. 7C).

Figure 7E:
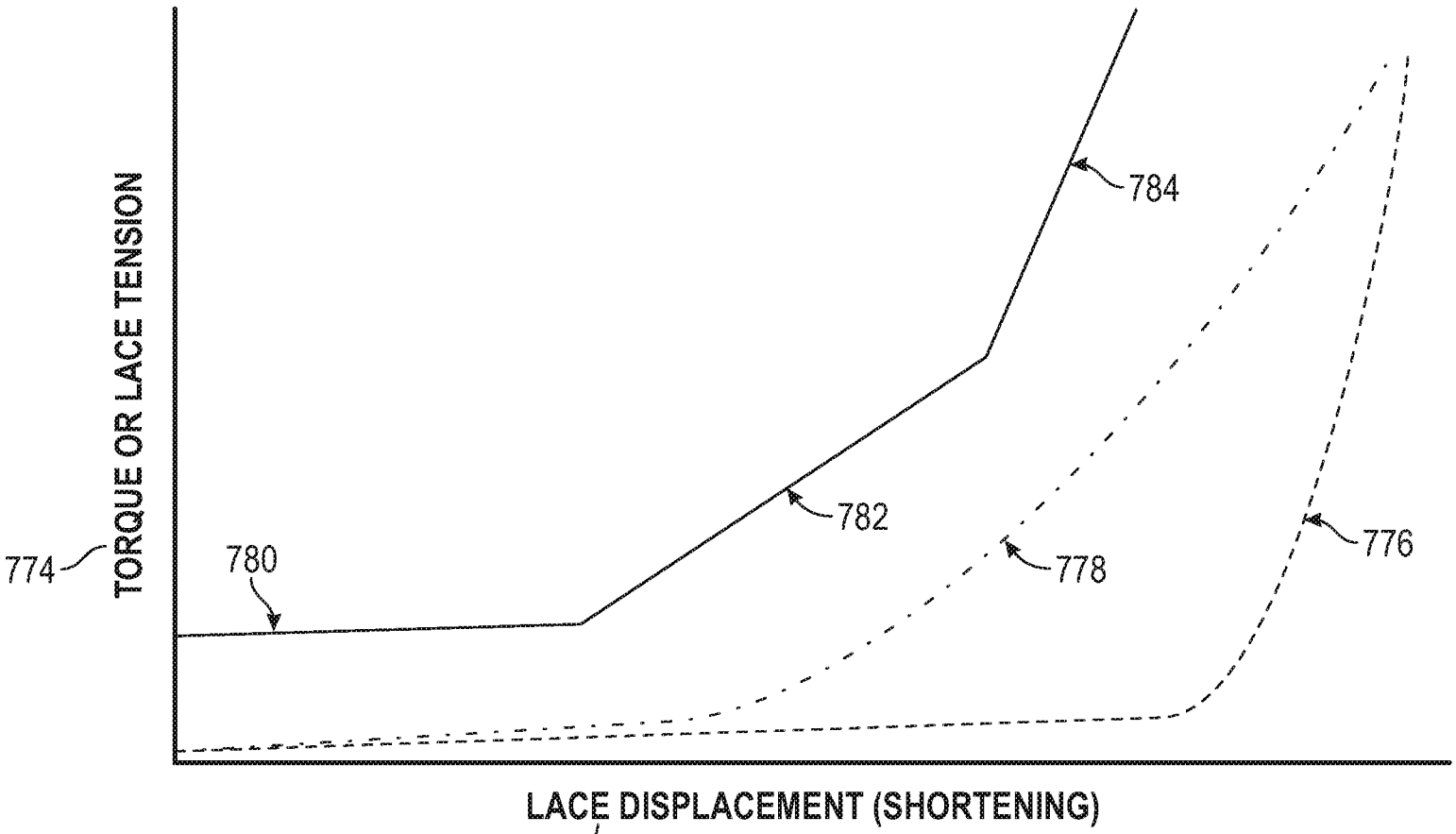
FIG. 7E is a graph illustrating various torque versus lace displacement curves for deformable lace guides, according to some example embodiments.

FIG. 7E is a graph 770 illustrating various torque versus lace displacement curves for deformable lace guides, according to some example embodiments. As discussed above, one of the benefits achieved using lace guides 710 involves modifying torque (or lace tension) versus lace displacement (or shortening) curves. Curve 776 illustrates a torque versus displacement curve for a non-deformable lace guide used in an example lacing architecture. The curve 776 illustrates how laces experience a rapid increase in tension over a short displacement near the end of the tightening process. In contrast, curve 778 illustrates a torque versus displacement curve for a first deformable lace guide used in an example lacing architecture. The cure 778 begins in a fashion similar to curve 776, but as the lace guides deform with additional lace tension the curve is flattened, resulting in tension increasing over a larger lace displacement. Flattening out the curves allows for more control of fit and performance of the footwear for the end users.

The final example is split into three segments, an initial tightening segment 780, an adaptive segment 782, and a reactive segment 784. The segments 780, 782, 784 may be utilized in any circumstance where the torque and resultant displacement is desired. However, the reactive segment 784 may particularly be utilized in circumstances where the motorized lacing engine makes sudden changes or corrections in the displacement of the lace in reaction to unanticipated external factors, e.g., the wearer has abruptly stopped moving, resulting in a relatively high load on the lace. The adaptive segment 782, by contrast, may be utilized when more gradual displacement of the lace may be utilized because a change in the load on the lace may be anticipated, e.g., because the change in load may be less sudden or a change in activity is input into the motorized lacing engine by the wearer or the motorized lacing engine is able to anticipate a change in activity through machine learning. The deformable lace guide design resulting in this final example, is designed to create the adaptive segment 782 and reactive segment 784 through lace guide structural design (such as channel shape, material selection, or a combination parameters). The lacing architecture and lace guides producing the final example, also produce a pre-tension in the lace cable resulting in the illustrated initial tightening segment 780.

FIGS. 8A-8F are diagrams illustrating an example lacing guide 800 for use in certain lacing architectures, according to some example embodiments. In this example, an alternative lace guide with an open lace channel is illustrated. The lacing guide 800 described below can be substituted into any of the lacing architectures discussed above in reference to lace guide 410, heel lace guide 610, or even the medial exit guide 435. All of the various configurations discussed above will not be repeated here for the sake of brevity. The lacing guide 800 includes a guide tab 805, a stitch opening 810, a guide superior surface 815, a lace retainer 820, a lace channel 825, a channel radius 830, a lace access opening 840, a guide inferior surface 845, and a guide radius 850. Advantages of an open channel lace guide, such as lacing guide 800, include the ability to easily route the lace cable after installation of the lace guides on the footwear upper. With tubular lace guides as illustrated in many of the lace architecture examples discussed above, routing the lace cable through the lace guides is most easily accomplish before adhering the lace guides to the footwear upper (not to say it cannot be accomplished later). Open channel lace guides facilitate simple lace routing by allowing the lace cable to simply be pushed pass the lace retainer 820 after the lace guides 800 are positioned on the footwear upper. The lacing guide 800 can be fabricated from various materials including metal or plastics.

Figure 8A:
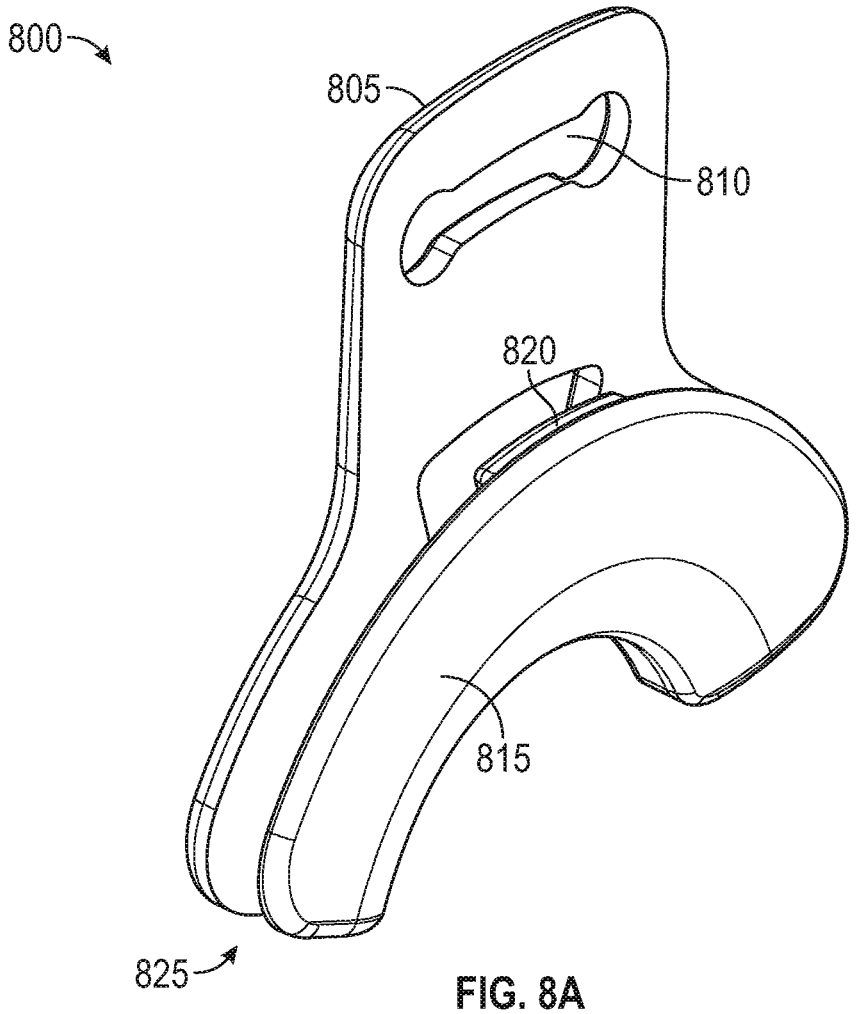
FIGS. 8A-8G are diagrams illustrating a lacing guide for use in certain lacing architectures, according to some example embodiments.
Figure 8B:
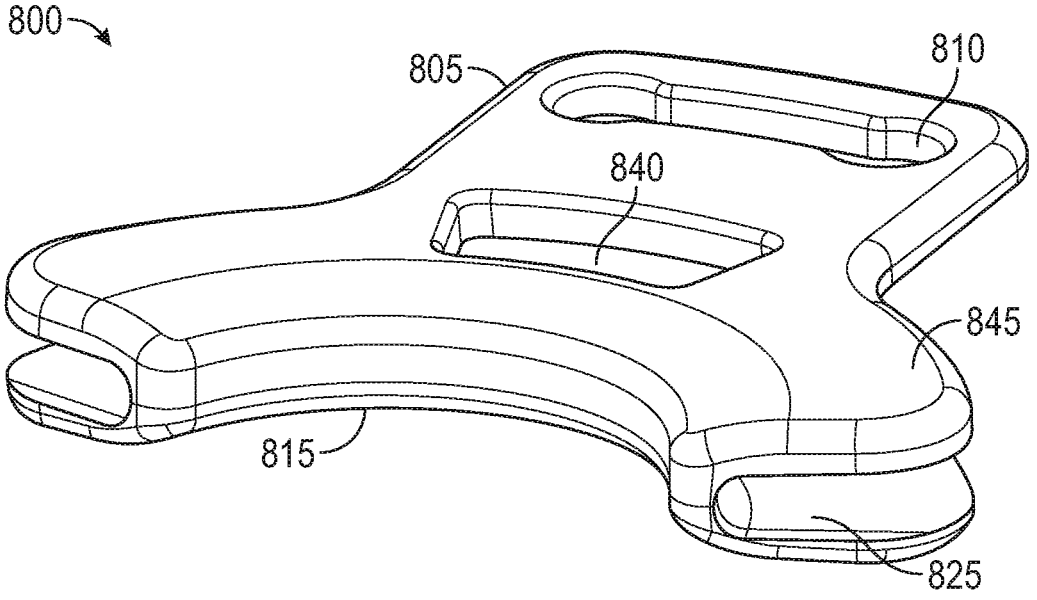
Figure 8C:
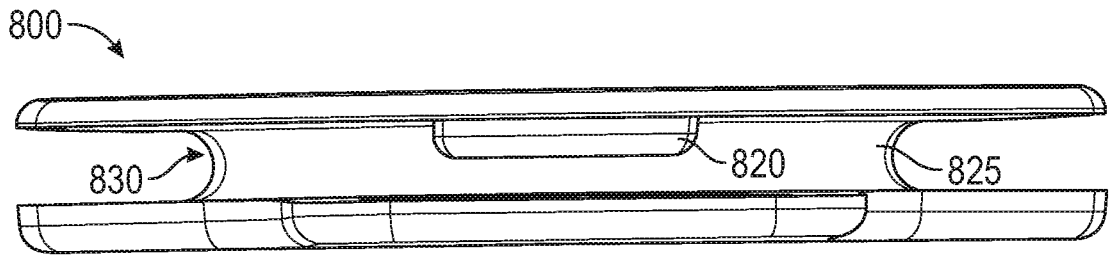
Figure 8D:
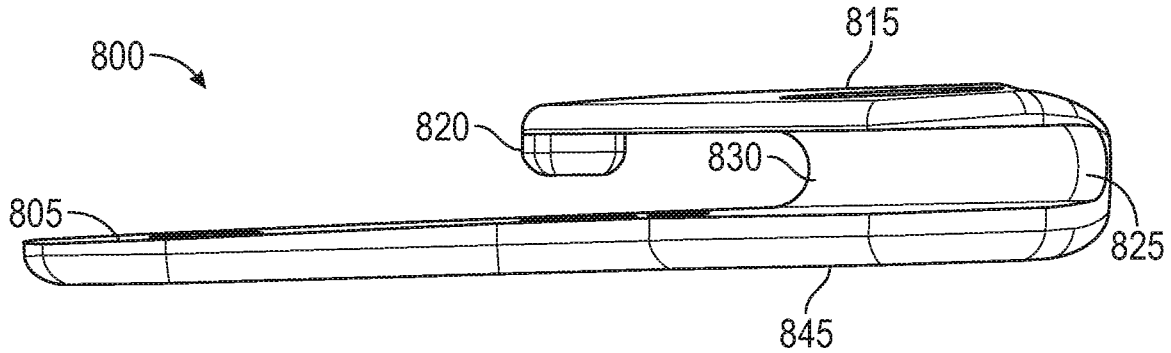
Figure 8E:
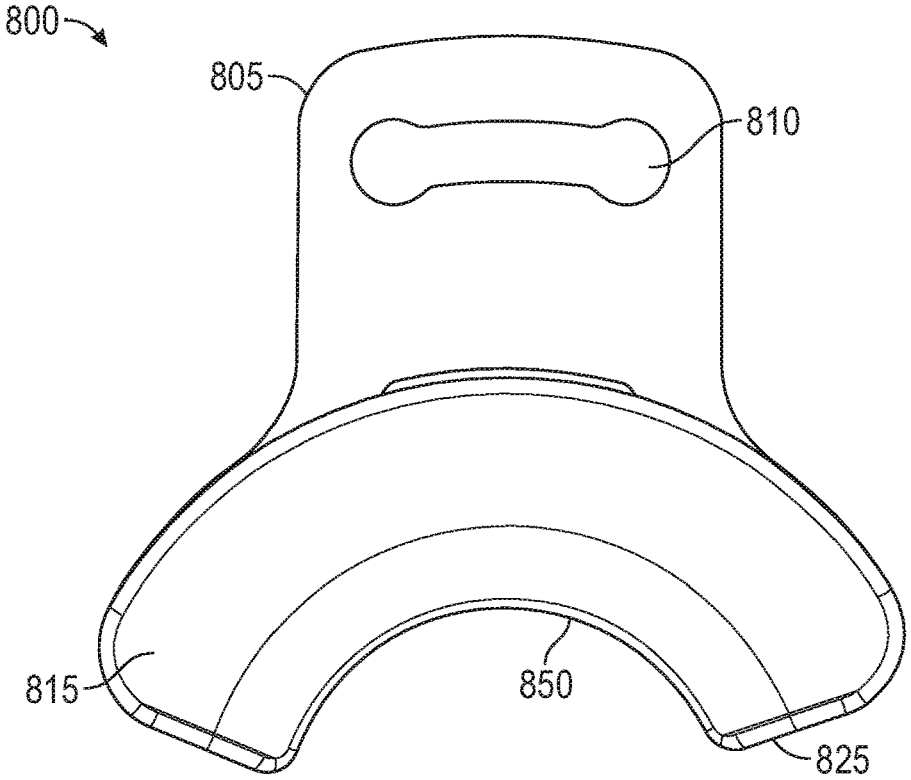
Figure 8F:
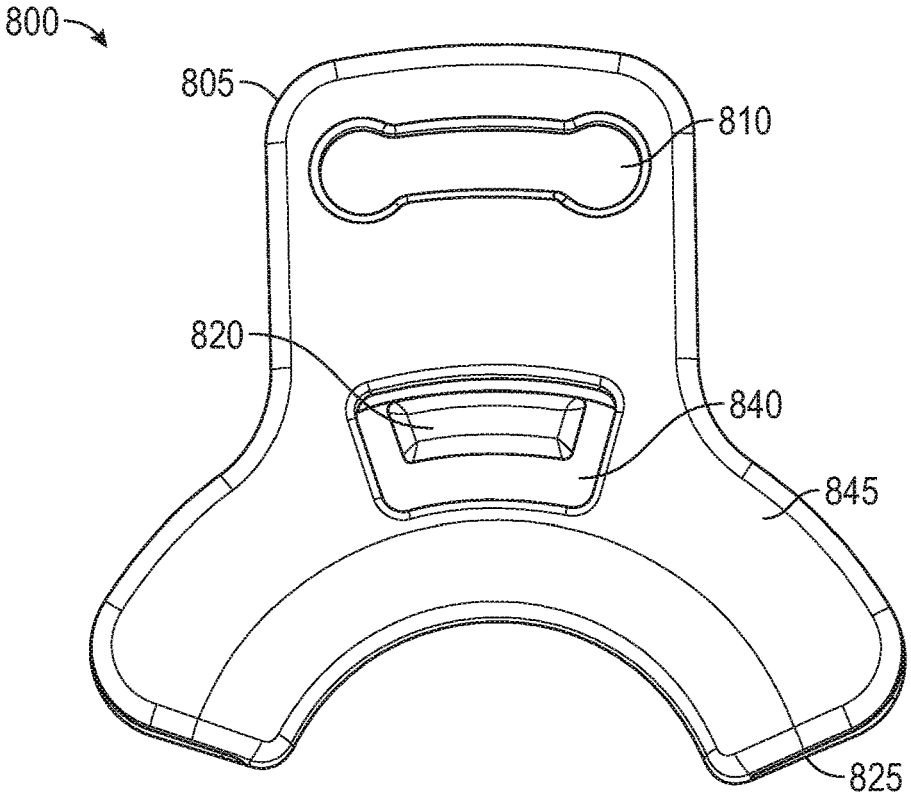

In this example, the lacing guide 800 can be initially attached to a footwear upper through stitching or adhesives. The illustrated design includes a stitch opening 810 that is configured to enable easy manual or automated stitching of lacing guide 800 onto a footwear upper (or similar material). Once lacing guide 800 is attached to the footwear upper, lace cable can be routed by simply pulling a loop of lace cable into the lace channel 825. The lace access opening 840 extends through the inferior surface 845 to provide a relief recess for the lace cable to get around the lace retainer 820. In some examples, the lace retainer 820 can be different dimensions or even be split into multiple smaller protrusions. In an example, the lace retainer 820 can be narrower in width, but extend further towards or even into access opening 840. In some examples, the access opening 840 can also be different dimensions, and will usually somewhat mirror the shape of lace retainer 820 (as illustrated in FIG. 8F). In this example, the channel radius 830 is designed to correspond to, or be slightly larger then, the diameter of the lace cable. The channel radius 830 is one of the parameters of the lacing guide 800 that can control the amount of friction experienced by the lace cable running through the lacing guide 800. Another parameter of lacing guide 800 that impacts friction experienced by the lace cable includes guide radius 850. The guide radius 850 also may impact the frequency or spacing of lace guides positioned on a footwear upper.

Figure 8G:
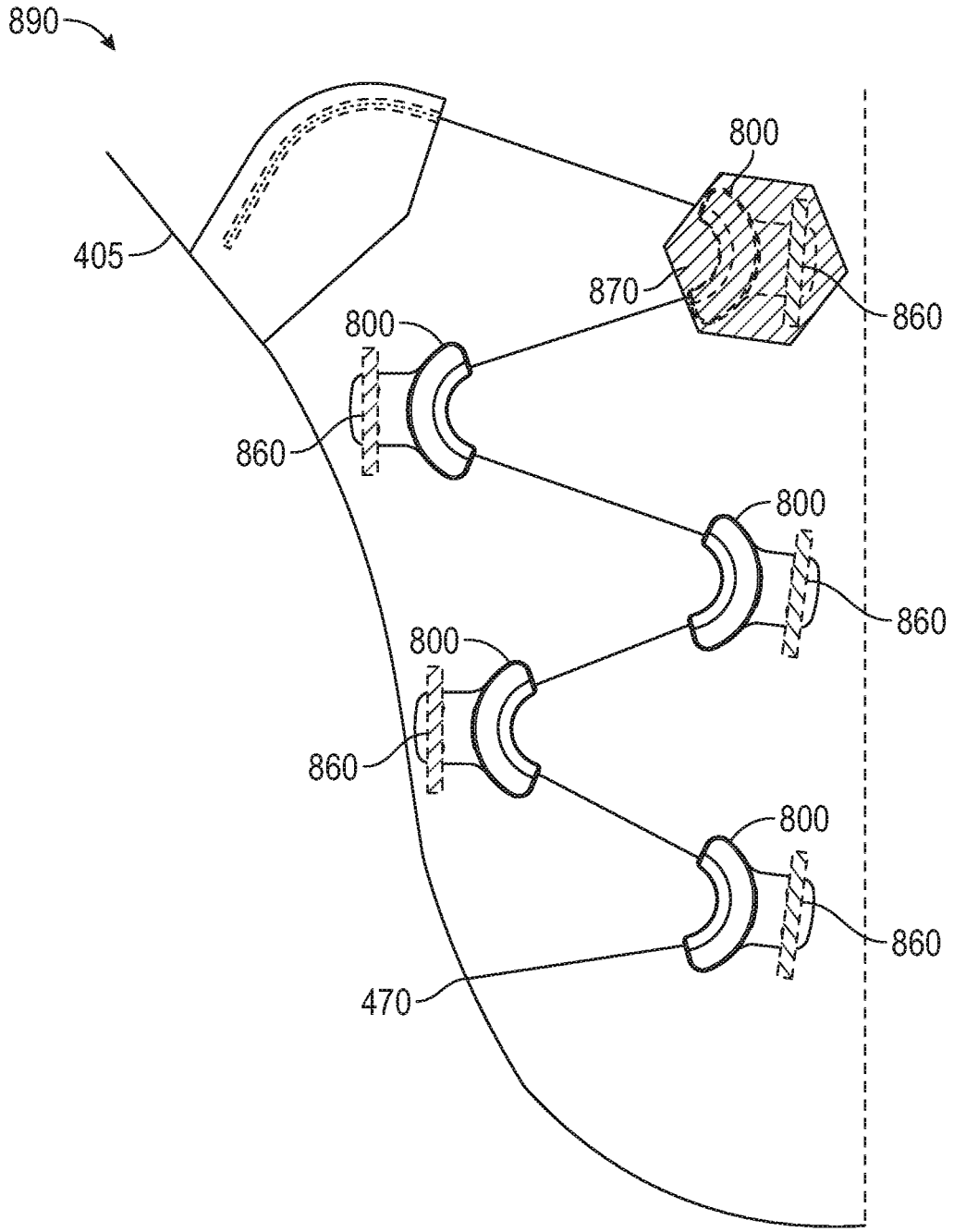

FIG. 8G is a diagram illustrating a portion of footwear upper 405 with a lacing architecture 890 using lacing guides 800, according to some example embodiments. In this example, multiple lacing guides 800 are arranged on a lateral side of footwear upper 405 to form half of the lacing architecture 890. Similar to lacing architectures discussed above, lacing architecture 890 uses lacing guides 800 to form a wave pattern or parachute lacing pattern to route the lace cable. One of the benefits of this type of lacing architecture is that lace tightening can produce both later-medial tightening as well as anterior-posterior tightening of the footwear upper 405.

In this example, lacing guides 800 are at least initially adhered to upper 405 through stitching 860. The stitching 860 is shown over or engaging stitch opening 810. One of the lacing guide 800 is also depicted with a reinforcement 870 covering the lacing guide. Such reinforcements can be positioned individually over each of the lacing guides 800. Alternatively, larger reinforcements could be used to cover multiple lacing guides. Similar to the reinforcements discussed above, reinforcement 870 can be adhered through adhesives, heat-activated adhesives, and/or stitching. In some examples, reinforcement 870 can be adhered using adhesives (heat-activated or not) and a vacuum bagging process that uniformly compresses the reinforcement over the lacing guide. A similar vacuum bagging process can also be used with reinforcements and lacing guides discussed above. In other examples, mechanical presses or similar machines can be used to assist with adhering reinforcements over lacing guides.

Once all of the lacing guides 800 are initially positioned and attached to footwear upper 405, the lace cable can be routed through the lacing guides. Lace cable routing can begin with anchoring a first end of the lace cable at lateral anchor point 470. The lace cable can then be pulled into each lace channel 825 starting with the anterior most lacing guide and working posteriorly towards the heel of upper 405. Once the lace cable is routed through all lacing guides 800, reinforcements 870 can be optionally adhered over each of the lacing guides 800 to secure both the lacing guides and the lace cable.

Assembly Processes

Figure 9:
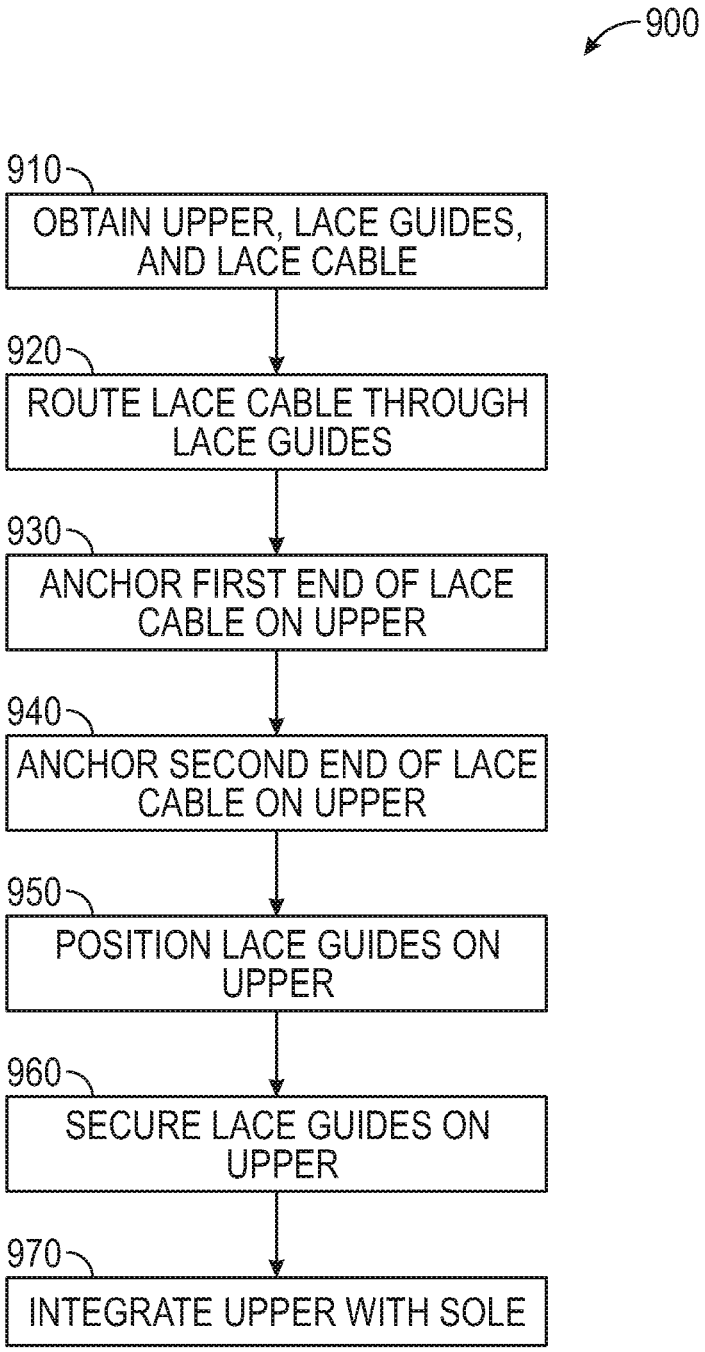
FIG. 9 is a flowchart illustrating a footwear assembly process for assembly of footwear including a lacing engine, according to some example embodiments.

FIG. 9 is a flowchart illustrating a footwear assembly process 900 for assembly of footwear including a lacing engine, according to some example embodiments. In this example, the assembly process 900 includes operations such as: obtaining footwear upper, lace guides, and lace cable at 910; routing lace cable through tubular lace guides at 920; anchoring a first end of the lace cable at 930; anchoring a second end of lace cable at 940; positioning lace guides at 950; securing lace guides at 960; and integrating upper with footwear assembly at 970. The process 900 described in further detail below can include some or all of the process operations described and at least some of the process operations can occur at various locations and/or using different automated tools.

In this example, the process 900 begins at 910 by obtaining a footwear upper, a plurality of lace guides, and a lace cable. The footwear upper, such as upper 405, can be a flattened footwear upper separated from the remainder of a footwear assembly (e.g., sole, mid-sole, outer cover, etc. . . . ). The lace guides in this example include tubular plastic lace guides as discussed above, but could also include other types of lace guides. At 920, the process 900 continues with the lace cable being routed (or threaded) through the plurality of lace guides. While the lace cable can be routed through the lace guides at a different point in the assembly process 900, when using tubular lace guides routing the lace through the lace guides prior to assembly onto the footwear upper may be preferable. In some examples, the lace guides can be pre-threaded onto the lace cable, with process 900 beginning with multiple lace guides already threaded onto the lace obtained during the operation at 910.

At 930, the process 900 continues with a first end of the lace cable being anchored to the footwear upper. For example, lace cable 430 can be anchored along a lateral edge of upper 405. In some examples, the lace cable may be temporary anchored to the upper 405 with a more permanent anchor accomplished during integration of the footwear upper with the remaining footwear assembly. At 940, the process 900 can continue with a second end of the lace cable being anchored to the footwear upper. Like the first end of the lace cable, the second end can be temporarily anchored to the upper. Additionally, the process 900 can optionally delay anchoring of the second end until later in the process or during integration with the footwear assembly.

At 950, the process 900 continues with the plurality of lace guides being positioned on the upper. For example, lace guides 410 can be positioned on upper 405 to generate the desired lacing pattern. Once the lace guides are positioned, the process 900 can continue at 960 by securing the lace guides onto the footwear upper. For example, the reinforcements 420 can be secured over lace guides 410 to hold them in position. Finally, the process 900 can complete at 970 with the footwear upper being integrated into the remainder of the footwear assembly, including the sole. In an example, integration can include positioning the loop of lace cable connecting the lateral and medial sides of the footwear upper in position to engage a lacing engine in a mid-sole of the footwear assembly.

Figure 10:
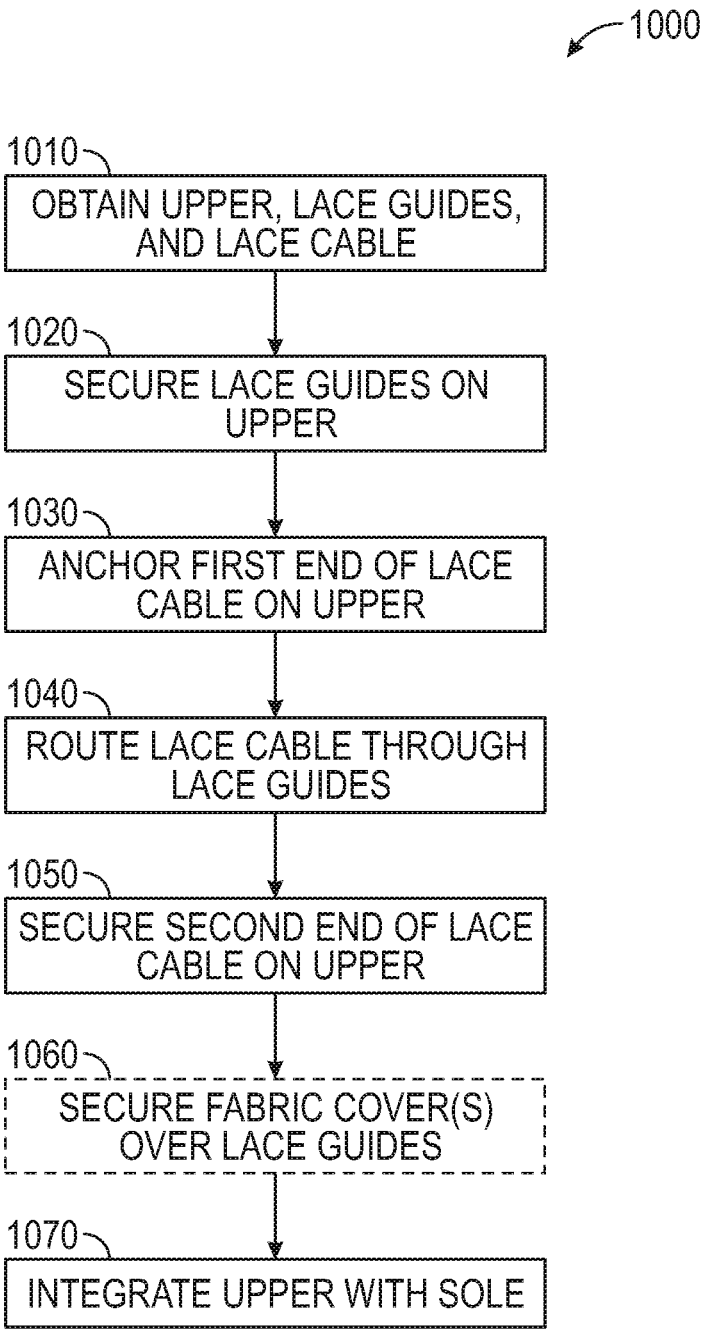
FIG. 10 is a flowchart illustrating a footwear assembly process for assembly of footwear including a lacing engine, according to some example embodiments.

FIG. 10 is a flowchart illustrating a footwear assembly process 1000 for assembly of footwear including a plurality of lacing guides, according to some example embodiments. In this example, the assembly process 1000 includes operations such as: obtaining footwear upper, lace guides, and lace cable at 1010; securing lacing guides on footwear upper at 1020; anchoring a first end of the lace cable at 1030; routing lace cable through the lace guides at 1040; anchoring a second end of lace cable at 1050; optionally securing reinforcements over the lace guides at 1060; and integrating upper with footwear assembly at 1070. The process 1000 described in further detail below can include some or all of the process operations described and at least some of the process operations can occur at various locations and/or using different automated tools.

In this example, the process 1000 begins at 1010 by obtaining a footwear upper, a plurality of lace guides, and a lace cable. The footwear upper, such as upper 405, can be a flattened footwear upper separated from the remainder of a footwear assembly (e.g., sole, mid-sole, outer cover, etc. . . . ). The lace guides in this example include open channel plastic lacing guides as discussed above, but could also include other types of lace guides. At 1020, the process 1000 continues with the lacing guides being secured to the upper. For example, lacing guides 800 can be individually stitched in position on upper 405.

At 1030, the process 1000 continues with a first end of the lace cable being anchored to the footwear upper. For example, lace cable 430 can be anchored along a lateral edge of upper 405. In some examples, the lace cable may be temporary anchored to the upper 405 with a more permanent anchor accomplished during integration of the footwear upper with the remaining footwear assembly. At 1040, the process 1000 continues with the lace cable being routed through the open channel lace guides, which includes leaving a lace loop for engagement with a lacing engine between the lateral and medial sides of the footwear upper. The lace loop can be a predetermined length to ensure the lacing engine is able to properly tighten the assembled footwear.

At 1050, the process 1000 can continue with a second end of the lace cable being anchored to the footwear upper. Like the first end of the lace cable, the second end can be temporarily anchored to the upper. Additionally, the process 1000 can optionally delay anchoring of the second end until later in the process or during integration with the footwear assembly. In certain examples, delaying anchoring of the first and/or second end of the lace cable can allow for adjustment in overall lace length, which may be useful during integration of the lacing engine.

At 1060, the process 1000 can optionally include an operation for securing fabric reinforcements (covers) over the lace guides to further secure them to the footwear upper. For example, lacing guides 800 can have reinforcements 870 hot melted over the lacing guides to further secure the lacing guides and the lace cable. Finally, the process 1000 can complete at 1070 with the footwear upper being integrated into the remainder of the footwear assembly, including the sole. In an example, integration can include positioning the loop of lace cable connecting the lateral and medial sides of the footwear upper in position to engage a lacing engine in a mid-sole of the footwear assembly.

Figure 11:
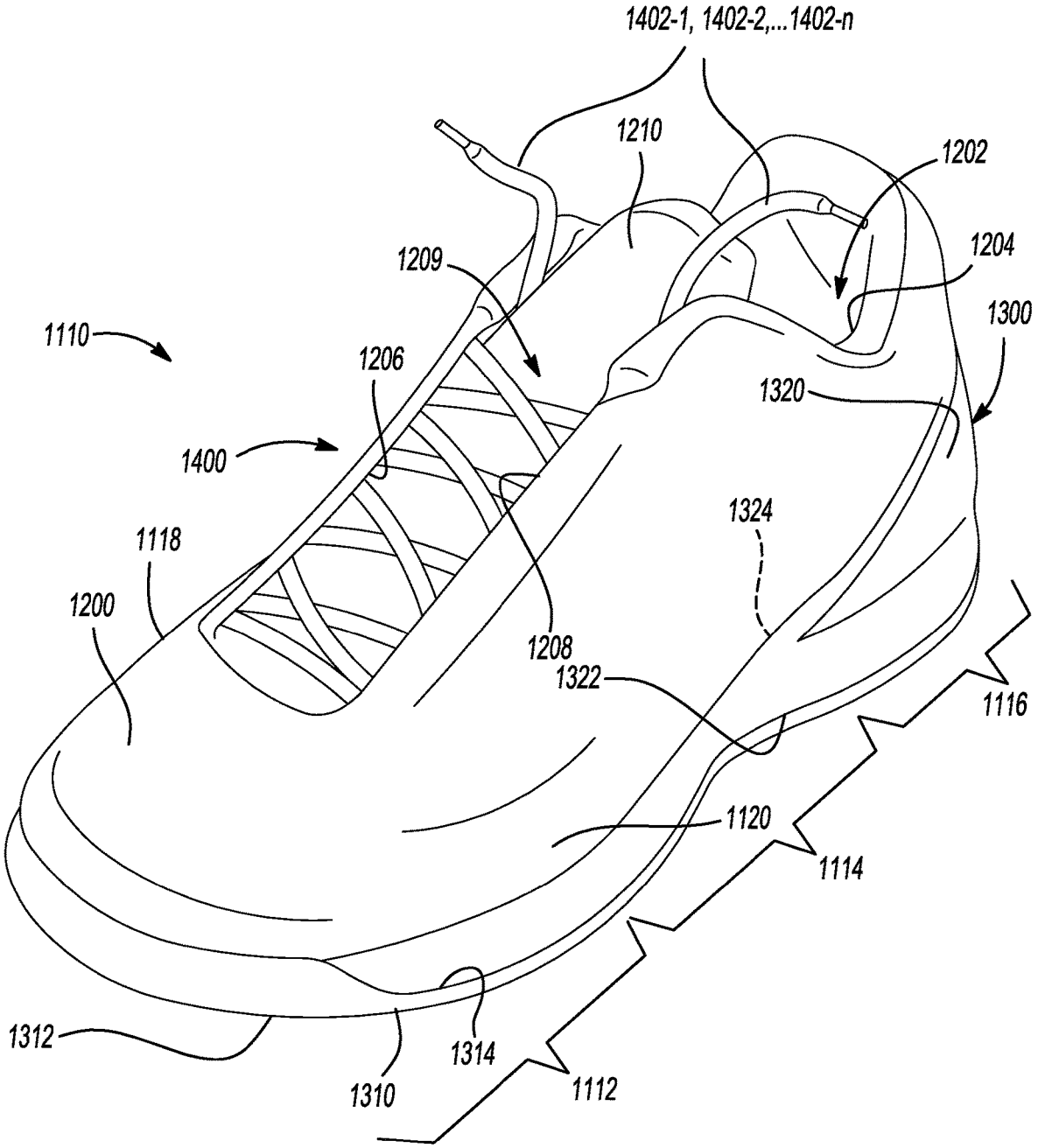
FIG. 11 is a perspective view of an article of footwear having a lacing system in accordance with principles of the present disclosure.

Referring to FIG. 11, in some implementations, an article of footwear 1110 includes an upper 1200, a sole structure 1300 attached to the upper 1200, and a lacing system 1400 operable to move the upper 1200 between a tightened state and a loosened state. The article of footwear 1110 may be divided into one or more portions. For example, the portions may include a forefoot portion 1112, a mid-foot portion 1114 and a heel portion 1116. The forefoot portion 1112 may correspond with toes and joints connecting metatarsal bones with phalanx bones of a foot. The mid-foot portion 1114 may correspond with an arch area of the foot, and the heel portion 1116 may correspond with rear portions of the foot, including a calcaneus bone. The footwear 1110 may include medial and lateral sides 1118, 1120, respectively, corresponding with opposite sides of the footwear 1110 and extending through the portions 1112, 1114, 1116.

The upper 1200 includes interior surfaces that define an interior void 1202 configured to receive and secure a foot for support on the sole structure 1300. An opening 1204 may provide access to the interior void 1202. For example, the opening 1204 may receive a foot to secure the foot within the void 1202 and facilitate entry and removal of the foot from and to the interior void 1202. The opening 1204 may be defined in part by a medial edge 1206 and an opposite lateral edge 1208 of the upper 1200. In this regard, the medial and lateral edges 1206, 1208 may define a lacing area 1209 of the article of footwear 1110.

The upper 1200 may include a tongue portion 1210 that extends along the lacing area 1209 and covers at least a portion of the opening 1204. The upper 1200 may be formed from one or more materials that are stitched or adhesively bonded together to form the interior void 1202. Suitable materials of the upper 1200 may include, but are not limited to, textiles, foam, leather, and synthetic leather. The materials of the upper 1200 may be selected and located to impart properties of durability, air-permeability, wear-resistance, flexibility, and comfort.

In some implementations, the sole structure 1300 includes an outsole 1310 and a midsole 1320 arranged in a layered configuration. For example, the outsole 1310 engages with a ground surface during use of the footwear 1110, and the midsole 1320 is disposed between the upper 1200 and the outsole 1310. In some implementations, the midsole 1320 attaches to the upper 1200. In some examples, the sole structure 1300 may also incorporate additional layers such as an insole or sockliner that may reside within the interior void 1202 of the upper 1200 to receive a plantar surface of the foot to enhance the comfort of the footwear 1110.

In some examples, the outsole 1310 includes a ground-engaging surface 1312 and an opposite inner surface 1314. The inner surface 1314 may attach to the midsole 1320 or the upper 1200. The outsole 1310 generally provides abrasion-resistance and traction with the ground surface and may be formed from one or more materials that impart durability and wear-resistance, as well as enhance traction with the ground surface. For example, rubber may form at least a portion of the outsole 1310.

The midsole 1320 may include a bottom surface 1322 and a footbed 1324 disposed on an opposite side of the midsole 1320 than the bottom surface 1322. Stitching or adhesives may secure the midsole 1320 to the upper 1200. The footbed 1324 may be contoured to conform to a profile of the bottom surface (e.g., plantar) of the foot. In some examples, the insole or sockliner may be disposed on the footbed 1324 under the foot within at least a portion of the interior void 1202 of the upper 1200. The midsole 1320 may be formed from one or more polymer foam materials to provide resilient compressibility under an applied load to attenuate ground-reaction forces. In some examples, the midsole 1320 is integrally formed with the outsole 1310 and extends through the portions 1112, 1114, 1116 of the footwear 1110 between the inner surface 1314 of the outsole 1310 and the bottom surface 1322 of the midsole 1320.

Figure 12A:
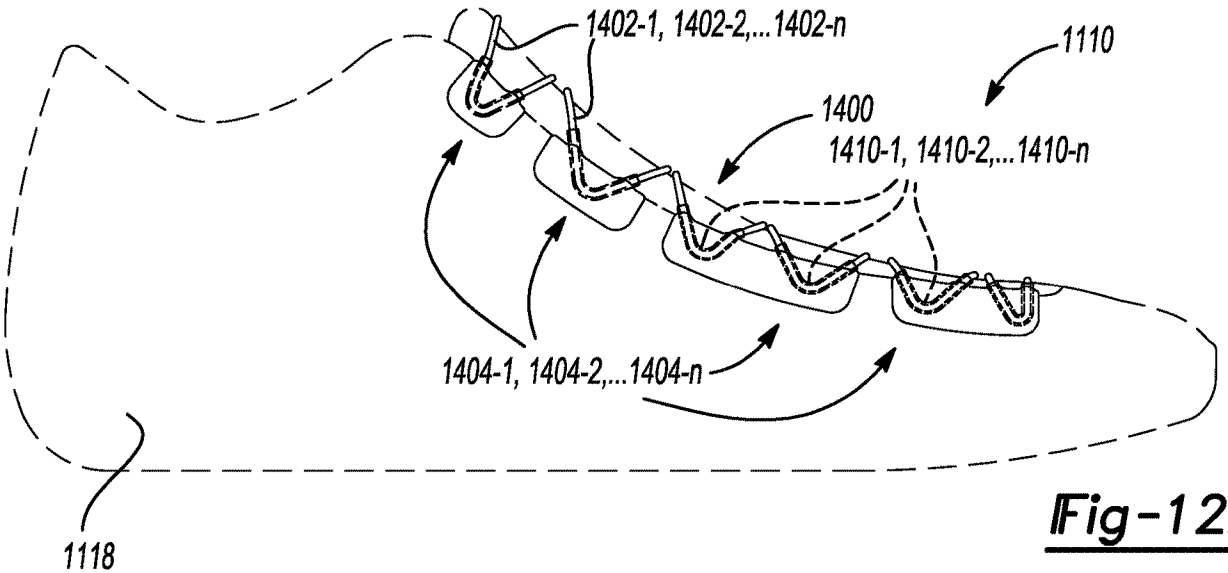
FIG. 12A is a side view of the article of footwear of FIG. 11.
Figure 12B:
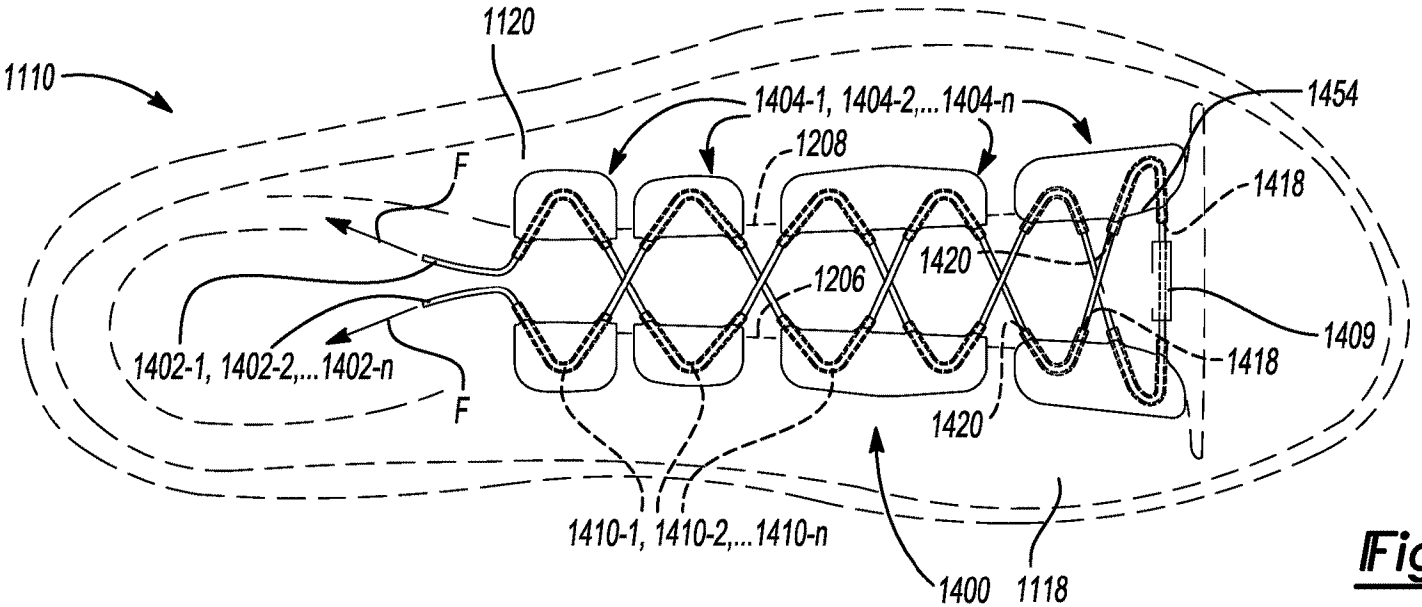
FIG. 12B is a top view of the article of footwear of FIG. 11.

With reference to FIGS. 12A and 12B, the lacing system 1400 includes one or more laces 1402-1, 1402-2, . . . **1402-*n* and one or more lace-receiving assemblies 1404-1, 1404-2, . . . 1404-*n*. In some examples, the lacing system 1400 includes two laces 1402-1, 1402-2 and eight lace-receiving assemblies 1404-1, 1404-2, . . . 1404-*n*. It will be appreciated, however, that the lacing system 1400 may include more or less than two laces 1402-1, 1402-2 and more or less than eight lace-receiving assemblies 1404-1, 1404-2, . . . 1404-*n* within the scope of the present disclosure. In some implementations, the laces 1402-1, 1402-2, . . . 1402-*n* are operatively connected at an attachment location 1409 (FIG. 12B) such that the laces 1402-1, 1402-2, . . . 1402-*n*** define a continuous construct.

The laces 1402-1, 1402-2, . . . **1402-*n* may be highly lubricious and/or may be formed from one or more fibers having a low modulus of elasticity and a high tensile strength. For instance, the fibers may include high modulus polyethylene fibers having a high strength-to-weight ratio and very low elasticity. Additionally or alternatively, the laces 1402-1, 1402-2, . . . 1402-*n* may be formed from a molded monofilament polymer and/or a woven steel with or without other lubrication coating. In some examples, the laces 1402-1, 1402-2, . . . 1402-*n*** include multiple strands of material woven together.

The laces 1402-1, 1402-2, . . . **1402-*n* may be movable in a tightening direction F (FIG. 12B) to move the lacing system 1400 into a tightened state and may be movable in a loosening direction that is opposite to direction F to move the lacing system 1400 into a loosened state. For example, application of a force in the direction F (FIG. 12B) on the laces 1402-1, 1402-2, . . . 1402-*n* may move the laces in the tightening direction to move the lacing system 1400 into the tightened state to adjust a fit of the interior void 1202 around the foot and accommodate entry and removal therefrom. For instance, tightening of the laces 1402-1, 1402-2 moves the medial edge 1206 towards the lateral edge 1208 and cinches the upper 1200 to close the interior void 1202 around the foot, while loosening of the laces 1402-1, 1402-2 allows the medial edge 1206 to move away from the lateral edge 1208 and relaxes the upper 1200 to open the interior void 1202 for removal of the foot therefrom. The upper 1200 may include apertures such as eyelets and/or other engagement features such as fabric or mesh loops that receive the laces 1402-1, 1402-2, . . . 1402-*n***.

In some implementations, the force applied in the direction F may be applied on the laces 1402-1, 1402-2, . . . **1402-*n* in a manual manner when a user pulls one or more of the laces 1402-1, 1402-2, . . . 1402-*n* in the direction F. In other implementations, the force may be applied on the laces 1402-1, 1402-2, . . . 1402-*n* in an automatic manner when a tightening mechanism (not shown) pulls one or more of the laces 1402-1, 1402-2, . . . 1402-*n*** or may be secured by a tightening mechanism when manually pulled in the direction F. Various configurations and functions of such a tightening mechanism may be found in commonly owned U.S. Patent Application Ser. No. 62/365,764 filed Jul. 22, 2016 and entitled "Dynamic Lacing System," the disclosure of which is hereby incorporated by reference in its entirety.

Figure 13A:
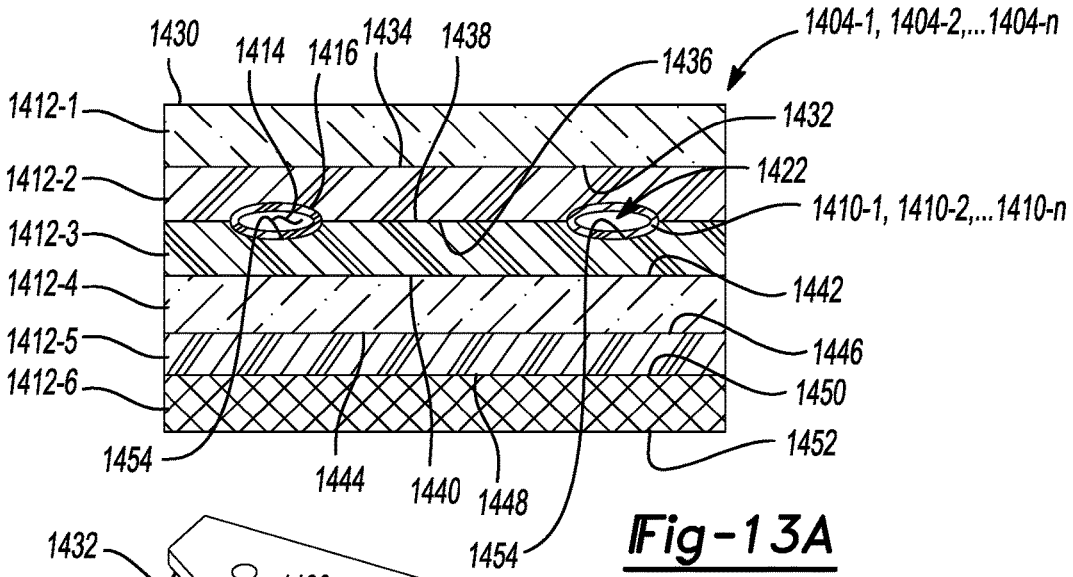
FIG. 13A is a representative partial cross-sectional view of a lace-receiving assembly of the lacing system in accordance with principles of the present disclosure.
Figure 13B:
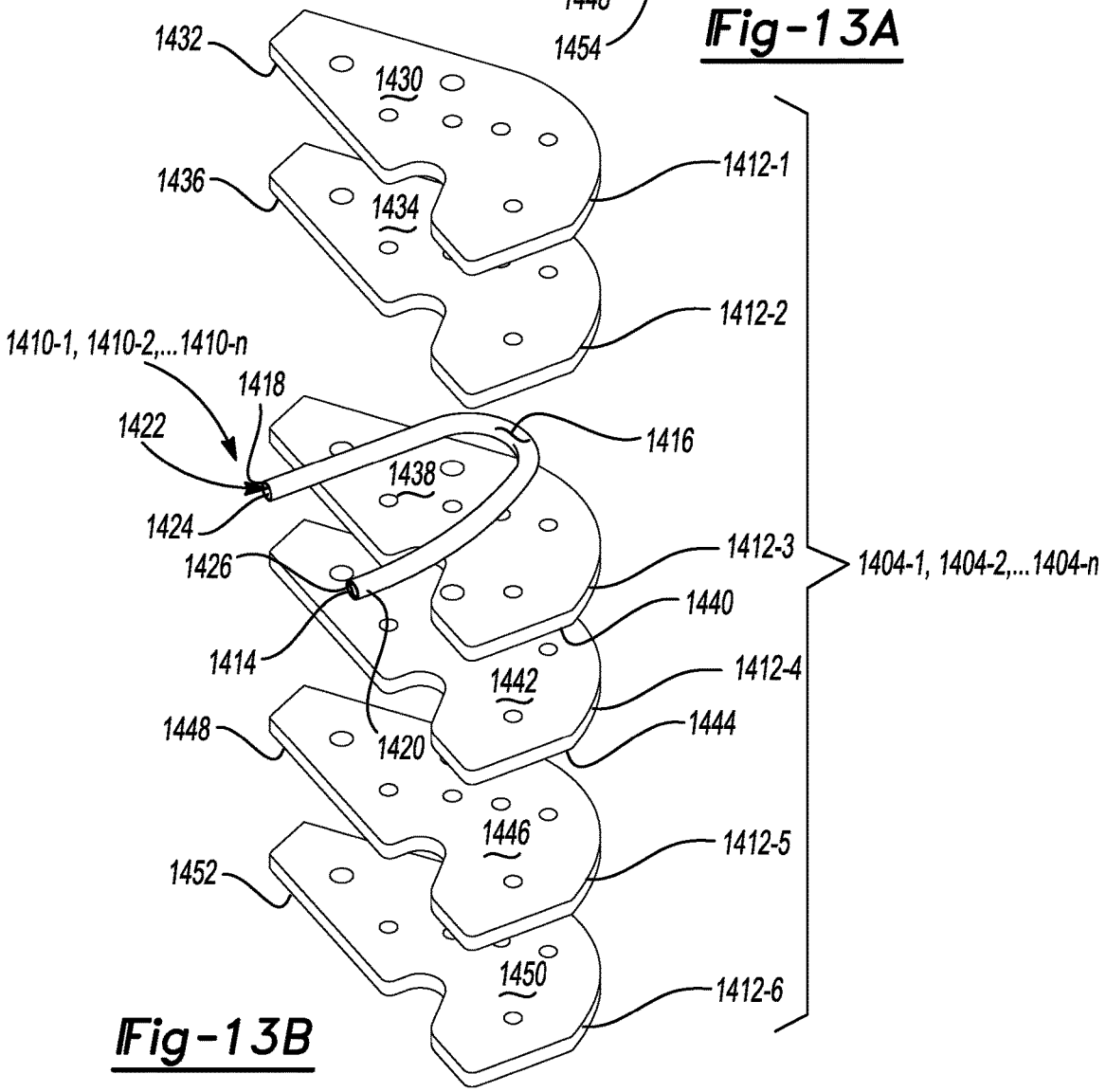
FIG. 13B is a representative exploded view of the lace-receiving assembly of FIG. 13A.

With reference to FIGS. 13A and 13B, the lace-receiving assemblies 1404-1, 1404-2, . . . **1404-*n* may each include one or more lace guides 1410-1, 1410-2, . . . 1410-*n* and a plurality of sheets 1412-1, 1412-2, . . . 1412-*n* of material (e.g., a substrate). As illustrated in FIG. 13B, the lace guides 1410-1, 1410-2, . . . 1410-*n* may each include an inner surface 1414 and an outer surface 1416. The inner surface 1414 and the outer surface 1416 may extend from a proximal end 1418 of the lace guide 1410-1, 1410-2, . . . 1410-*n* to a distal end 1420 of the lace guide 1410-1, 1410-2, . . . 1410-*n*. In some implementations, the lace guides 1410-1, 1410-2, . . . 1410-*n* define an arcuate shape (e.g., C-shape, U-shape, S-shape, etc.) extending from the proximal end 1418 to the distal end 1420. The lace guides 1410-1, 1410-2, . . . 1410-*n* may be pre-formed into the desired arcuate shape or, alternatively, may be formed from a substantially straight tube, cut, and bent into the desired arcuate shape. If bent into the desired arcuate shape, the guides 1410-1, 1410-2, . . . 1410-*n* may be held in the desired shape by the sheets 1412-1, 1412-2, . . . 1412-*n*** of material, as will be described in detail below.

The inner surface 1414 may define a passage 1422 extending through each lace guide 1410-1, 1410-2, . . . **1410-*n* from the proximal end 1418 to the distal end 1420, such that the lace guides 1410-1, 1410-2, . . . 1410-*n* define a substantially cylindrical conduit or tube. The proximal end 1418 includes an entrance opening 1424 in fluid communication with the passage 1422 while the distal end 1420 forms an exit opening 1426 in fluid communication with both the passage 1422 and the entrance opening 1424**.

Suitable materials for each of the lace guides 1410-1, 1410-2, . . . **1410-*n* may include, but are not limited to, Teflon®. For example, the lace guides 1410-1, 1410-2, . . . 1410-*n* may include a fluoropolymer, such as polytetrafluoroethylene (PTFE). In some implementations, the inner surface 1414 of the lace guides 1410-1, 1410-2, . . . 1410-*n*** may be coated with a fluoropolymer (e.g., PTFE).

With continued reference to FIGS. 13A and 13B, in some implementations, the lace-receiving assemblies 1404-1, 1404-2, . . . **1404-*n* include a first sheet 1412-1, a second sheet 1412-2, a third sheet 1412-3, a fourth sheet 1412-4, a fifth sheet 1412-5, and a sixth sheet 1412-6. Suitable materials for each of the plurality of sheets 1412-1, 1412-2, . . . 1412-*n* may include, but are not limited to, textiles, foam, leather, synthetic leather, or a hot melt material (e.g., thermoplastic polyurethane (TPU)). For example, the first sheet 1412-1 may include a synthetic suede leather the ultimately forms an outer surface of the article of footwear 1110. The second and third sheets 1412-2, 1412-3 may include TPU. The fourth sheet 1412-4 may include a synthetic suede leather. The fifth sheet 1412-5 may include TPU. The sixth sheet 1412-6 may include a textile, foam, leather, or synthetic leather that forms the upper 1200. As such, the sixth sheet 1412-6 may be a portion of an outer surface of the upper 1200 of the article of footwear 1110. In the example provided in FIG. 13B, the sixth sheet 1412-6 may be a material of the upper 1200 and, as such, acts as a substrate that supports the other sheets 1412-1, 1412-2, 1412-3, 1412-4, 1412-5. While the sixth sheet 1412-6 is described as being a portion of the upper 1200, the sixth sheet 1412-6 could alternatively be a substrate that is attached to a material of the upper 1200** via stitching, adhesive, and the like.

The first sheet 1412-1 includes an upper surface 1430 and an opposite lower surface 1432. The second sheet 1412-2 includes an upper surface 1434 and an opposite lower surface 1436. The third sheet 1412-3 includes an upper surface 1438 and an opposite lower surface 1440. The fourth sheet 1412-4 includes an upper surface 1442 and an opposite lower surface 1444. The fifth sheet 1412-5 includes an upper surface 1446 and an opposite lower surface 1448. The sixth sheet 1412-6 includes an upper surface 1450 and an opposite lower surface 1452.

In an assembled implementation, (i) the lower surface 1432 of the first sheet 1412-1 may engage, and be coupled to, the upper surface 1434 of the second sheet 1412-2, (ii) the lower surface 1436 of the second sheet 1412-2 may engage, and be coupled to, the upper surface 1438 of the third sheet 1412-3, (iii) the lower surface 1440 of the third sheet 1412-3 may engage, and be coupled to, the upper surface 1442 of the fourth sheet 1412-4, (iv) the lower surface 1444 of the fourth sheet 1412-4 may engage, and be coupled to, the upper surface 1446 of the fifth sheet 1412-5, and (v) the lower surface 1448 of the fifth sheet 1412-5 may engage, and be coupled to, the upper surface 1450 of the sixth sheet 1412-6.

As illustrated in FIG. 13A, at least a portion of each of the lace guides 1410-1, 1410-2, . . . **1410-*n* may be disposed between the second sheet 1412-2 and the third sheet 1412-3, such that the lower surface 1436 of the second sheet 1412-2 and the upper surface 1438 of the third sheet 1412-3 engage the lace guides 1410-1, 1410-2, . . . 1410-*n*. In this regard, the lower surface 1436 of the second sheet 1412-2 and/or the upper surface 1438 of the third sheet 1412-3 may define a channel 1454** extending therebetween.

As illustrated in FIG. 13B, in some implementations, the lace guides 1410-1, 1410-2, . . . **1410-*n* are disposed between the second sheet 1412-2 and the third sheet 1412-3. For example, the lace guides 1410-1, 1410-2, . . . 1410-*n* are disposed within the channel 1454 defined by the lower surface 1436 of the second sheet 1412-2 and/or the upper surface 1438 of the third sheet 1412-3. During formation of the lace-receiving assemblies 1404-1, 1404-2, . . . 1404-*n*, the second sheet 1412-2 and the third sheet 1412-3 may be bonded to one another by applying heat to the sheets 1412-2, 1412-3 at a temperature that is above the melting temperature of the sheets 1412-2, 1412-3 but is below the melting temperature of the lace guides 1410-1, 1410-2, . . . 1410-*n*. Accordingly, the sheets 1412-2, 1412-3 are bonded to one another when the material of the sheets 1412-2, 1412-3 is melted and flows but the lace guides 1410-1, 1410-2, . . . 1410-*n* retain their desired cross-sectional shape. As will be described below, attaching the second sheet 1412-2 to the third sheet 1412-3 retains the lace guides 1410-1, 1410-2, . . . 1410-*n* between the sheets 1412-2, 1412-3 and, further, maintains the lace guides 1410-1, 1410-2, . . . 1410-*n*** in a desired shape.

In some implementations, the lace guides 1410-1, 1410-2, . . . **1410-*n* are disposed between the second sheet 1412-2 and the third sheet 1412-3 such that the proximal end 1418 and/or the distal end 1420 is flush with, extends beyond, or is recessed within the sheets 1412-1, 1412-2, . . . 1412-*n* of material. For example, the proximal and/or distal ends 1418, 1420 of the lace guides 1410-1, 1410-2, . . . 1410-*n* may protrude from, extend from, or be recessed from an outer edge 1455 defined by the sheets 1412-1, 1412-2, . . . 1412-*n* of material, such that the entrance opening 1424 and exit opening 1426 are in fluid communication with an area (e.g., the interior void 1202) external to the lace-receiving assemblies 1404-1, 1404-2, . . . 1404-*n***.

As illustrated in FIGS. 12A and 12B, the lace-receiving assemblies 1404-1, 1404-2, . . . **1404-*n* may be disposed on the medial and lateral sides 1118, 1120 of the footwear 1110. For example, one or more of the lace-receiving assemblies 1404-1, 1404-2, . . . 1404-*n* may be disposed along the medial edge 1206 of the upper 1200, and one or more of the lace-receiving assemblies 1404-1, 1404-2, . . . 1404-*n* may be disposed along the lateral edge 1208 of the upper 1200. In this regard, the proximal and distal ends 1418, 1420 of a lace guide 310-*n* disposed on the medial edge 1206 of the upper 1200 may face the lateral side 1120 of the footwear 1110, and the proximal and distal ends 1418, 1420 of a lace guide 1410-*n* disposed on the lateral edge 1208 of the upper 1200 may face the medial side 1118 of the footwear 1110**.

The laces 1402-1, 1402-2, . . . **1402-*n* may be routed through the lace guides 1410-1, 1410-2, . . . 1410-*n*. For example, the laces 1402-1, 1402-2, . . . 1402-*n* may extend from a first of the lace-receiving assemblies 1404-1, 1404-2, . . . 1404-*n* disposed along the medial edge 1206 of the upper 1200 to a second of the lace-receiving assemblies 1404-1, 1404-2, . . . 1404-*n* disposed along the lateral edge 1208 of the upper 1200, and from the second of the lace-receiving assemblies 1404-1, 1404-2, . . . 1404-*n* back to the first of the lace-receiving assemblies 1404-1, 1404-2, . . . 1404-*n* or to a third of the lace-receiving assemblies 1404-1, 1404-2, . . . 1404-*n* disposed along the medial edge 1206 of the upper 1200. In this regard, the laces 1402-1, 1402-2, . . . 1402-*n* may extend back and forth between various lace-receiving assemblies 1404-1, 1404-2, . . . 1404-*n* disposed along the medial and lateral edges 1206, 1208 of the upper 1200. In some implementations, the laces 1402-1, 1402-2, . . . 1402-*n* are translatably disposed within the lace guides 1410-1, 1410-2, . . . 1410-*n*. For example, the laces 1402-1, 1402-2, . . . 1402-*n* may extend through the passage 1422 of the lace guides 1410-1, 1410-2, . . . 1410-*n* and out of the entrance and exit openings 1424, 1426, such that the laces 1402-1, 1402-2, . . . 1402-*n* slidably engage the inner surface 1414 of the lace guides 1410-1, 1410-2, . . . 1410-*n***.

Figure 14A:
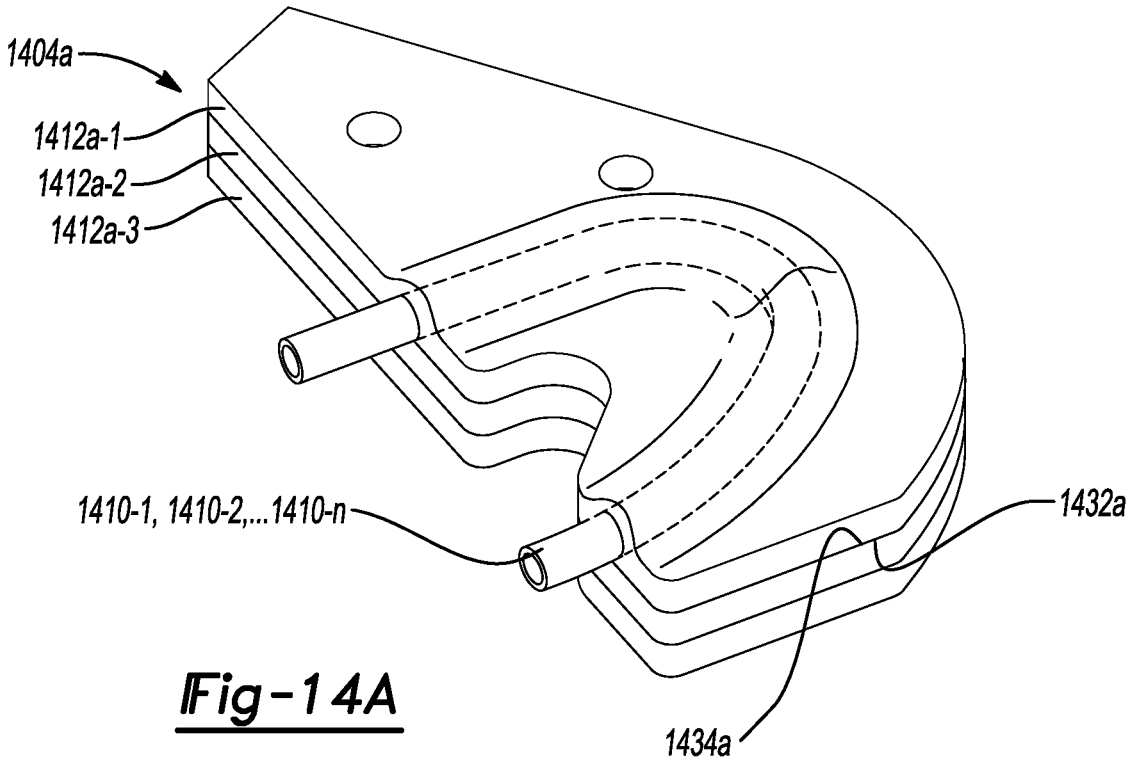
FIG. 14A is a perspective view of another lace-receiving assembly in accordance with principles of the present disclosure.

With reference to FIG. 14A, another lace-receiving assembly **1404*a* for use with the lacing system 1400 is shown. The structure and function of the lace-receiving assembly 1404*a* may be substantially similar to that of the lace-receiving assemblies 1404-1, 1404-2, . . . 1404-*n***, apart from any exceptions described below and/or shown in the figures. Accordingly, the structure and/or function of similar features will not be described again in detail. In addition, like reference numerals are used hereinafter and in the drawings to identify like features, while like reference numerals containing letter extensions (i.e., "a") are used to identify those features that have been modified.

The lace-receiving assembly **1404*a* may include one or more of the lace guides 1410-1, 1410-2, . . . 1410-*n*, a first sheet 1412***a*-1, a second sheet 1412*a*-2, and a third sheet 1412*a*-3. The first and second sheets 1412*a*-1, 1412*a*-2 may include TPU. The third sheet 1412*a*-3 may include a textile, foam, leather, or synthetic leather. In this regard, at least one of the sheets 1412*a*-1, 1412*a*-2, 312*a*-3 (e.g., 1412*a*-3) may include the material of the upper 1200 and, further, may form a portion of the upper 1200. As illustrated in FIG. 14A, at least a portion of each of the lace guides 1410-1, 1410-2, . . . 1410-*n* may be disposed between the first sheet 1412*a*-1 and the second sheet 1412*a*-2, such that a lower surface 1432*a* of the first sheet 1412*a*-1 and an upper surface 1434*a* of the second sheet 1412*a*-2 engage the lace guides 1410-1, 1410-2, . . . 1410-*n*.

Figure 14B:
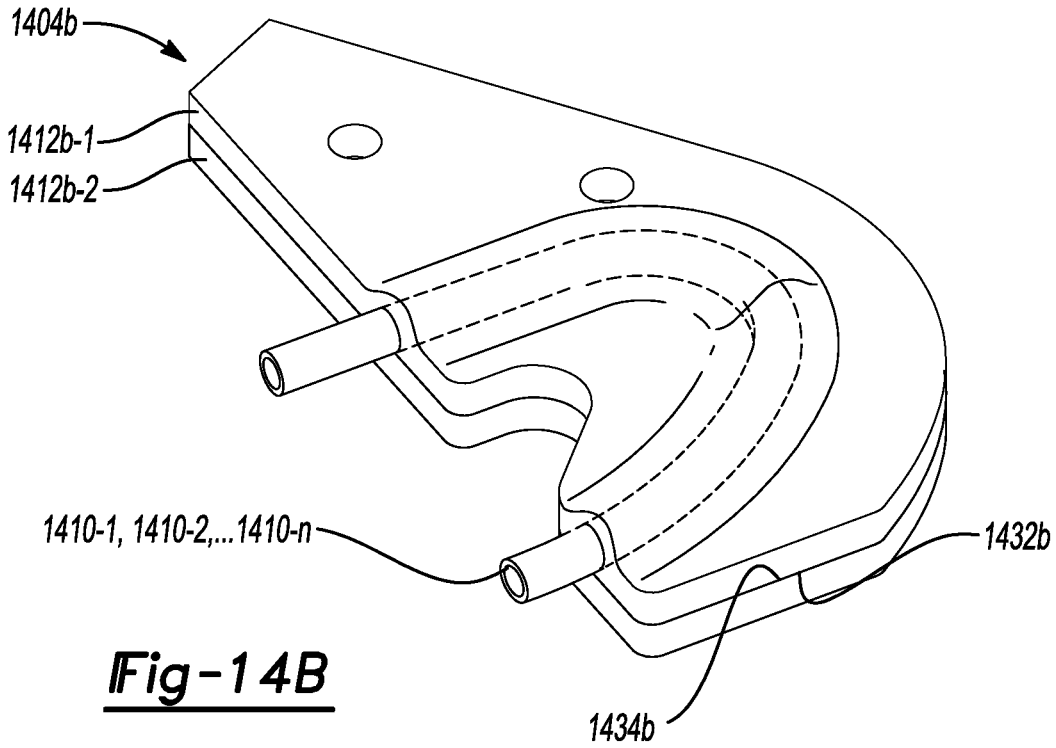
FIG. 14B is a perspective view of another lace-receiving assembly in accordance with principles of the present disclosure.

With reference to FIG. 14B, another lace-receiving assembly 1404*b* for use with the lacing system 1400 is shown. The structure and function of the lace-receiving assembly 1404*b* may be substantially similar to that of the lace-receiving assemblies 1404-1, 1404-2, . . . 1404-*n*, apart from any exceptions described below and/or shown in the figures. Accordingly, the structure and/or function of similar features will not be described again in detail. In addition, like reference numerals are used hereinafter and in the drawings to identify like features, while like reference numerals containing letter extensions (i.e., "b") are used to identify those features that have been modified.

The lace-receiving assembly 1404*b* may include one or more of the lace guides 1410-1, 1410-2, . . . 1410-*n*, a first sheet 1412*b*-1, and a second sheet 1412*b*-2. The first sheet 1412*b*-1 may include TPU. The second sheet 1412*b*-2 may include a textile, foam, leather, or synthetic leather. In this regard, at least one of the sheets 1412*b*-1, 1412*b*-2 (e.g., 1412*b*-2) may include the material of the upper 1200 and may be a portion of the upper 1200. As illustrated in FIG. 14B, at least a portion of each of the lace guides 1410-1, 1410-2, . . . 1410-*n* may be disposed between the first sheet 1412*b*-1 and the second sheet 1412*b*-2, such that a lower surface 1432*b* of the first sheet 1412*b*-1 and an upper surface 1434*b* of the second sheet 1412*b*-2 engage the lace guides 1410-1, 1410-2, . . . 1410-*n*.

Figure 14C:
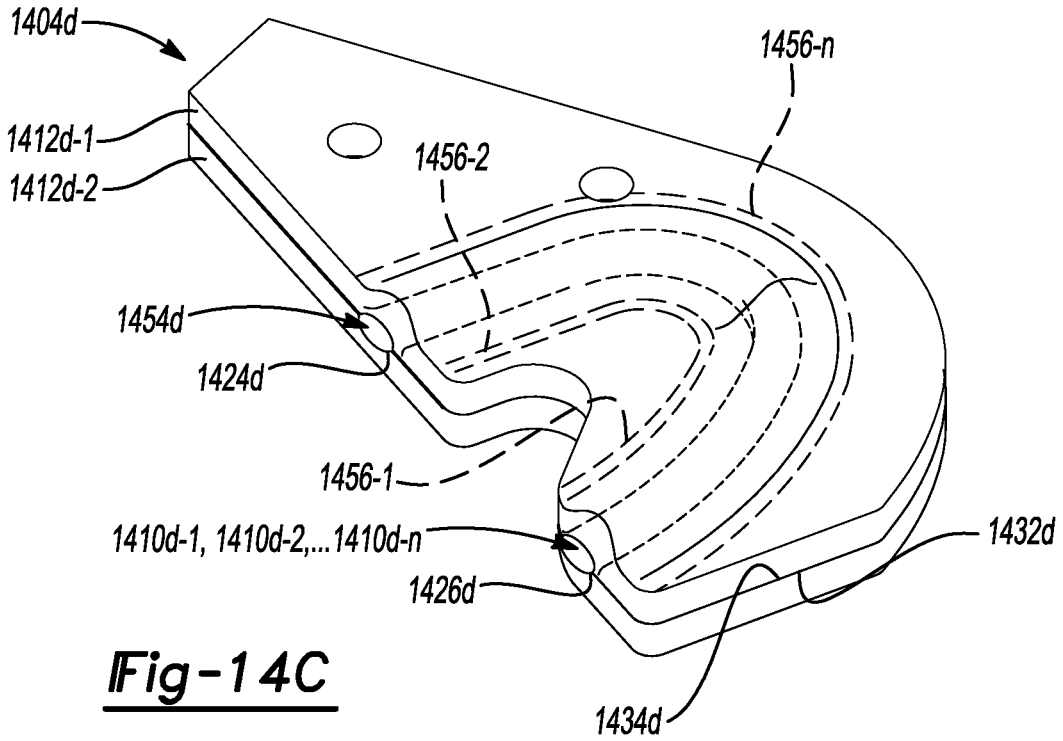
FIG. 14C is a perspective view of another lace-receiving assembly in accordance with principles of the present disclosure.

With reference to FIG. 14C, another lace-receiving assembly 1404*d* for use with the lacing system 1400 is shown. The structure and function of the lace-receiving assembly 1404*d* may be substantially similar to that of the lace-receiving assemblies 1404-1, 1404-2, . . . 1404-*n*, apart from any exceptions described below and/or shown in the figures. Accordingly, the structure and/or function of similar features will not be described again in detail. In addition, like reference numerals are used hereinafter and in the drawings to identify like features, while like reference numerals containing letter extensions (i.e., "d") are used to identify those features that have been modified.

The lace-receiving assembly 1404*d* may include a first sheet 1412*d*-1 and a second sheet 1412*d*-2. The first sheet 1412*d*-1 or the second sheet 1412*d*-2 may include a textile, foam, leather, synthetic leather, or TPU. In this regard, at least one of the sheets 1412*d*-1, 1412*d*-2 (e.g., 1412*d*-2) may include the material of the upper 1200 and may be a portion of the upper 1200. As illustrated in FIG. 14C, a lower surface 1432*d* of the first sheet 1412*d*-1 and an upper surface 1434*d* of the second sheet 1412*d*-2 may define one or more lace guides 1410*d*-1, 1410*d*-2, . . . 1410*d*-*n*. In this regard, the lace-receiving assembly 1404*d* may include one or more stitches 1456-1, 1456-2, . . . 1456-*n* extending through the lower surface 1432*d* and the upper surface 1434*d* to define a channel 1454*d* (e.g., a void) extending between the first sheet 1412*d*-1 and the second sheet 1412*d*-2. The stitches 1456-1, 1456-2, . . . 1456-*n* may be formed from a polyester satin or any other suitable material having a low coefficient of friction.

The channel 1454*d* may define one or more of the lace guides 1410*d*-1, 1410*d*-2, . . . 1410*d*-*n* (e.g., one or more voids) extending between the first sheet 1412*d*-1 and the second sheet 1412*d*-2 from an entrance opening 1424*d* to an exit opening 1426*d*. In this regard, the lace guides 1410*d*-1, 1410*d*-2, . . . 1410*d*-*n* (e.g., voids) may be disposed within the channel 1454*d*, such that the lace-receiving assembly 1404*d* may be formed without the lace guides 1410-1, 1410-2, . . . 1410-*n*. In some implementations, the stitches 1456-1, 1456-2, . . . 1456-*n* define an arcuate path, such that the channel 1454*d* or the lace guides 1410*d*-1, 1410*d*-2, . . . 1410*d*-*n* define an arcuate path extending from the entrance opening 1424*d* to the exit opening 1426*d*. In some implementations, the lace-receiving assembly 1404*d* may be formed without the stitch 1456-*n*, such that the lace guides 1410*d*-1, 1410*d*-2, . . . 1410*d*-*n* extend along an arch or convex curvature defined by the stitches 1456-1, 1456-2. In other implementations, the channel 1454*d* may be defined between adjacent ones of the stitches 1456-1, 1456-2, . . . 1456-*n*, such that the lace guides 1410*d*-1, 1410*d*-2, . . . 1410*d*-*n* are disposed between the convex curvature and a concave curvature defined by the stitches 1456-1, 1456-2, . . . 1456-*n*. In this regard, in some implementations, one or more of the stitches 1456-1, 1456-2, . . . 1456-*n* may extend substantially parallel to one or more of the other stitches 1456-1, 1456-2, . . . 1456-*n*. In some implementations, the stitches 1456-1, 1456-2, . . . 1456-*n* may define an embroidered construct defining the channel 1454*d* and one or more of the lace guides 1410*d*-1, 1410*d*-2, . . . 1410*d*-*n* between various ones of the stitches 1456-1, 1456-2, . . . 1456-*n*.

While the channel 1454*d* and the lace guides 1410*d*-1, 1410*d*-2, . . . 1410*d*-*n* are generally shown and described herein as being defined at least in part by one or more of the stitches 1456-1, 1456-2, . . . 1456-*n*, the channel 1454*d* and/or the lace guides 1410*d*-1, 1410*d*-2, . . . 1410*d*-*n* may be defined between opposed sheets (e.g., first sheet 1412*d*-1 and second sheet 1412*d*-2) using other techniques, within the scope of the present disclosure. For example, the channel 1454*d* and/or the lace guides 1410*d*-1, 1410*d*-2, . . . 1410*d*-*n* may be defined between unbonded portions of the lower surface 1432*d* and the upper surface 1434*d*. In this regard, a bond inhibitor (e.g., a material that inhibits bonding) may be disposed between the first sheet 1412*d*-1 and the second sheet 1412*d*-2 to inhibit bonding between the first sheet 1412*d*-1 and the second sheet 1412*d*-2 at the location of the bond inhibitor. For example, the bond inhibitor may be disposed on the lower surface 1432*d* or the upper surface 1434*d* to inhibit bonding therebetween. In some implementations, the bond inhibitor may be disposed along an arcuate path, such that that the unbonded portions of the lower surface 1432*d* or the upper surface 1434*d* define the channel 1454*d* and one or more of the lace guides 1410-1, 1410-2, . . . 1410-*n*.

Figure 15:
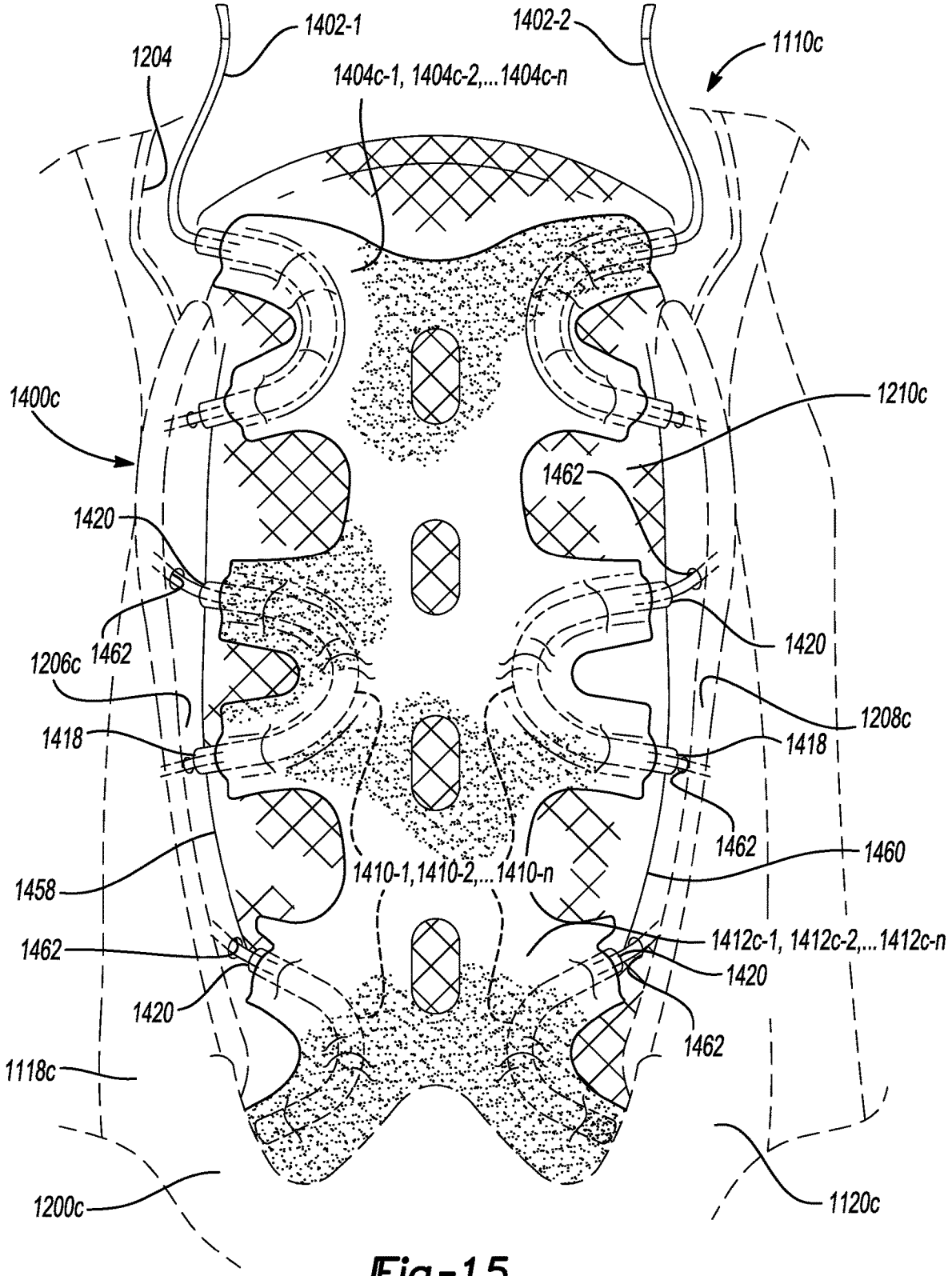
FIG. 15 is a top view of a portion of an article of footwear having a lacing system in accordance with principles of the present disclosure.

With reference to FIG. 15, a portion of another article of footwear 1110*c* is shown. The structure and function of the footwear 1110*c* may be substantially similar to that of the footwear 1110, apart from any exceptions described below and/or shown in the figures. Accordingly, the structure and/or function of similar features will not be described again in detail. In addition, like reference numerals are used hereinafter and in the drawings to identify like features, while like reference numerals containing letter extensions (i.e., "c") are used to identify those features that have been modified.

The footwear 1110*c* may include a tongue portion 1210*c* having a lacing system 1400*c*. The lacing system 1400*c* may include one or more of the laces 1402-1, 1402-2, . . . 1402-*n* and one or more lace-receiving assemblies 1404*c*-1, 1404*c*-2, . . . 1404*c*-*n*. The structure and function of the lace-receiving assemblies 1404*c*-1, 1404*c*-2, . . . 1404*c*-*n* may be substantially similar to that of the lace-receiving assemblies 1404-*n*, 1404*a*-*n*, 1404*b*-*n*, 1404*d*-*n* apart from any exceptions described below and/or shown in the figures. In some implementations, the lacing system 1400*c* includes a single lace-receiving assembly 1404*c*-1. It will be appreciated, however, that the lacing system may include more than one lace-receiving assembly 1404*c*-1, 1404*c*-2, . . . 1404*c*-*n*, or one or more of the lace receiving assemblies 1404-*n*, 1404*a*-*n*, 1404*b*-*n*, 1404*d*-*n* within the scope of the present disclosure.

The lace-receiving assemblies 1404*c*-1, 1404*c*-2, . . . 1404*c*-*n* may be coupled to the tongue portion 1210*c* of the footwear 1110*c*, as shown in FIG. 15. For example, one of the sheets 1412*c*-1, 1412*c*-2, . . . 1412*c*-*n* of the lace-receiving assemblies 1404*c*-1, 1404*c*-2, . . . 1404*c*-*n*, respectively, may be defined by a portion of the tongue portion 1210*c*. In this regard, the tongue portion 1210*c* serves as a substrate that supports the other sheets 1412*c*-1, 1412*c*-2, . . . 1412*c*-*n* of the lace-receiving assemblies 1404*c*-1, 1404*c*-2, . . . 1404*c*-*n*. As illustrated in FIG. 15, the lace-receiving assemblies 1404*c*-1, 1404*c*-2, . . . 1404*c*-*n* may be disposed on the tongue portion 1210*c* such that the proximal and distal ends 1418, 1420 of the lace guides 1410-1, 1410-2, . . . 1410-*n* are substantially aligned with a lateral side 1458 of the tongue portion 1210*c* or a medial side 1460 of the tongue portion 1210*c*. In particular, the lace guides 1410-1, 1410-2, . . . 1410-*n* may be disposed within the lace-receiving assemblies 1404*c*-1, 1404*c*-2, . . . 1404*c*-*n* such that the proximal and distal ends 1418, 1420 of a lace guide 1410-*n* disposed on the medial side 1460 of the tongue portion 1210*c* are facing the medial side 1318*c* of the footwear 1110*c*, and the proximal and distal ends 1418, 1420 of a lace guide 1410-*n* disposed on the lateral side 1458 of the tongue portion 1210*c* are facing the lateral side 1320*c* of the footwear 1110*c*.

The laces 1402-1, 1402-2, . . . 1402-*n* may be routed through the lace guides 1410-1, 1410-2, . . . 1410-*n*. For example, the laces 1402-1, 1402-2, . . . 1402-*n* may extend from a first of the lace guides 1410-1, 1410-2, . . . 1410-*n* into a portion of the upper 1200*c*, and from the upper 1200*c* into a second of the lace guides 1410-1, 1410-2, . . . 1410-*n*. In this regard, the medial and lateral edges 1206*c*, 1208*c* of the upper 1200*c* may include a plurality of apertures 1462 that receive the laces 1402-1, 1402-2, . . . 1402-*n*. In some implementations, the laces 1402-1, 1402-2, . . . 1402-*n* define a substantially serpentine configuration extending from and between the lace guides 1410-1, 1410-2, . . . 1410-*n* and the upper 1200*c*. In contrast to the configuration shown in FIG. 12B, the laces 1402-1, 1402-2, . . . 1402-*n* do not cross one another but, rather, extend along the respective edges 1206*c*, 1208*c*, as shown in FIG. 15. In operation, when a force is applied in the direction F, the effective length of the laces 1402-1, 1402-2, . . . 1402-*n* decreases, thereby drawing the edges 1206*c*, 1208*c* toward one another and tightening the article of footwear 1110*c*.

Figure 16:
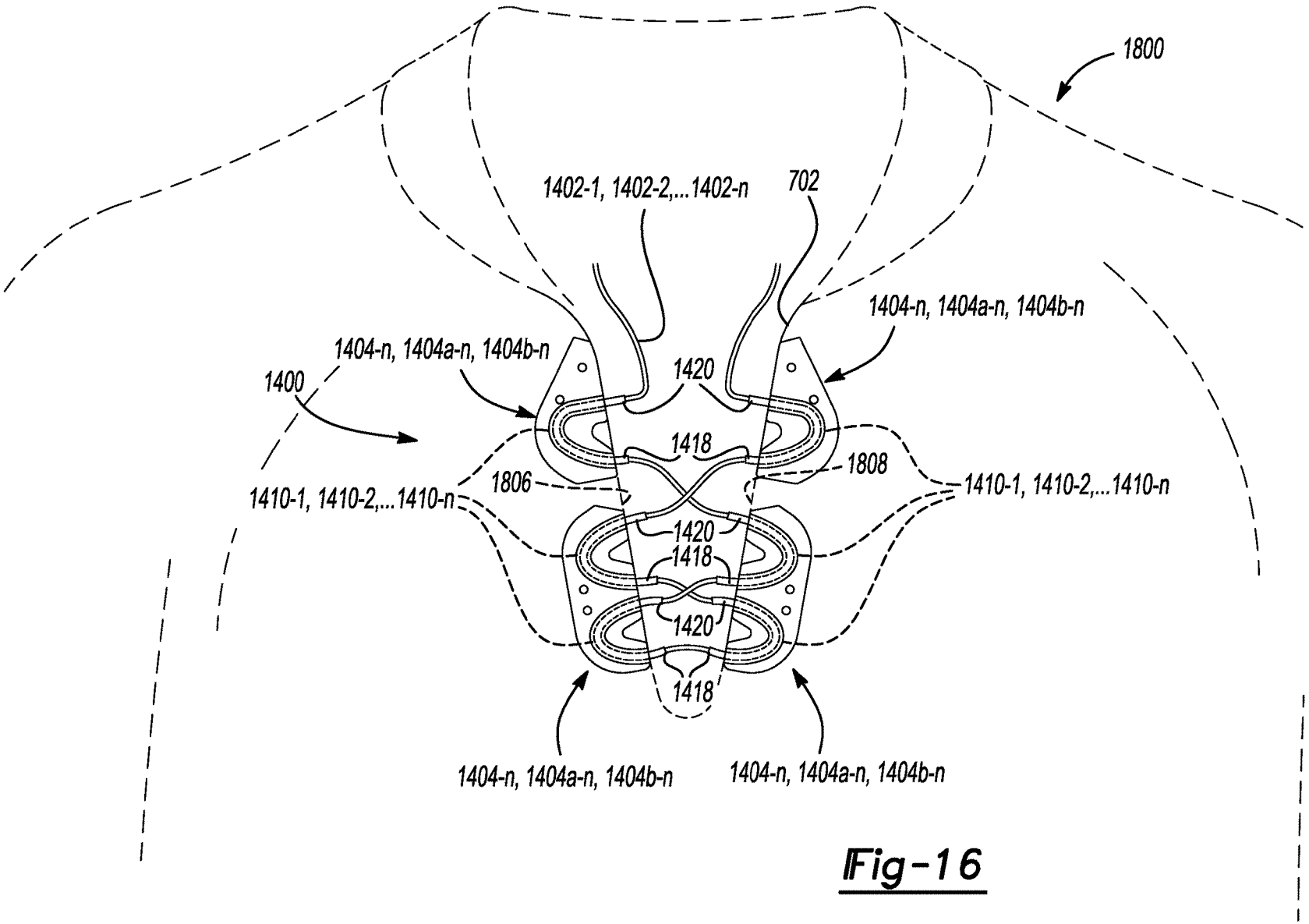
FIG. 16 is a front view of a portion of an article of clothing having a lacing system in accordance with principles of the present disclosure.
Figure 17:
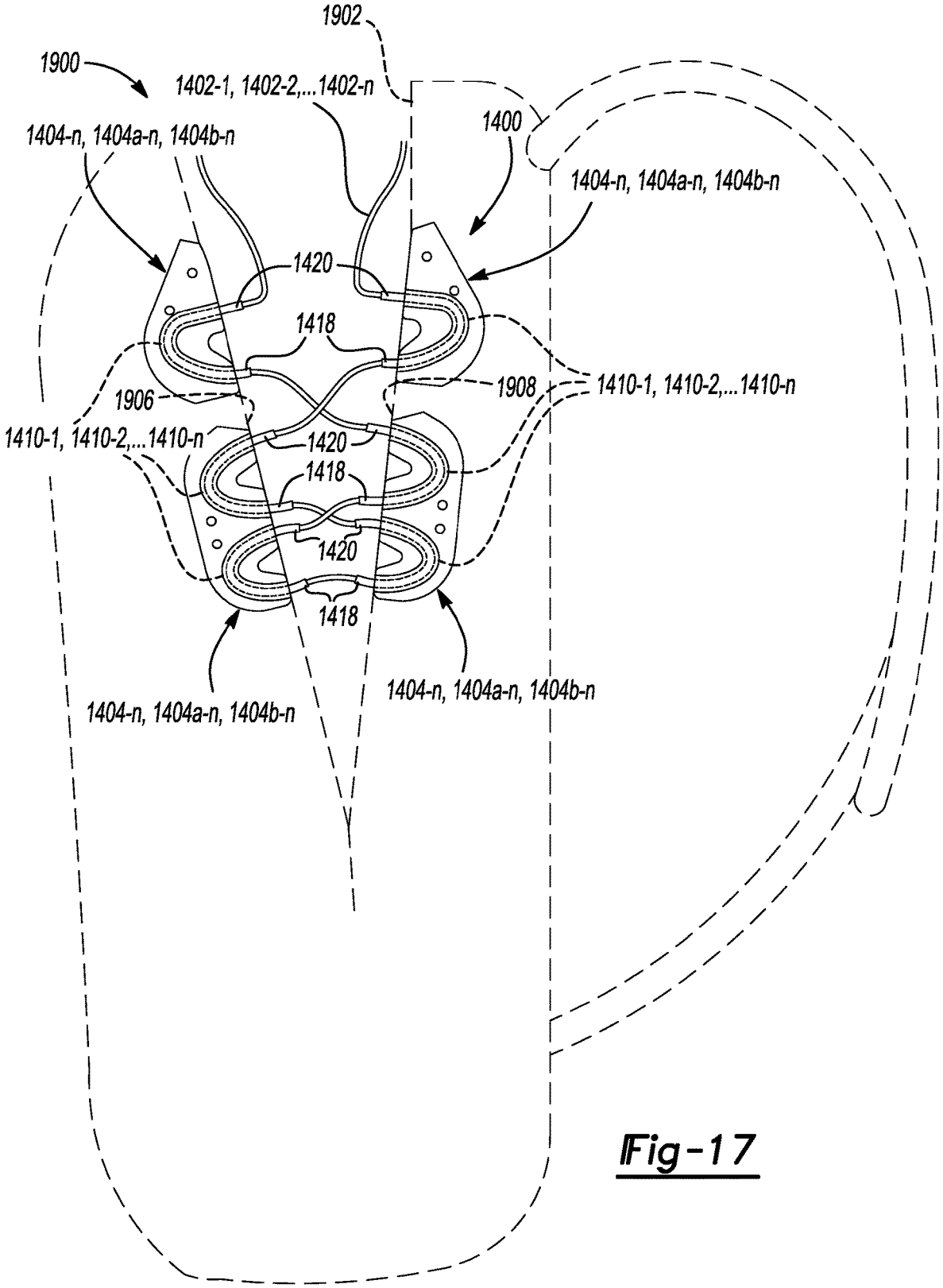
FIG. 17 is a front view of a bag having a lacing system in accordance with principles of the present disclosure.

With reference to FIG. 16, an article of clothing 1800 having an opening 1802 and the lacing system 1400 is illustrated. While the article of clothing 1800 is generally shown and described herein as being a shirt (e.g., a hooded sweatshirt), it will be appreciated that the article of clothing 1800 may be another type of clothing having the opening 1802 within the scope of the present disclosure. For example, the article of clothing 1800 may be a pair of pants or a jacket having the opening 1802. The opening 1802 may be defined in part by a first edge 1806 and an opposite second edge 1808 of the article of clothing 1800.

As previously described, the lacing system 1400 may include one or more of the laces 1402-1, 1402-2, . . . 1402-*n* and one or more of the lace-receiving assemblies 1404-*n*, 1404*a*-*n*, 1404*b*-*n*, 1404*d*-*n*. As illustrated in FIG. 16, the lace-receiving assemblies 1404-*n*, 1404*a*-*n*, 1404*b*-*n*, 1404*d*-*n* may be disposed along the edges 1806, 1808 of the article of clothing 1800 such that the proximal and distal ends 1418, 1420 of a lace guide 1410-*n* disposed on the first edge 1806 of the article of clothing 1800 face the second edge 1808 of the article of clothing 1800, and the proximal and distal ends 1418, 1420 of a lace guide 1410-*n* disposed on the second edge 1808 of the article of clothing 1800 face the first edge 1806 of the article of clothing 1800.

With reference to FIG. 16, a bag 1900 having an opening 1902 and the lacing system 1400 is illustrated. While the bag 1900 is generally shown and described herein as being a backpack, it will be appreciated that the bag 1900 may be another type of bag having the opening 1902 within the scope of the present disclosure. For example, the bag 1900 may be a duffle bag or a suitcase having the opening 1902. The opening 1902 may be defined in part by a first edge 1906 and an opposite second edge 1908 of the bag 1900.

As previously described, the lacing system 1400 may include one or more laces 1402-1, 1402-2, . . . 1402-*n* and one or more lace-receiving assemblies 1404-*n*, 1404*a*-*n*, 1404*b*-*n*, 1404*d*-*n*. As illustrated in FIG. 16, the lace-receiving assemblies 1404-*n*, 1404*a*-*n*, 1404*b*-*n*, 1404*d*-*n* may be disposed along the first and second edges 1906, 1908 of the bag 1900 such that the proximal and distal ends 1418, 1420 of a lace guide 1410-*n* disposed on the first edge 1806 of the bag 1900 face the second edge 1908 of the bag 1900, and the proximal and distal ends 1418, 1420 of a lace guide 1410-*n* disposed on the second edge 1908 of the bag 1900 face the first edge 1906 of the bag 1900.

With reference to FIGS. 18A-18E, a method of manufacturing a lace-receiving assembly will now be described. While the method is generally shown and described herein relative to the lace receiving assemblies 1404-1, 1404-2, . . . 1404-*n*, it will be appreciated that the method may be used to manufacture any of the previously-described lace receiving assemblies (e.g., lace receiving assemblies 1404-*n*, 1404*a*-*n*, 1404*b*-*n*, 1404*c*-*n*).

Figure 18A:
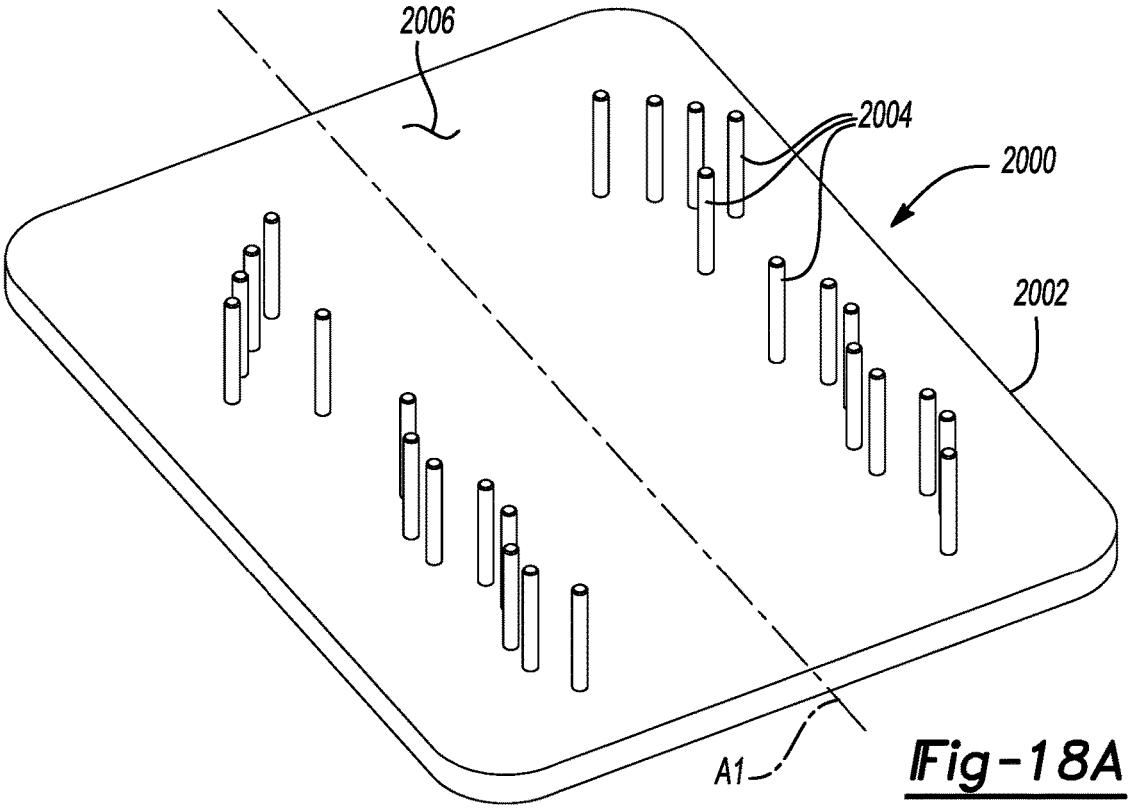
FIG. 18A is a perspective view of a pin board for manufacturing a lacing system in accordance with the principles of the present disclosure.

With reference to FIG. 18A, the method may include providing an assembly fixture 2000 having a support 2002 and a plurality of attachment features 2004. In some implementations, the support 2002 may include a plate or board defining a longitudinal axis A1, and the attachment features 2004 may include a plurality of pins. In this regard, the assembly fixture 2000 may be referred to herein as a "pin board 2000."

The attachment features 2004 may extend orthogonally from a surface 2006 of the support 2002. While the attachment features 2004 are illustrated as being disposed generally symmetrically relative to or about the longitudinal axis A1, it will be appreciated that the attachment features 2004 may be disposed in such a way as to define other arrangements or patterns within the scope of the present disclosure.

Figure 18B:
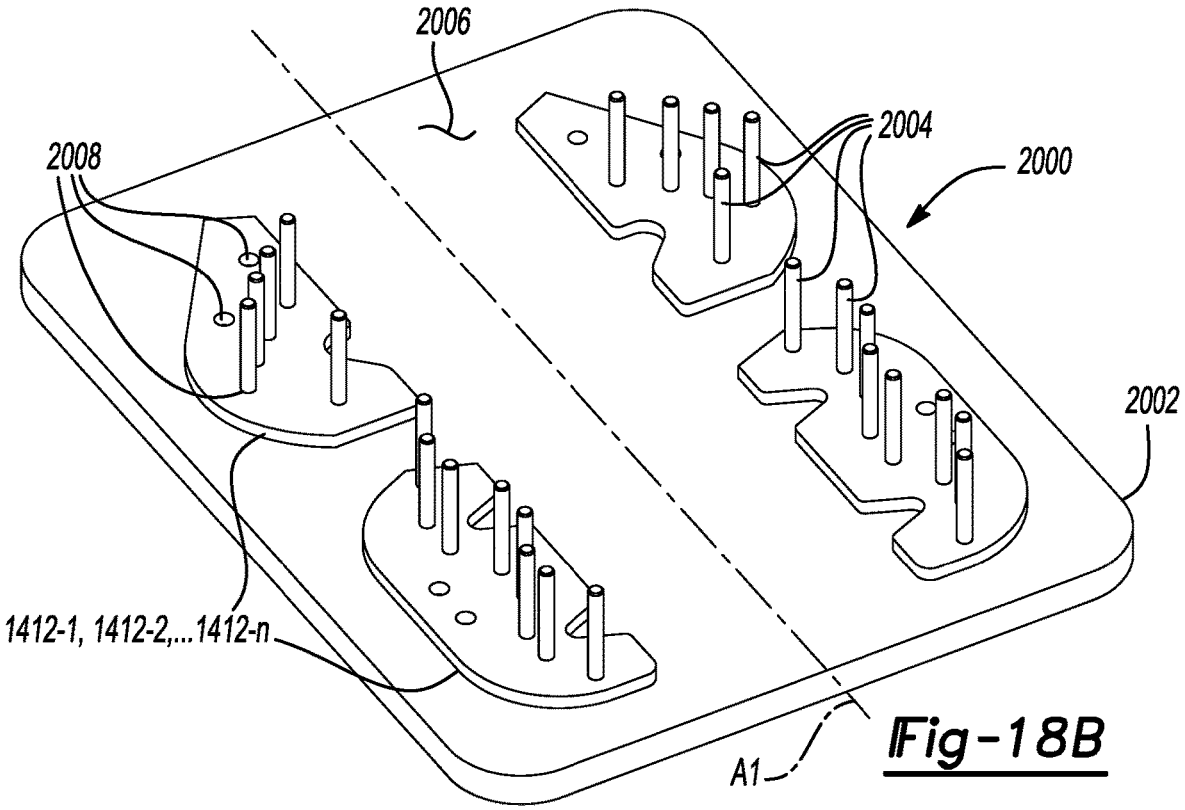
FIG. 18B is a perspective view of a portion of a lacing system disposed on the pin board of FIG. 18A in accordance with the principles of the present disclosure.

With reference to FIG. 18B, the method may also include assembling one or more of the sheets 1412-1, 1412-2, . . .

1412-*n* of material onto the pin board 2000. For example, the method may include assembling one or more sheets 1412-1, 1412-2, . . . 1412-*n* of textile, foam, leather, synthetic leather, or TPU onto the pin board 2000. As previously described, in some implementations, one of the sheets 1412-1, 1412-2, . . . 1412-*n* may include a portion (e.g., the upper 1200 or the tongue 1210) of the footwear 1110, 1110*c*, a portion of the article of clothing 1800, or a portion of the bag 1900. Assembling the one or more sheets 1412-1, 1412-2, . . . 1412-*n* of material to the pin board 2000 may include extending one or more of the attachment features 2004 through a corresponding one or more apertures 2008 formed through each of the sheets 1412-1, 1412-2, . . . 1412-*n* of material. As illustrated in FIG. 18B, in some implementations, the sheets 1412-1, 1412-2, . . . 1412-*n* may be assembled in a symmetric arrangement relative to the longitudinal axis A1.

Figure 18C:
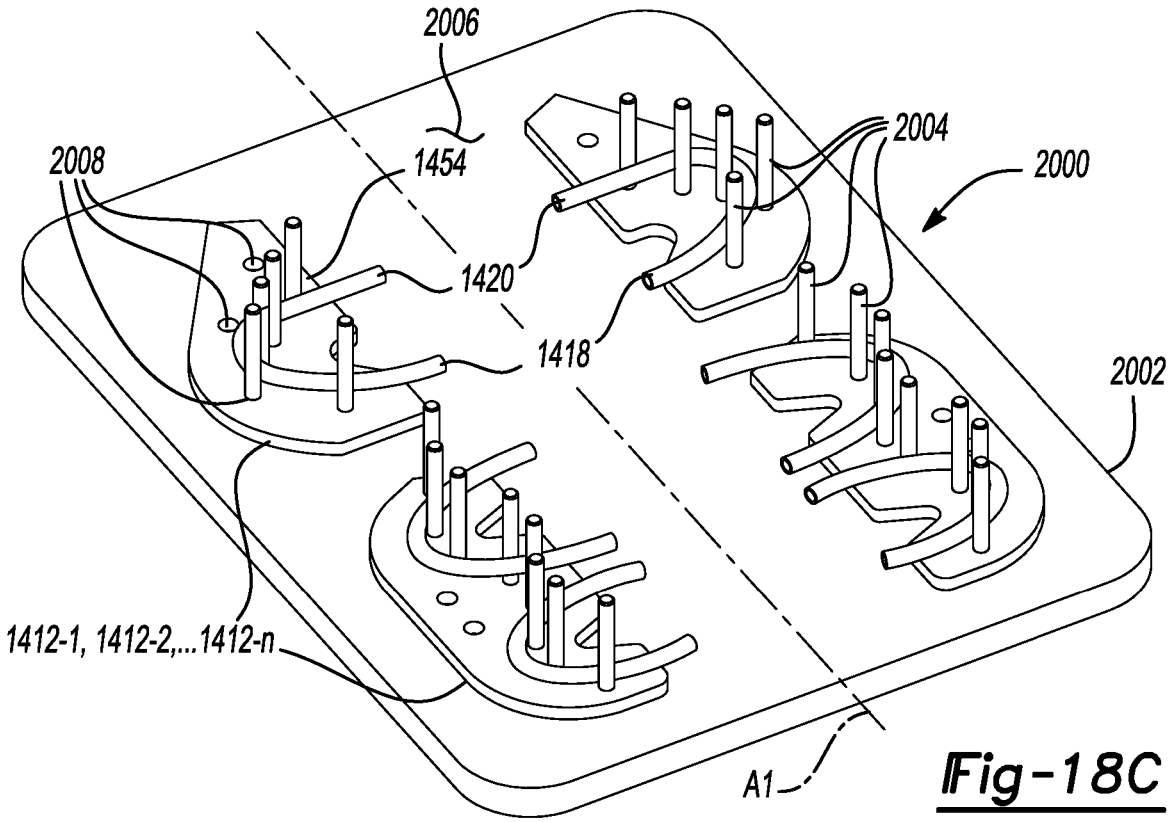
FIG. 18C is a perspective view of a portion of a lacing system disposed on the pin board of FIG. 18A in accordance with the principles of the present disclosure.

With reference to FIG. 18C, the method may further include assembling one or more of the lace guides 1410-1, 1410-2, . . . 1410-*n* onto the pin board 2000, such that the lace guides 1410-1, 1410-2, . . . 1410-*n* engage the sheets 1412-1, 1412-2, . . . 1412-*n* of material. As previously described, the lace guides 1410-1, 1410-2, . . . 1410-*n* may be disposed on the sheets 1412-1, 1412-2, . . . 1412-*n* of material such that the proximal and distal ends 1418, 1420 extend beyond the outer edge 1455 defined by the sheets 1412-1, 1412-2, . . . 1412-*n* of material. In some implementations, the method may include bending or otherwise forming one or more of the lace guides 1410-1, 1410-2, . . . 1410-*n* into an arcuate shape (e.g., C-shape, U-shape, S-shape, etc.) prior to assembling the lace guides 1410-1, 1410-2, . . . 1410-*n* onto the pin board 2000, or during assembly of the lace guides 1410-1, 1410-2, . . . 1410-*n* onto the pin board 2000, such that the attachment features 2004 secure and maintain both the shape and location of the lace guides 1410-1, 1410-2, . . . 1410-*n*. In other implementations, the lace guides 1410-1, 1410-2, . . . 1410-*n* may be pre-formed in an arcuate shape, such that the attachment features 2004 secure and maintain the location of the lace guides 1410-1, 1410-2, . . . 1410-*n*. As illustrated in FIG. 18C, in some implementations, the lace guides 1410-1, 1410-2, . . . 1410-*n* may be assembled in a symmetric arrangement relative to the longitudinal axis A1.

Figure 18D:
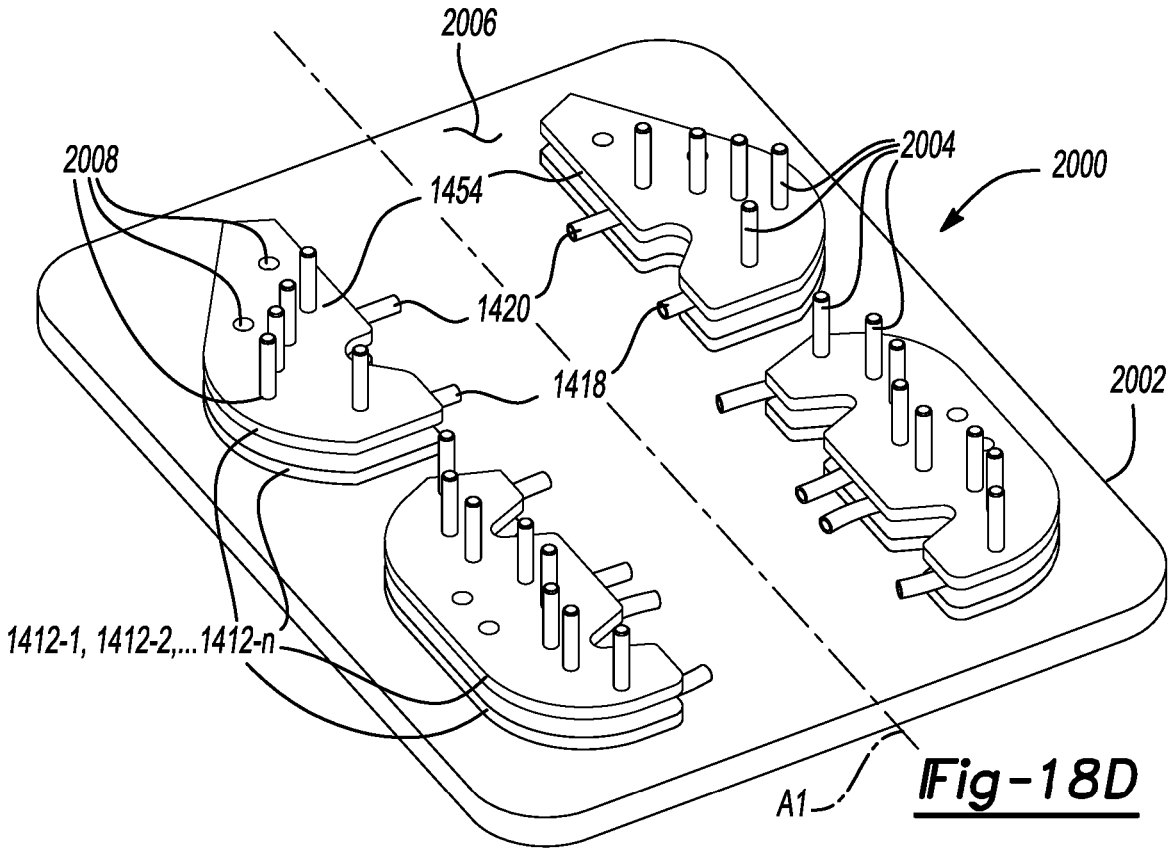
FIG. 18D is a perspective view of a portion of a lacing system disposed on the pin board of FIG. 18A in accordance with the principles of the present disclosure.

With reference to FIG. 18D, the method may also include assembling one or more of the sheets 1412-1, 1412-2, . . . 1412-*n* of material onto the pin board 2000 such that the lace guides 1410-1, 1410-2, . . . 1410-*n* are disposed and secured between sheets 1412-1, 1412-2, . . . 1412-*n* of material in a sandwich configuration. For example, the method may include assembling one or more sheets 1412-1, 1412-2, . . . 1412-*n* of textile, foam, leather, synthetic leather, or TPU onto the pin board 2000. As previously described, in some implementations, at least one of the sheets 1412-1, 1412-2, . . . 1412-*n* engaging the lace guides 1410-1, 1410-2, . . . 1410-*n* may include TPU. As previously described, assembling the one or more sheets 1412-1, 1412-2, . . . 1412-*n* of material to the pin board 2000 may include extending one or more of the attachment features 2004 through a corresponding one or more apertures 2008 formed through each of the sheets 1412-1, 1412-2, . . . 1412-*n* of material. The sheets 1412-1, 1412-2, . . . 1412-*n* of material may be assembled such that the proximal and distal ends 1418, 1420 of the lace guides 1410-1, 1410-2, . . . 1410-*n* extend beyond the outer edge 1455 defined by the sheets 1412-1, 1412-2, . . . 1412-*n* of material. As illustrated in FIG. 18D, in some implementations, the sheets 1412-1, 1412-2, . . . 1412-*n* may be assembled in a symmetric arrangement relative to the longitudinal axis A1.

Upon arranging the lace guides 1410-1, 1410-2, . . . 1410-*n* and sheets 1412-1, 1412-2, . . . 1412-*n* of material onto the pin board 2000, the method may include securing the lace guides 1410-1, 1410-2, . . . 1410-*n* relative to the sheets 1412-1, 1412-2, . . . 1412-*n* of material. In some implementations, the method may include applying heat and/or pressure to the sheets 1412-1, 1412-2, . . . 1412-*n* of material to melt one or more of the sheets 1412-1, 1412-2, . . . 1412-*n*. For example, as previously described, one or more of the sheets 1412-1, 1412-2, . . . 1412-*n* may include TPU such that, upon the application of heat at a temperature above the melting point of the TPU sheet(s) but below the melting temperature of the lace guides 1410-1, 1410-2, . . . 1410-*n*, one or more sheets 1412-1, 1412-2, . . . 1412-*n* melts. Upon removal of the heat, the one or more sheets 1412-1, 1412-2, . . . 1412-*n* may solidify such that it is bonded, secured and/or sealed to one or more of the lace guides 1410-1, 1410-2, . . . 1410-*n* and/or another of the one or more sheets 1412-1, 1412-2, . . . 1412-*n*. In other implementations, the lace guides 1410-1, 1410-2, . . . 1410-*n* may be secured, or otherwise defined, relative to the sheets 1412-1, 1412-2, . . . 1412-*n* of material using other techniques, such as stitching (e.g., FIG. 14C) and/or an adhesive, for example. Upon securing the lace guides 1410-1, 1410-2, . . . 1410-*n* relative to the sheets 1412-1, 1412-2, . . . 1412-*n* of material, the resulting assembly or assemblies may substantially define one or more of the lace receiving assemblies 1404-1, 1404-2, . . . 1404-*n*.

Figure 18E:
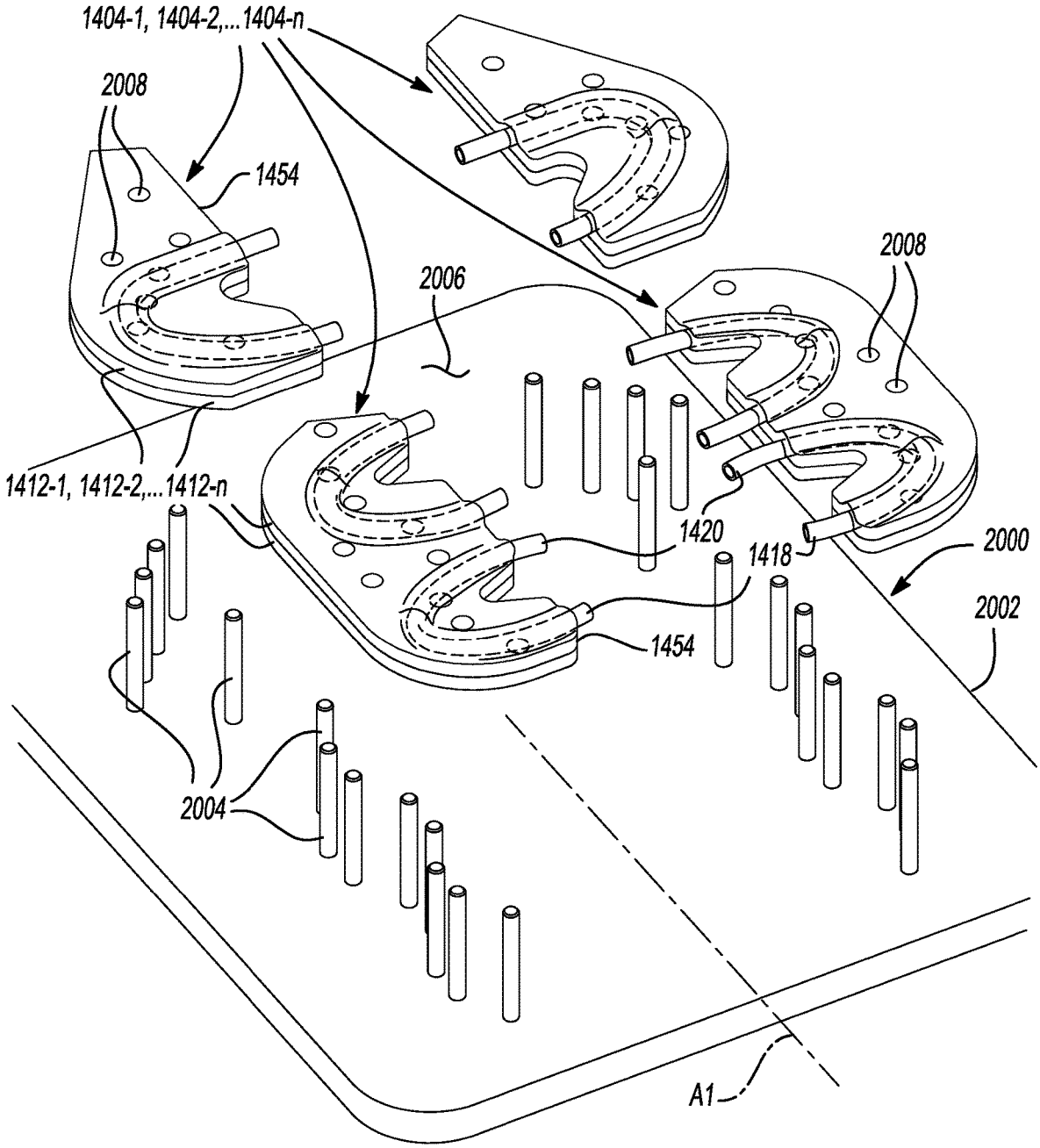
FIG. 18E is a perspective view of a portion of a lacing system removed from the pin board of FIG. 18A in accordance with the principles of the present disclosure.

With reference to FIG. 18E, the method may also include removing the one or more lace receiving assemblies 1404-1, 1404-2, . . . 1404-*n* from the pin board 2000. Upon removing the lace receiving assemblies 1404-1, 1404-2, . . . 1404-*n* from the pin board 2000, the lace receiving assemblies 1404-1, 1404-2, . . . 1404-*n* may be assembled to the article of footwear 1110*a*, 1110*c*, the article of clothing 1800, or the bag 1900 using one or more of a variety of techniques (e.g., stitching, adhesive, hot melt, etc.) known in the art. If one of the sheets 1412-1, 1412-2, . . . 1412-*n* of material forms a portion of the article of footwear 1110*a*, 1110*c*, the article of clothing 1800, or the bag 1900, the entire assembly may be removed from the pin board 2000 and may be subsequently formed into the completed article of footwear 1110*a*, 1110*c*, the article of clothing 1800, or the bag 1900. For example, the portion of the assembly that forms a portion of the article of footwear 1110*a*, 1110*c* may be removed from the pin board 2000 and shaped around a last (not shown) to be formed into a shape of the last.

Referring to FIGS. 12A, 12B, and 15-17, the laces 1402-1, 1402-2, . . . 1402-*n* are movable within the lace guides 1410-1, 1410-2, . . . 1410-*n* when, for example, a force is applied to the laces 1402-1, 1402-2, . . . 1402-*n*. Accordingly, when a force is applied to the laces 1402-1, 1402-2, . . . 1402-*n*, the laces may translate through the lace guides 1410-1, 1410-2, . . . 1410-*n* to apply a force on a portion of the article (e.g., article of footwear 1110, 1110*c*, article of clothing 1800, or bag 1900) to close an opening (e.g., opening 1204, opening 1802, or opening 1902) of the article and/or move the article into a tightened state. For example, once a foot is received by the interior void 1202 and supported on the sole structure 1300 of the article of footwear 1110, a force applied in the direction F to the laces 1402-1, 1402-2, . . . 1402-*n* causes the upper 1200 to be tightened, thereby securing the fit of the interior void 1202 around the foot. In some examples, a desired fit of the interior void 1202 around the foot is adjustable based upon a magnitude of the force applied to the laces 1402-1, 1402-2, . . . **1402-*n* in the direction F. For instance, increasing the magnitude of the force may move the laces 1402-1, 1402-2, . . . 1402-*n* by a greater distance through the lace guides 1410-1, 1410-2, . . . 1410-*n* to achieve a tighter fit of the interior void 1202** around the foot.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

EXAMPLES

The present inventors have recognized, among other things, a need for an improved lacing architecture for automated and semi-automated tightening of shoe laces. This document describes, among other things, example lacing architectures, example lace guides used in the lacing architectures, and related assembly techniques for automated footwear platforms. The following examples provide a non-limiting examples of the actuator and footwear assembly discussed herein.

Example 1 describes subject matter including a footwear assembly with a lacing architecture to facilitate automated tightening. In this example, the footwear assembly can include a footwear upper including a toe box portion, a medial side, a lateral side, and a heel portion, the medial side and the lateral side each extending proximally from the toe box portion to a heel portion. The footwear assembly can also include a lace cable running through a plurality of lace guides. The lace cable can include a first end anchored along a distal outside portion of the medial side and a second end anchored along a distal outside portion of the lateral side. The plurality of lace guides can be distributed along the medial side and the lateral side, and each lace guide of the plurality of lace guides can be adapted to receive a length of the lace cable. In this example, the lace cable can extend through each of the plurality of lace guides to form a pattern along each of the medial side and lateral side of the footwear upper. The footwear assembly can also include a medial proximal lace guide routing the lace cable from the pattern formed by a medial portion of the plurality of lace guides into a position allowing the lace cable to engage a lacing engine disposed within a mid-sole portion. Finally, the footwear assembly includes a lateral proximal lace guide to route the lace cable out of the position allowing the lace cable to engage the lacing engine into the pattern formed by a lateral portion of the plurality of lace guides.

In example 2, the subject matter of example 1 can optionally include each lace guide of the plurality of lace guides forming a u-shaped channel to retain the lace cable.

In example 3, the subject matter of example 2 can optionally include the u-shaped channel in each lace guide is an open channel allowing a lace loop to be pulled into the lace guide.

In example 4, the subject matter of example 2 can optionally include the u-shaped channel in each lace guide being formed with a tubular structure bent or formed in a u-shape with the lace cable threaded through the tubular structure.

In example 5, the subject matter of any one of examples 1 to 4 can optionally include the pattern being shaped to flatten a force or torque verses lace displacement curve during tightening of the lace cable.

In example 6, the subject matter of any one of examples 1 to 5 can optionally include each lace guide of the plurality of lace guides being secured to the footwear upper with an overlay including heat-activated adhesive compressed over each lace guide.

In example 7, the subject matter of example 6 can optionally include the overlay being a fabric impregnated with the heat-activated adhesive.

In example 8, the subject matter of example 6 can optionally include portions of each lace guide extending beyond the overlay securing each lace guide.

In example 9, the subject matter of any one of examples 1 to 8 can optionally include each lace guide of the plurality of lace guides being at least initially secured to the footwear upper by stitching.

In example 10, the subject matter of example 9 can optionally include each lace guide of the plurality of lace guides being further secured to the footwear upper with an overlay including heat-activated adhesive compressed over each lace guide.

In example 11, the subject matter of any one of examples 1 to 10 can optionally include the pattern formed with the lace guides creating a substantially sinusoidal wave along each of the medial side and the lateral side of the footwear upper.

In example 12, the subject matter of example 11 can optionally include the substantially sinusoidal wave being a modified sine wave including larger radius curves at crests and troughs in comparison to a standard sine wave.

In example 13, the subject matter of any one of examples 1 to 12 can optionally include the pattern including three upper lace guides proximate the centerline of the footwear upper on each of the medial side and the lateral side.

In example 14, the subject matter of example 13 can optionally include each of the three upper lace guides on each of the medial side and the lateral side being spaced a different distance from the centerline.

In example 15, the subject matter of any one of examples 1 to 14 can optionally include the footwear upper having an elastic centerline portion extending from at least the toe box portion proximally to a foot opening.

In example 16, the subject matter of any one of examples 1 to 15 can optionally include pairs of lace guides being connected across a centerline portion of the footwear upper by elastic members.

In example 17, the subject matter of example 16 can optionally include the elastic members being adapted to smooth out a torque versus lace displacement curve during tightening of the lace cable.

In example 18, the subject matter of example 16 can optionally include the elastic members being interchangeable with different elastic members providing varying modulus of elasticity to change fit characteristics of the footwear upper.

In example 19, the subject matter of any one of examples 1 to 18 can optionally include the footwear upper including a zipper extending from the toe box portion to a foot opening between a medial portion of the plurality of lace guides and a lateral portion of the plurality of lace guides.

In example 20, the subject matter of any one of examples 1 to 19 can optionally include the pattern preventing the lace cable from crossing over a central portion of the footwear upper between the medial side and the lateral side.

Example 21 describes subject matter including a footwear assembly with a lacing architecture to facilitate automated tightening. In this example, the lacing architecture for an automated footwear platform can include a lace cable routed through a plurality of lace guides. The lace cable can include a first end anchored along a distal outside portion of a medial side of an upper portion of a footwear assembly and a second end anchored along a distal outside portion of a lateral side of the upper portion. The plurality of lace guides can be distributed in a first pattern along the medial side and in a second pattern along the lateral side. Additionally, each lace guide of the plurality of lace guides can include an open lace channel to receive a length of the lace cable. The lacing architecture can also include a medial proximal lace guide for routing the lace cable from the first pattern formed by a medial portion of the plurality of lace guides into a position allowing the lace cable to engage a lacing engine disposed within a mid-sole portion. Finally, in this example, the lacing architecture can also include a lateral proximal lace guide to route the lace cable out of the position allowing the lace cable to engage the lacing engine into the second pattern formed by a lateral portion of the plurality of lace guides.

In example 22, the subject matter of example 21 can optionally include each lace guide of the plurality of lace guides including a lace retention member extending into the open lace channel to assist in retaining the lace cable within the lace guide.

In example 23, the subject matter of example 22 can optionally include each lace guide of the plurality of lace guides having a lace access opening opposite the lace retention member, the lace access opening providing clearance to route the cable around the lace retention member.

In example 24, the subject matter of any one of examples 21 to 23 can optionally include each lace guide of the plurality of lace guides having a stitch opening along a superior portion of the lace guide, the stitch opening enabling the lace guide to be at least partially secure to the upper portion by stitching.

ADDITIONAL NOTES

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Although an overview of the inventive subject matter has been described with reference to specific example embodiments, various modifications and changes may be made to these embodiments without departing from the broader scope of embodiments of the present disclosure. Such embodiments of the inventive subject matter may be referred to herein, individually or collectively, by the term "invention" merely for convenience and without intending to voluntarily limit the scope of this application to any single disclosure or inventive concept if more than one is, in fact, disclosed.

The embodiments illustrated herein are described in sufficient detail to enable those skilled in the art to practice the teachings disclosed. Other embodiments may be used and derived therefrom, such that structural and logical substitutions and changes may be made without departing from the scope of this disclosure. The disclosure, therefore, is not to be taken in a limiting sense, and the scope of various embodiments includes the full range of equivalents to which the disclosed subject matter is entitled.

As used herein, the term "or" may be construed in either an inclusive or exclusive sense. Moreover, plural instances may be provided for resources, operations, or structures described herein as a single instance. Additionally, boundaries between various resources, operations, modules, engines, and data stores are somewhat arbitrary, and particular operations are illustrated in a context of specific illustrative configurations. Other allocations of functionality are envisioned and may fall within a scope of various embodiments of the present disclosure. In general, structures and functionality presented as separate resources in the example configurations may be implemented as a combined structure or resource. Similarly, structures and functionality presented as a single resource may be implemented as separate resources. These and other variations, modifications, additions, and improvements fall within a scope of embodiments of the present disclosure as represented by the appended claims. The specification and drawings are, accordingly, to be regarded in an illustrative rather than a restrictive sense.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method (process) examples described herein, such as the footwear assembly examples, can include machine or robotic implementations at least in part.

The above description is intended to be illustrative, and not restrictive. For example, the above-described examples (or one or more aspects thereof) may be used in combination with each other. Other embodiments can be used, such as by one of ordinary skill in the art upon reviewing the above description. An Abstract, if provided, is included to comply with 37 C.F.R. § 1.72(b), to allow the reader to quickly ascertain the nature of the technical disclosure. It is submitted with the understanding that it will not be used to interpret or limit the scope or meaning of the claims. Also, in the above Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A lace-receiving assembly comprising:

a first sheet including a hot melt adhesive or a thermoplastic polyurethane having a first surface and a second surface opposite the first surface;

a second sheet including a hot melt adhesive or a thermoplastic polyurethane having a third surface and a fourth surface opposite the third surface, the third surface bonded to the first surface to define a channel extending between the first sheet and the second sheet;

a lace guide having an outer surface facing the first surface and the third surface within the channel;

a third sheet including at least one of a textile, a foam, a leather, and a synthetic leather having a fifth surface and a sixth surface opposite the fifth surface, the fifth surface bonded to the fourth surface of the second sheet;

a fourth sheet including at least one of a textile, a foam, a leather, and a synthetic leather having a seventh surface and an eighth surface opposite the seventh surface, the seventh surface bonded to the second surface of the first sheet; and a fifth sheet having a ninth surface and a tenth surface opposite the ninth surface, the ninth surface bonded to the eighth surface of the fourth sheet.

2. The lace-receiving assembly of claim 1, wherein the fifth sheet includes a material selected from a group consisting of a hot melt adhesive or a thermoplastic polyurethane.

3. The lace-receiving assembly of claim 1, further comprising a sixth sheet having an eleventh surface and an twelfth surface opposite the eleventh surface, the eleventh surface bonded to the tenth surface of the fifth sheet.

4. The lace-receiving assembly of claim 1, wherein the lace guide includes a conduit.

5. The lace-receiving assembly of claim 4, wherein the conduit includes a proximal end and a distal end, the proximal end defining a first opening, the distal end defining a second opening in fluid communication with the first opening.

6. An article including a first side, a second side opposite the first side, and an opening between the first side and the second side, the article comprising:

a first lace-receiving assembly disposed on the first side and including:

a first sheet including a hot melt adhesive or a thermoplastic polyurethane having a first surface and a second surface opposite the first surface;

a second sheet including a hot melt adhesive or a thermoplastic polyurethane having a third surface and a fourth surface opposite the third surface, the third surface bonded to the first surface to define a first channel extending between the first sheet and the second sheet;

a first lace guide having an outer surface facing the first surface and the third surface within the first channel;

a third sheet including at least one of a textile, a foam, a leather, and a synthetic leather having a fifth surface and a sixth surface opposite the fifth surface, the fifth surface bonded to the fourth surface of the second sheet;

a fourth sheet including at least one of a textile, a foam, a leather, and a synthetic leather having a seventh surface and an eighth surface opposite the seventh surface, the seventh surface bonded to the second surface of the first sheet; and a fifth sheet having a ninth surface and a tenth surface opposite the ninth surface, the ninth surface bonded to the eighth surface of the fourth sheet.

7. The article of claim 6, wherein the article includes one of an article of footwear, an article of clothing, and a bag.

8. The article of claim 6, further comprising a lace extending through the first lace guide, the lace operable to reduce the opening when tightened by bringing the first side and the second side closer together.

9. The article of claim 6, wherein the first lace guide includes a conduit.

10. The article of claim 9, wherein the conduit includes a proximal end and a distal end, the proximal end defining a first opening, the distal end defining a second opening in fluid communication with the first opening.

11. The article of claim 10, wherein the conduit defines an arcuate shape extending between the proximal end and the distal end.

12. The article of claim 11, wherein the arcuate shape is selected from a group consisting of a C-shape, a U-shape, and an S-shape.

13. The article of claim 10, wherein the conduit includes a passage extending between the first opening and the second opening, the passage defined by an inner surface of the conduit.

14. A method of manufacturing a lace-receiving assembly, the method comprising:

providing a first sheet including a hot melt adhesive or a thermoplastic polyurethane having a first surface and a second surface opposite the first surface;

bonding the first surface to a third surface of a second sheet including a hot melt adhesive or a thermoplastic polyurethane to define a channel extending between the first sheet and the second sheet, the second sheet including a fourth surface opposite the third surface;

positioning a lace guide within the channel, the lace guide having an outer surface facing the first surface and the third surface of the second sheet;

bonding the fourth surface of the second sheet to a fifth surface of a third sheet including at least one of a textile, a foam, a leather, and a synthetic leather, the third sheet having a sixth surface opposite the fifth surface;

bonding the second surface of the first sheet to a seventh surface of a fourth sheet including at least one of a textile, a foam, a leather, and a synthetic leather, the fourth sheet including an eighth surface opposite the seventh surface; and bonding the eighth surface of the fourth sheet to a ninth surface of a fifth sheet, the fifth sheet including a tenth surface opposite the ninth surface.

15. The method of claim 14, further comprising:

providing a pin board having a plurality of pins extending therefrom;

extending at least one of the plurality of pins through the first sheet; and extending at least one of the plurality of pins through the second sheet.

16. The method of claim 15, wherein positioning the lace guide within the channel includes positioning the lace guide on the first surface of the first sheet.

17. The method of claim 16, wherein positioning the lace guide on the first surface of the first sheet includes engaging the lace guide with one or more of the plurality of pins.

* * * * *